United States Patent [19]

Tanco

[11] 3,959,635

[45] May 25, 1976

[54] SYSTEM AND METHOD FOR OPERATING A STEAM TURBINE WITH DIGITAL COMPUTER CONTROL HAVING IMPROVED AUTOMATIC STARTUP CONTROL FEATURES

[75] Inventor: Juan J. Tanco, Buenos Aires, Argentina

[73] Assignee: Westinghouse Electric Corporation, Pittsburgh, Pa.

[22] Filed: Apr. 26, 1972

[21] Appl. No.: 247,598

Related U.S. Application Data

[63] Continuation-in-part of Ser. No. 247,440, April 25, 1972, abandoned, which is a continuation-in-part of Ser. No. 246,900, April 24, 1972, abandoned.

[52] U.S. Cl. ..... 235/151.1; 235/151.3; 444/1; 290/40 R

[51] Int. Cl.[2] ..... F01D 19/02; G05B 15/00; H02P 9/00

[58] Field of Search ..... 235/151.21, 151.34, 235/151.3, 151.1, 151; 415/17, 14; 60/646; 290/40; 444/1; 340/172.5

[56] References Cited

UNITED STATES PATENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,588,265 | 6/1971 | Berry | 415/17 X |

OTHER PUBLICATIONS

Application of the Prodac 50 System to Direct Digital Control, J. C. Belz, G. J. Kirk, & P. S. Radcliffe, IEEE Intl. Conv. Rec. Part 3, 1965, pp. 102–122.

Monitoring and Automatic Control in Steam Power Stations by Process Computer, E. Doetsch & G. Hirschberg, Siemens Review XXXV(1968), No. 12, pp. 471–476.

*Primary Examiner*—Edward J. Wise

*Attorney, Agent, or Firm*—E. F. Possessky

[57] ABSTRACT

A steam turbine operates with a control system having a programmed digital computer for automatically controlling steam flow to satisfy turbine speed or load demand during turbine startup, synchronization and load operation. Steam flow is controlled throughout the entire startup sequence by means of speed control signals determined by the computer as a function of monitored turbine operating conditions. While under load operation the turbine is under digital computer load control, and operational parameters are monitored by the digital computer.

34 Claims, 58 Drawing Figures

TABLE 1-1. TASK PRIORITY ASSIGNMENT

FIG. 9

| Level | Function | Frequency | Core Location |
|---|---|---|---|
| F | STOP/INITIALIZE | ON DEMAND | 2F40 |
| E | AUXILIARY SYNCHRONIZER | 0.1 SEC | 14BD |
| D | CONTROL | 1.0 SEC | 2730 |
| C | OPERATOR'S PANEL | ON DEMAND | 21B0 |
| B | ANALOG SCAN | 0.5 SEC | 16D0 |
| A | ATS-PERIODICS | 1.0 SEC | 4420 |
| 9 | LOGIC | ON DEMAND | 1962 |
| 8 | VISUAL DISPLAY | 1.0 SEC | 1E60 |
| 7 | DATA LINK | ON DEMAND | 3D10 |
| 6 | ATS-ANALOG CONVERSIONS | 5.0 SEC | 6960 |
| 5 | FLASH | 0.5 SEC | 15A0 |
| 4 | PROGRAMMER'S CONSOLE | ON DEMAND | 3000 |
| 3 | ATS-MESSAGE WRITER | 5.0 SEC | 6CA0 |
| 2 | ANALOG/DIGITAL TREND | 1.0 SEC | 3E70 |
| 1 | CCO TEST* | ON DEMAND | 0E80 |
| 0 | BATCH PROCESSORS** | ON DEMAND | 4000 |

*The CCO test task may be used only during maintenance and debugging periods, since this program overlays the data link program area.

**The batch processors may be used only on manual control and with the sync disabled; also, the sequence of events interrupt must be disabled since the batch processor programs overlay the ATS program area.

TABLE 1-2. CORE MAP 1—FINAL OPERATING VERSION

FIG. 10

| Starting Location | Program | Size | |
|---|---|---|---|
| | | Dec | Hex |
| 0 | FAM FAST ACCESS MEMORY | 32 | 20 |
| 20 | SEQUENCE OF EVENTS INTERRUPT | 32 | 20 |
| 40 | VALVE INTERRUPT | 96 | 60 |
| A0 | ZERO TABLE | 96 | 60 |
| 100 | SRI TABLE | 32 | 20 |
| 120 | PLANTCCI SUBROUTINE | 120 | 78 |
| 198 | SPEED CHANNEL 1 INTERRUPT | 47 | 2F |
| 1C7 | SPEED CHANNEL 2 INTERRUPT | 25 | 19 |
| 1E0 | CCO IMAGE TABLE | 32 | 20 |
| 200 | MONITOR | 3162 | C5A |
| E5A | MONITOR PATCHES | 6 | 6 |
| E60 | MONITOR SPARE | 32 | 20 |
| E80 | DATA LINK-SPARE TERMINAL | 16 | 10 |
| E92 | DATA LINK-DT INTERRUPT | 40 | 28 |
| EBA | DATA LINK-CONTROL WORDS | 10 | A |
| EC4 | DATA LINK-INPUT BUFFER | 10 | A |
| ECE | DATA LINK-OUTPUT BUFFER | 50 | 32 |
| F00 | SYSTEM LIBRARY | 618 | 26A |
| 116A | BREAKER OPEN INTERRUPT | 22 | 16 |

1850

REFDMD
SPEED FEEDBACK LOOP
REF1
REF2
RESMW
MW
GR3
PISP
IPI
PI
RESPI
VSP
1876

REFDMD
SPEED FEEDBACK LOOP
REF1
MWI
1087
1089
1086
REF2
RESMW
1084
1082
MW
1091

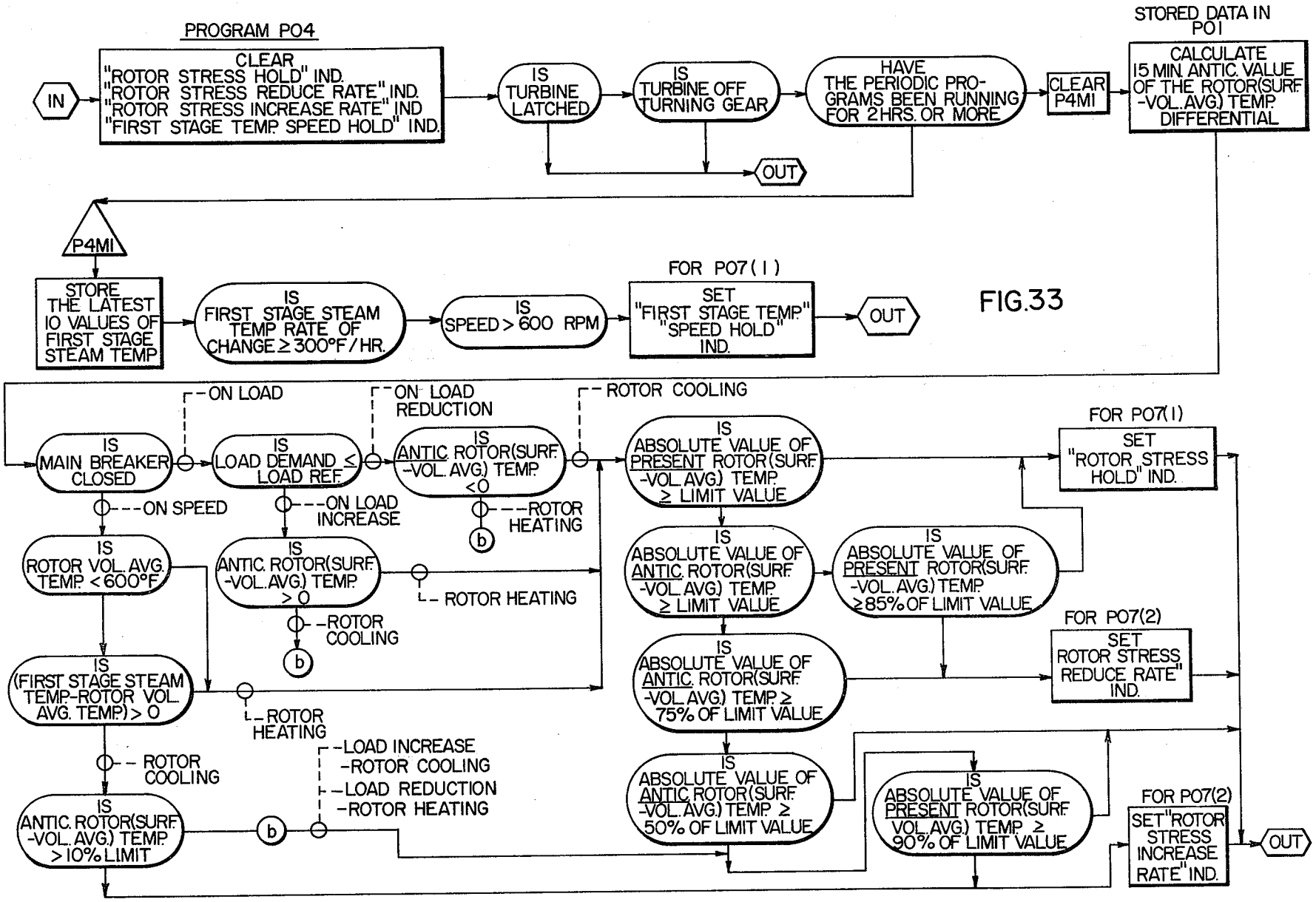
PROGRAM P04
IN
CLEAR "ROTOR STRESS HOLD" IND. "ROTOR STRESS REDUCE RATE" IND. "ROTOR STRESS INCREASE RATE" IND. "FIRST STAGE TEMP. SPEED HOLD" IND.
IS TURBINE LATCHED
IS TURBINE OFF TURNING GEAR
OUT
HAVE THE PERIODIC PROGRAMS BEEN RUNNING FOR 2HRS. OR MORE
CLEAR P4MI
STORED DATA IN P01
CALCULATE 15 MIN. ANTIC. VALUE OF THE ROTOR(SURF.-VOL. AVG.) TEMP. DIFFERENTIAL
P4MI
STORE THE LATEST 10 VALUES OF FIRST STAGE STEAM TEMP
IS FIRST STAGE STEAM TEMP RATE OF CHANGE ≥ 300°F/HR.
IS SPEED > 600 RPM
FOR P07(1)
SET "FIRST STAGE TEMP." "SPEED HOLD" IND.
OUT
FIG.33
ROTOR COOLING
ON LOAD
ON SPEED
IS MAIN BREAKER CLOSED
IS ROTOR VOL. AVG. TEMP. < 600°F
IS (FIRST STAGE STEAM TEMP.-ROTOR VOL. AVG. TEMP.) > 0
ROTOR COOLING
IS ANTIC. ROTOR(SURF.-VOL. AVG.) TEMP. > 10% LIMIT
ON LOAD REDUCTION
IS LOAD DEMAND < LOAD REF.
ON LOAD INCREASE
IS ANTIC. ROTOR(SURF.-VOL. AVG.) TEMP. < 0
ROTOR HEATING
b
IS ANTIC. ROTOR(SURF.-VOL. AVG.) TEMP. > 0
ROTOR COOLING
b
ROTOR HEATING
ROTOR HEATING
LOAD INCREASE
ROTOR COOLING
LOAD REDUCTION
ROTOR HEATING
b
IS ABSOLUTE VALUE OF PRESENT ROTOR(SURF.-VOL. AVG.) TEMP. ≥ LIMIT VALUE
FOR P07(1)
SET "ROTOR STRESS HOLD" IND.
IS ABSOLUTE VALUE OF ANTIC. ROTOR(SURF.-VOL. AVG.) TEMP. ≥ LIMIT VALUE
IS ABSOLUTE VALUE OF PRESENT ROTOR(SURF.-VOL. AVG.) TEMP. ≥85% OF LIMIT VALUE
FOR P07(2)
SET ROTOR STRESS REDUCE RATE" IND.
IS ABSOLUTE VALUE OF ANTIC. ROTOR(SURF.-VOL. AVG.) TEMP. ≥ 75% OF LIMIT VALUE
IS ABSOLUTE VALUE OF ANTIC. ROTOR(SURF.-VOL. AVG.) TEMP. ≥ 50% OF LIMIT VALUE
IS ABSOLUTE VALUE OF PRESENT ROTOR(SURF.-VOL. AVG.) TEMP. ≥ 90% OF LIMIT VALUE
FOR P07(2)
SET "ROTOR STRESS INCREASE RATE" IND.
OUT

CHART 1

| INDEX NO. | ACCELERATION RATE(RPM/MIN) |
|---|---|
| 1 | 50 |
| 2 | 100 |
| 3 | 200 |
| 4 | 300 |
| 5 | 400 |
| 6 | 500 |
| 7 | 600 |
| 8 | 700 |
| 9 | 800 |
| | |

CHART 2

| BUILDING BLOCK # | ACTUAL RPM OF TURBINE ROTOR | | | | | | | | | | | |
|---|---|---|---|---|---|---|---|---|---|---|---|---|
| | $X_1$ | $Y_1$ | $Z_1$ | $X_2$ | $Y_2$ | $Z_2$ | $X_3$ | $Y_3$ | $Z_3$ | $X_4$ | $Y_4$ | $Z_4$ |
| 70 | 1680 | 1750 | 1650 | 1870 | 1970 | 1850 | 2360 | 2460 | 2340 | 2600 | 2690 | 2540 |
| 71, 271 | 1770 | 2020 | 1750 | 2320 | 2470 | 2290 | 2520 | 2640 | 2490 | — | — | — |
| 72 | 1970 | 2070 | 1930 | 2440 | 2570 | 2400 | 2800 | 2930 | 2780 | — | — | — |
| 73 | 1850 | 1940 | 1800 | 2310 | 2400 | 2260 | 2620 | 2740 | 2410 | — | — | — |
| 80 | 900 | 1000 | 880 | 1170 | 1220 | 1140 | 1290 | 1360 | 1260 | — | — | — |
| 81, 281 | 920 | 940 | 900 | 990 | 1020 | 960 | 1200 | 1240 | 1170 | 1270 | 1320 | 1240 |
| | | | | | | | | | | | | |
| | | | | | | | | | | | | |

| | | EXPECTED GEN. STATOR COIL DISCH. GAS OR $H_2O$ TEMP. RISE = | GEN. STATOR COIL DISCHARGE GAS OR $H_2O$ RISE LIMIT = |
|---|---|---|---|
| HYDROGEN COOLED GENERATORS | WITH SINGLE VENT STATOR COILS 60 PSIG RATED GAS PRESSURE | $36\left(\frac{74.7}{14.7+PSIG}\right)\left(\frac{I_{SA}}{I_S}\right)^2$ | $40+\left(\frac{60-PSIG}{7.5}\right)$ |
| | WITH DOUBLE VENT STATOR COILS 60 PSIG RATED GAS PRESSURE | $50\left(\frac{74.7}{14.7+PSIG}\right)\left(\frac{I_{SA}}{I_S}\right)^2$ | $55+\left(\frac{60-PSIG}{15}\right)$ |
| | WITH DOUBLE VENT STATOR COILS 75 PSIG RATED GAS PRESSURE | $50\left(\frac{89.7}{14.7+PSIG}\right)\left(\frac{I_{SA}}{I_S}\right)^2$ | $55+\left(\frac{75-PSIG}{15}\right)$ |
| | WITH WATER COOLED STATOR COILS 75 PSIG RATED GAS PRESSURE | $30\left(\frac{I_{SA}}{I_S}\right)^2$ | 35 |
| CONVENTIONALLY COOLED GENERATORS | | EXPECTED EMBEDDED STATOR COIL RTD RISE = $45\left(\frac{44.7}{18.7+RISE}\right)^{.68}\left(\frac{I_{SA}}{I_S}\right)^2$ | EMBEDDED STATOR COIL RTD RISE LIMIT = $50+\left(\frac{30-PSIG}{2}\right)$ |

CHART I
(SEE NOTE 2)

NOTE 2. $I_{SA}$ = ACTUAL GENERATOR STATOR CURRENT
$I_S$ = GENERATOR STATOR CURRENT AT RATED VOLTAGE AND RATED HYDROGEN PRESSURE
PSIG = ACTUAL GENERATOR HYDROGEN PRESSURE

FIG. 37

PROGRAM PII

NO-LOAD AND LIGHT LOAD OPERATION GUIDE FOR REHEAT TURBINES

ATMOSPHERIC PRESS.=29.92
ABS=ATM+GAUGE

EXHAUST PRESSURE NOT TO EXCEED 2" Hga WHEN RUNNING

IF OVERSPEED TEST.
Cond. Press. ≤ 1.92 in. HgA Temp 1 = 1000-(80 x Cond. Press. Abs.)
Cond. Press. > 1.92 in. HgA Temp 1 = 1150-(160 x Cond. Press. Abs.)

Cond. Press. ≤ 1.92 in. HgA Temp 2 = 1023-(33.3 x Cond. Press. Abs.)
Cond. Press. > 1.92 in. HgA Temp 2 = 1150-(100 x Cond. Press. Abs.)

CT-22596B

DIFFERENTIAL EXPANSION - GENERATOR END

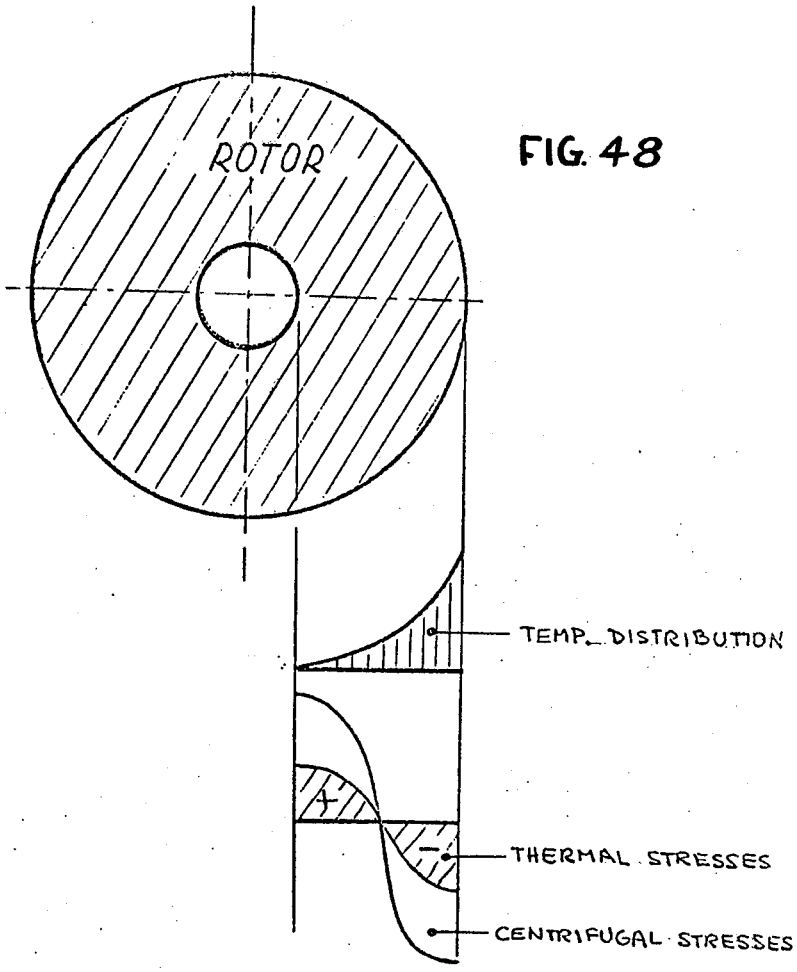
FIG. 48
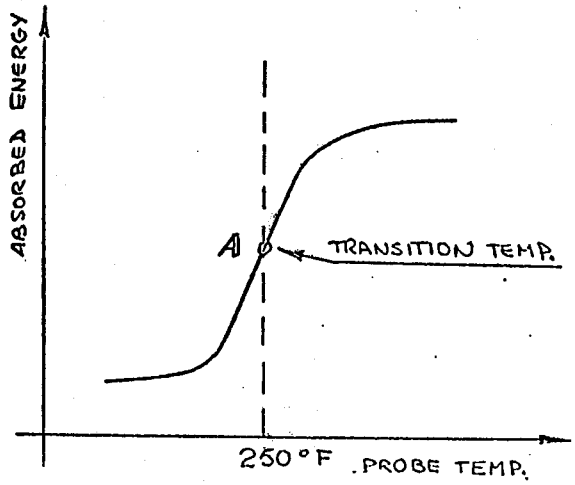

SYSTEM AND METHOD FOR OPERATING A STEAM TURBINE WITH DIGITAL COMPUTER CONTROL HAVING IMPROVED AUTOMATIC STARTUP CONTROL FEATURES

CROSS-REFERENCE TO RELATED APPLICATIONS

This application is a continuation-in-part of Ser. No. 247,440, entitled "Improved System and Method for Starting, Synchronizing and Operating a Steam Turbine with Digital Computer Control", filed by Theodore C. Giras and Robert Uram on Apr. 25, 1972, assigned to the present assignee and now abandoned. In turn Ser. No. 247,440 was a continuation-in-part of Ser. No. 246,900 entitled "General System and Method for Starting, Synchronizing and Operating a Steam Turbine with Digital Computer Control", filed by Theodore C. Giras and Robert Uram on Apr. 24, 1972 assigned to the present assignee and now abandoned.

1. Ser. No. 722,779, entitled "Improved System and Method for Operating a Steam Turbine and an Electric Power Generating Plant" filed by Theodore C. Giras and Manfred Birnbaum on Apr. 4, 1968, assigned to the present assignee, and continued as Ser. No. 123,993 on Mar. 16, 1971, and Ser. No. 319,115, on Dec. 29, 1972.

2. Ser. No. 408,962, entitled "System and Method for Starting, Synchronizing and Operating a Steam Turbine with Digital Computer Control" filed as a continuation of Ser. No. 247,877 which had been filed by Theodore C. Giras and Robert Uram on Apr. 26, 1972, assigned to the present assignee and hereby incorporated by reference; other related cases are set forth in Ser. No. 408,962.

SUMMARY OF THE INVENTION

It is a primary objective of this invention to provide for a steam turbine and system for controlling same, which control system overcomes the shortcomings of the prior art turbine control systems by providing automatic means for startup of the turbine combined with both speed and load control during all phases of turbine operation, and including overriding steam flow control so as to maintain turbine differential expansion and turbine rotor stress within predetermined limits.

It is another objective of this invention to provide a steam turbine and system for controlling same, which control system provides automatic digital means for automatic startup of the turbine combined with both speed and load control during all phases of turbine operation, and which provides improved capacity for turbine startup under cold start or hot start conditions.

In accordance with the above stated objectives, the present invention provides a steam turbine system having a control subsystem for controlling steam flow as an intermediate variable and the turbine speed during startup and turbine load during load operation as end operating variables, which control subsystem comprises a programmable digital computer system in combination with input means for receiving signals representative of turbine operating conditions and parameters and output means for using signals generated by said digital computer, for controlling the steam flow. The digital computer is operated by an overall program system for carrying out a plurality of respective functions in accordance with a predetermined priority, which functions include calculating speed control and load control signals, and limiting such control signals as a function of monitored differential expansion or rotor stress. The computer control system also provides for automatically sequencing the turbine through startup, and providing means for alternately sequencing through either a hot start or a cold start.

BACKGROUND OF THE INVENTION

The present invention relates to the elastic fluid turbines and more particularly to systems and methods for operating steam turbines and electric power plants in which generators are operated by steam turbines.

With respect to steam turbine control, prime mover turbine control usually operates to determine turbine rotor shaft speed, tubine load, and/or turbine throttle pressure as end control system variables. In the case of large electric power plants in which throttle pressure is steam-generating system controlled, turbine control is typically directed to the megawatt amount of electric load and the frequency participation of the turbine after the turbine rotor speed has been controllably brought to the synchronous value and the generator has been connected to the electric power system.

In addition to the conventional steam turbine generated system, another type of power generating system in which steam turbine control is needed is a combined cycle generating system. The combined cycle generating system involves a combination of heat sources and energy conversion apparatus organized to produce an electric power output. For example, gas turbines can drive generators and use their exhaust gases to supply heat for steam to be used in driving a steam turbine. A separate boiler can also be included in the system to provide steam generating heat. Electric power is supplied by separate generators driven by the turbines.

The end controlled plant or plant system variables and the turbine operation are normally determined by controlled variation of the steam flow to one or more of the various stages of the particular type and particular design of the turbine in use. In prime mover turbine applications such as drum type boiler electric power plants where turbine throttle pressure is extremely controlled by the boiler operation, the turbine inlet steam flow is an end controlled steam characteristic or an intermediately controlled system variable which controllably determines in turn the end control system variables, i.e., turbine speed, electric load or the turbine speed and the electric load. It is noteworthy, however, that some supplemental or protective control may be placed on the end control variable by additional downstream steam flow control such as by control of reheat valving and to that extent inlet turbine steam flow control is not strictly wholly controllably determinative of the end controlled system variables under all operating conditions.

In determining turbine operation and the end controlled system variables, turbine steam flow control has generally been achieved by controlled operation of valves disposed in the steam flow path or paths. To illustrate the nature of the turbine valve control in general and to establish simultaneously some background for subsequent description, consideration will now be directed to the system structure and the operation of a typical large electric power tandem steam turbine design for use with a fossil fuel drum-type boiler steam generating system.

Steam generated at controlled pressure may be admitted to the turbine steam chest through one or more throttle or stop valves operated by the turbine control system. Governor or control valves are arranged to supply steam inlets disposed around the periphery of a high pressure turbine section casing. The governor valves are also operated by the turbine control system to determine the flow of steam from the steam chest through the stationary nozzles or vanes and the rotor blading of the high pressure turbine section.

Torque resulting from the work performed by steam expansion causes rotor shaft rotation and reduced steam pressure. The steam is usually then directed to a reheat stage where its enthalpy is raised to a more efficient operating level. In the reheat stage, the high pressure section outlet steam is ordinarily directed to one or more reheaters associated with the primary steam generating system where heat energy is applied to the steam. In large electric power nuclear turbine plants, turbine reheater stages are usually not used and instead combined moisture separator reheaters are employed between the tandem nuclear turbine sections.

Reheated steam croses over the next or intermediate pressure section of a large fossil fuel turbine where additional rotor torque is developed as intermediate pressure steam expands and drives the intermediate pessure turbine blading. One or more interceptor and/or reheater stop valves are usually installed in the reheat steam flow path or paths in order to cut off or reduce the flow of turbine contained steam as required to protect against turbine overspeed. Reheat and/or interceptor valve operation at best produces late corrective turbine response and accordingly is normally not used controllably as a primary determinant of turbine operation.

Additional reheat may be applied to the steam after it exits from the intermediate pressure section. In any event, steam would typically be at a pressure of about 1200 psi as it enters the next or low pressure turbine section usually provided in the large fossil fuel turbines. Additional rotor torque is accordingly developed and the vitiated steam then exhausts to a condenser.

In both the intermediate pressure and the low pressure sections, no direct steam flow control is normally applied as already suggested. Instead, steam conditions at these turbine locations are normally determined by mechanical system design subject to time delayed effects following control placed on the high pressure section steam admission conditions.

In a typical large fossil fuel turbine just described, 30% of the total steady state torque might be generated by the high pressure section and 70% might be generated by the intermediate pressure and low pressure sections. In practice, the mechanical design of the turbine system defines the number of turbine sections and their respective torque ratings as well as other structural characteristics such as the disposition of the sections of one or more shafts, the number of reheat stages, the blading and vane design, the number and form of turbine stages and steam flow paths in the sections, etc.

A variety of valve arrangements may be used for steam control in the various turbine types and designs, and hydraulically operated valve devices have generally been used for steam control in the various valving arrangements. The use of hydraulically operated valves has been predicated largely on their relatively low cost coupled with their ability to meet stroke operating power and positioning speed and accuracy requirements.

Turbine valve control and automatic turbine operation have undergone successive stages of development. With increasing plant sizes, mechanical-hydraulic controls have been largely subplanted by analog electrohydraulic controllers sometimes designated as AEH controllers. The aforementioned Giras and Birnbaum Patent application, Ser. No. 319,115, provides a further description of the turbine control technology development and the earlier prior patent and publication art. The latter application discloses a programmed digital computer controller which generally provides improved turbine and electric power plant operation over the earlier prior art. U.S. Pat. No. 3,588,265 issued to W. Berry, entitled "System And Method For Providing Steam Turbine Operation With Improved Dynamics", and assigned to the present assignee, is also directed to a digital computer controller which provides improved automatic turbine startup and loading operations. U.S. Pat. No. 3,552,872 issued to T. Giras and T. C. Barns, Jr. entitled "Computer Positioning Control System With Manual Backup Control Especially Adapted For Operating Steam Turbine Valves", and assigned to the present assignee, discloses a digital computer controller interfaced with a manual backup controller. A general publication pertaining to turbine digital controllers has appeared in Electrical World Magazine.

At this point in the background writeup, it is noted that prior art citations are made herein in an attempt to characterize the context within which the presently disclosed subject matter has been developed. No representations are made that the cited art is the best art nor that the cited art is immune to alternative interpretations.

Generally, the earlier Berry and the earlier Giras and Birnbaum DEH turbine operating system comprise basic hardware and software elements and control loops which bear some similarity to a number of basic elements and loops described herein. However, the present disclosure involves improvements largely stemming from the combined application of principles associated with turbine technology and principles associated with the computer and control technologies in the determination of a particular detailed system arrangement and operation. Thus, the earlier DEH is largely directed to central control concepts which, although implementable with conventional know-how, open up opportunities for improvement-type developments related to the more central aspects of turbine control and operation as well as the more supportive aspects of turbine control and operation including areas such as turbine protection, remote system interfacing, accuracy and reliability, computer utilization efficiency, operator interface, maintenance and operator training.

In particular, earlier turbine control systems did not comprise a fully integrated programmable digital computer system for providing all phases of sequential and monitoring control of the turbine during speed startup, load control during load operation, and monitoring capability during load operation. More specifically, there has been a need for such a fully integrated turbine control system capable of monitoring differential expansion and rotor stress, and for providing means for efficiently controlling the turbine during startup as a function of these temperature-related conditions. In relation to such temperature conditions, there has been an existing need for more flexibility in turbine control at startup to start under different rotor temperature conditions.

BRIEF DESCRIPTION OF THE DRAWINGS

FIG. 9 shows a table of program or task priority assignments in accordance with the principles of the invention;

FIG. 10 shows the location of subroutines in accordance with the principles of the invention;

FIG. 33 shows a flow chart of the ATS turbine latching and load references which are operable in accordance with the principles of the invention;

FIG. 37 shows a chart of generator conditions which is operable in accordance with the principles of the invention;

FIG. 48 shows a section with an indication of buildup of rotor stresses in the rotor of the turbine generator which is operable in accordance with the principles of the invention.

DESCRIPTION OF THE PREFERRED EMBODIMENT

A. POWER PLANT

Figure 1:
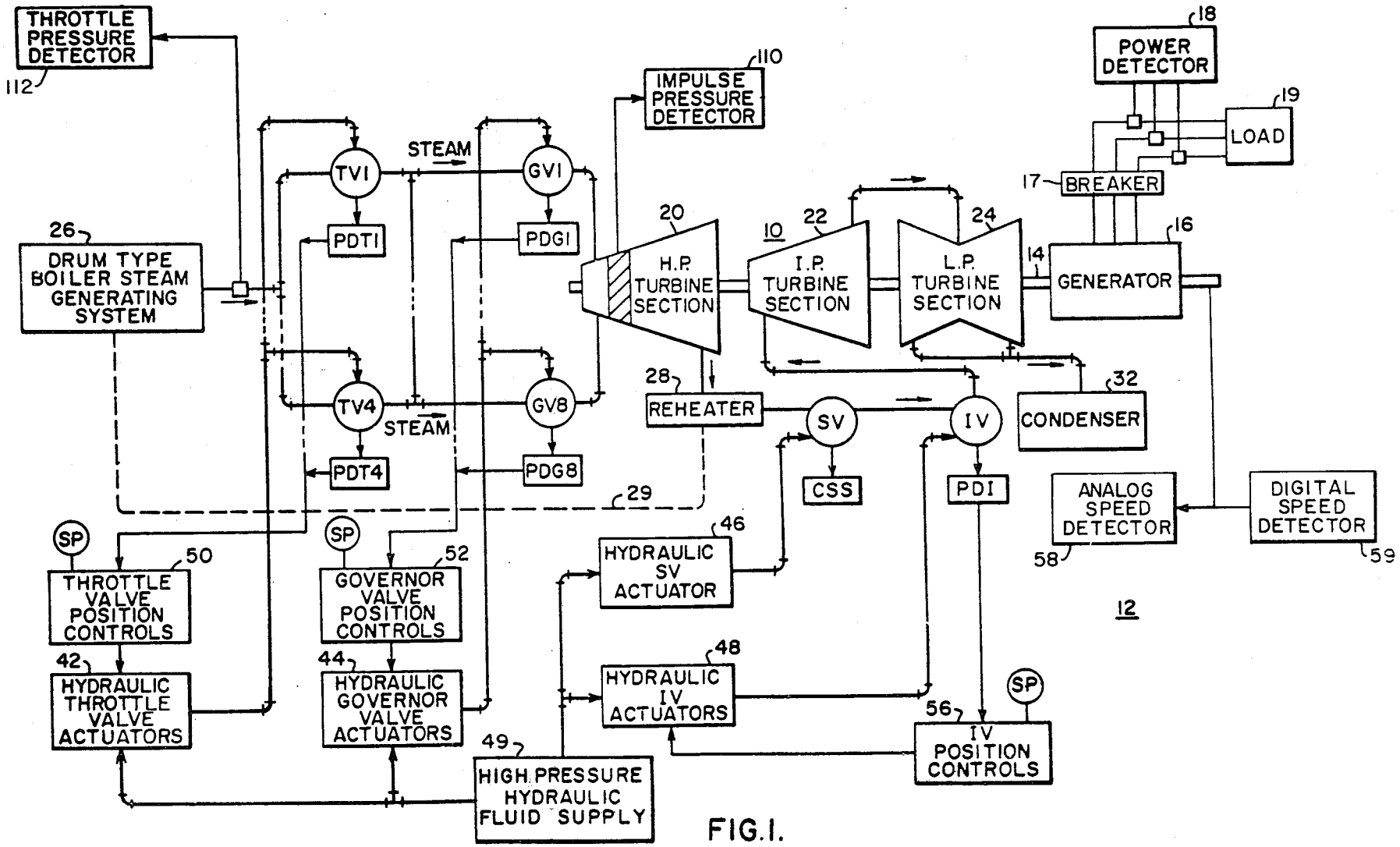
FIG. 1 shows a schematic diagram on an electric power plant including a large steam turbine and a fossile fuel fired drum type boiler and control devices which are all operable in accordance with the principles of the invention.
Figure 2:
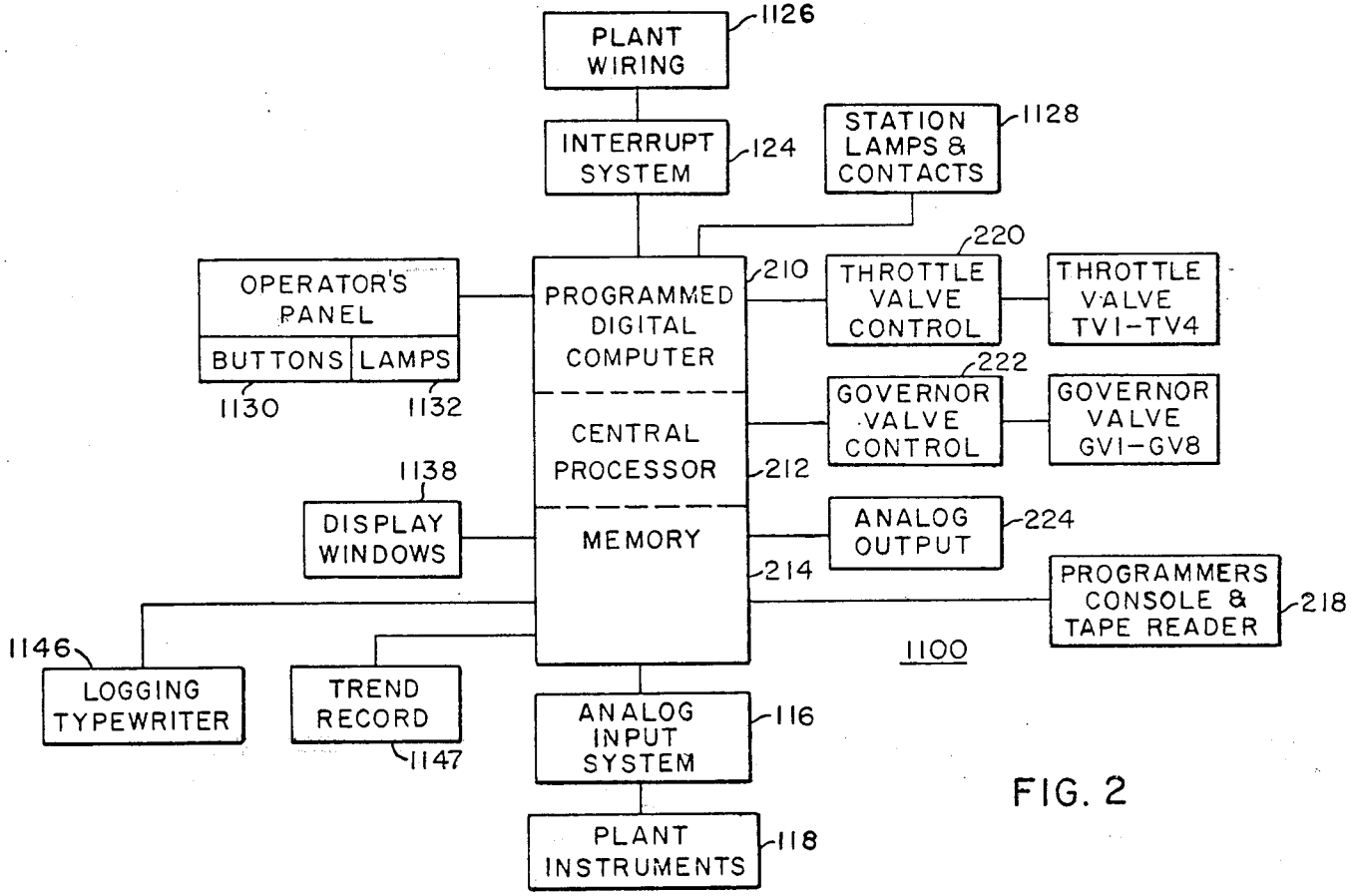
FIG. 2 shows a schematic diagram on a programmed digital computer control system operable with a steam turbine and its associated devices shown in FIG. 1 in accordance with the principles of the invention.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the aforementioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady conditions. Under transient electric load change conditions, system frequency may be affected and conforming turbo-generator speed changes would result. At synchronism, power contribution of the generator 16 to the network is normaly determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1–TV4. Generally, the plural inlet type and other front end turbine types such as the single ended type or the end bar lift type may involve different numbers and/or arrangements of valves.

Steam is directed from the admission steam chest to the first high pressure section expansion stage through eight governor inlet valves GV1-GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1–GV8 are typically all fully opened and steam flow control is provided by a full arc throttle valve operation. At some point in the start-up process, transfer is made from full arc throttle valve control to full arc governor valve control because of throttling energy losses and/or throttling control capability. Upon transfer the throttle valves TV1–TV4 are fully opened, and the governor valves GV1–GV8 are normally operated in the single valve mode. Subsequently, the governor valves may be individually operated in a predetermined sequence usually directed to achieving thermal balance on the rotor and reduced rotor blade stressing while producing the desired turbine speed and/or load operating level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV4 have reached the end of their control region i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valves GV1 and GV8 are arcuately adjacent to each other.

The preferred turbine start-up method is to raise the turbine speed from the turning gear speed of about 2 rpm to about 80% of the synchronous speed under throttle valve control and then transfer to governor valve control and raise the turbine speed to the synchronous speed, then close the power system breakers and meet the load demand. On shutdown, similar but reverse practices or simple coastdown may be employed. Other transfer practice may be employed, but it is unlikely that transfer would be made at a loading point above 40% rated load because of throttling efficiency considerations.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

To control the flow of reheat steam, a stop valve SV including one or more check valves is normally open and closed only when the turbine is tripped. Interceptor valves IV (only one indicated), are also provided in the reheat steam flow path, and they are normally open and if desired they may be operated over a range of position control to provide reheat steam flow cutback modulation under turbine overspeed conditions. Further description of an appropriate overspeed protection system is presented in U.S. Pat. 3,643,437 issued to M. Birnbaum, A. Braytenbah and A. Richardson and assigned to the present assignee.

In the typical fossil fuel drum type boiler steam generating system, the boiler control system controls boiler operations so that steam throttle pressure is held substantially constant. In the present description, it is therefore assumed as previously indicated that throttle pressure is an externally controlled variable upon which the turbine operation can be based. A throttle pressure detector 38 of suitable conventional design measures the throttle pressure to provide assurance of substantially constant throttle pressure supply, and, if desired as a programmed computer protective system override control function, turbine control action can be directed to throttle pressure control as well as or in place of speed and/or load control if the throttle pressure falls outside predetermined constraining safety and turbine condensation protection limits.

In general, the steady state power or load developed by a steam turbine supplied with substantially constant throttle pressure steam is determined as follows:

Equation (1)

$$\text{power or load} = K_P \frac{P_i}{P_O} = K_F S_F$$

where $P_i$ = first stage impulse pressure
$P_O$ = throttle pressure
$K_P$ = constant of proportionality
$S_F$ = steam flow
$K_F$ = constant of proportionality Where the throttle pressure is held substantially constant by external control as in the present case, the turbine load is thus proportional to the first stage impulse pressure $P_i$. The ratio $P_i/P_O$ may be used for control purposes, for example to obtain better anticipatory control of $P_i$ (i.e. turbine load) as the boiler control throttle pressure $P_O$ undergoes some variation within protective constraint limit values. However, it is preferred in the present case that the impulse pressure $P_i$ be used for feedback signalling in load control operation as subsequently more fully described, and a conventional pressure detector 40 is employed to determine the pressure $P_i$ for the assigned control usage.

Within its broad field of applicability, the invention can also be applied in nuclear reactor and other applications involving steam generating systems which produce steam without placement of relatively close steam generator control on the constancy of the turbine throttle pressure. In such cases, throttle control and operating philosophies are embodied in a form preferred for and tailored to the type of plant and turbine involved. In cases of unregulated throttle pressure supply, turbine operation may be directed with top priority to throttle pressure control or constraint and with lower priority to turbine load and/or speed control.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valves SV and IV. A computer monitored high pressure fluid supply 50 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitably known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valve positions are controlled to produce control over steam flow as an intermediate variable and over turbine speed and/or load as an end control variable or variables. Actuator operation provides the steam valve positioning, and respective valve position detectors PDT1–PDT4, PDG1–PDG8 and PDI are provided to generate respective valve position feedback signals for developing position error signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect to position setpoint signals sp in developing the respective input error signals. Position controlled operation of the interceptor valving IV would typically be provided only under a reheat steam flow cutback requirement.

The combined position control, hydraulic actuator, valve position detector element and other miscellaneous devices (not shown) form a local hydraulic electric analog valve position control for each throttle or governor inlet steam valve. The position setpoints SP are computer determined and supplied to the respective local loops and updated on a periodic basis. Setpoints SP may also be computed for the interceptor valve controls when the latter are employed. A more complete general background description of electrohydraulic steam valve positioning and hydraulic fluid supply systems for valve actuation is presented in the aforementioned Birnbaum and Noyes paper.

In the present case, the described hybrid arrangement including local loop analog electrohydraulic position control is preferred primarily because of the combined effects of control computer operating speed capabilities and computer hardware economics, i.e., the cost of manual backup analog controls is less than that for backup computer capacity at present control computer operating speeds for particular applications so far developed. Further consideration of the hybrid aspects of the turbine control system is presented subsequently herein. However, economic and fast operating backup control computer capability is expected and direct digital computer control of the hydraulic valve actuators will then likely be preferred over the digital control of local analog controls described herein.

A speed detector 58 is provided for determining the turbine shaft speed for speed control and for frequency participation control purposes. The speed detector 58 can for example be in the form of a reluctance pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1–PDT4, PDG1–PDG8 and PDI, and status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH - COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operate by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the value positions of the throttle values TV1 through TV4 and the governor values GV1 through GV8 and the interceptor valve IV, throttle pressure, steam flow, various steam temperatures, miscellaneous equipment operating temperature, generator hydrogen cooling pressure and temperatue, etc. A detailed list of all parameters is provided in Appendix 1. As used here and subsequently in this specification, the Appendix referred to is that of Ser. No. 408,962 filed as a Continuation of Ser. No. 247,877, and which is incorporated by reference supra. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters, as well as alarms generated by an automatic turbine startup system. (ATS) which includes program system blocks 1140, 1142, 1144 (FIG. 8) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive program. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. 3,552,872 by T. Giras et al and U.S. Pat. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

At this point in the description, further consideration of certain subsystems external to the DEH computer will aid in reaching an understanding of the invention. Making reference now to FIG. 3, a high pressure HP fluid supply system 310 for use in controlled actuation of the governor valves GV1 through GV8, the throttle valves TV1 through TV4 and associated valves is shown. The high pressure fluid supply system 310 corresponds to the supply system 49 in FIG. 1 and it uses a synthetic, fire retardant phosphate ester-based fluid and operates in the range of 1500 and 1800 psi. Nitrogen charged piston type accumulators 312 maintain a flow of fluid to the actuators for the governor valves GV1–GV8, the throttle valves TV1–TV4, etc. when pumps 314 and 316 are discharging to a reservoir 318 through unloader valves 320 and 321. In addition, the accumulators 312 provide additional transient flow capacity for rapid valve movements.

Figure 4:
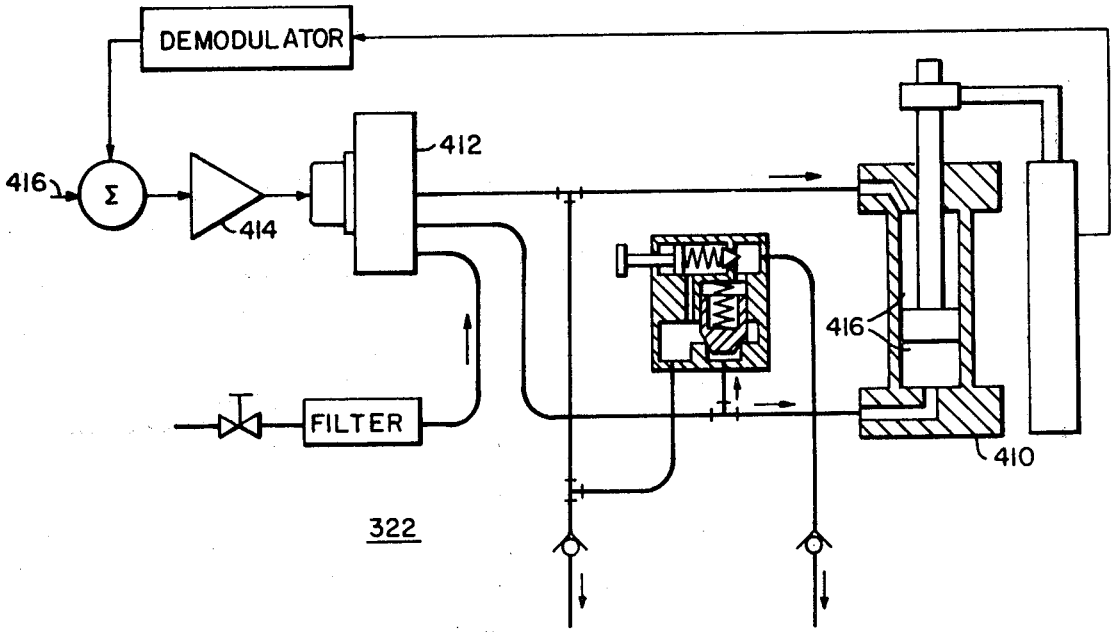
FIG. 4 shows a schematic diagram of a servo system connected to the valve actuators.

Referring now to FIG. 4, a typical electrohydraulic valve actuation system 322 is shown in greater detail for positioning a modulating type valve actuator 410 against the closing force of a large coil spring. A servo-valve 412 which is driven by a servo-amplifier 414 controls the flow of fluid therethrough. The servo-valve 412 controls the flow of fluid entering or leaving the valve actuator cylinder 416 relative to the HP fluid supply system 310. A linear voltage differential transformer LVTD generates a valve position indicating transducer voltage which is summed with a valve position demand voltage at connection 418. The summation of the two previously mentioned voltages produces a valve position error input signal to the servo-amplifier 414. The linear voltage differential transformer LVTD has a linear voltage characteristic with respect to displacement thereof in the preferred embodiment. Therefore, the position of the valve actuator 410 is made proportional to the valve position demand voltage at connection 418.

Figure 5:
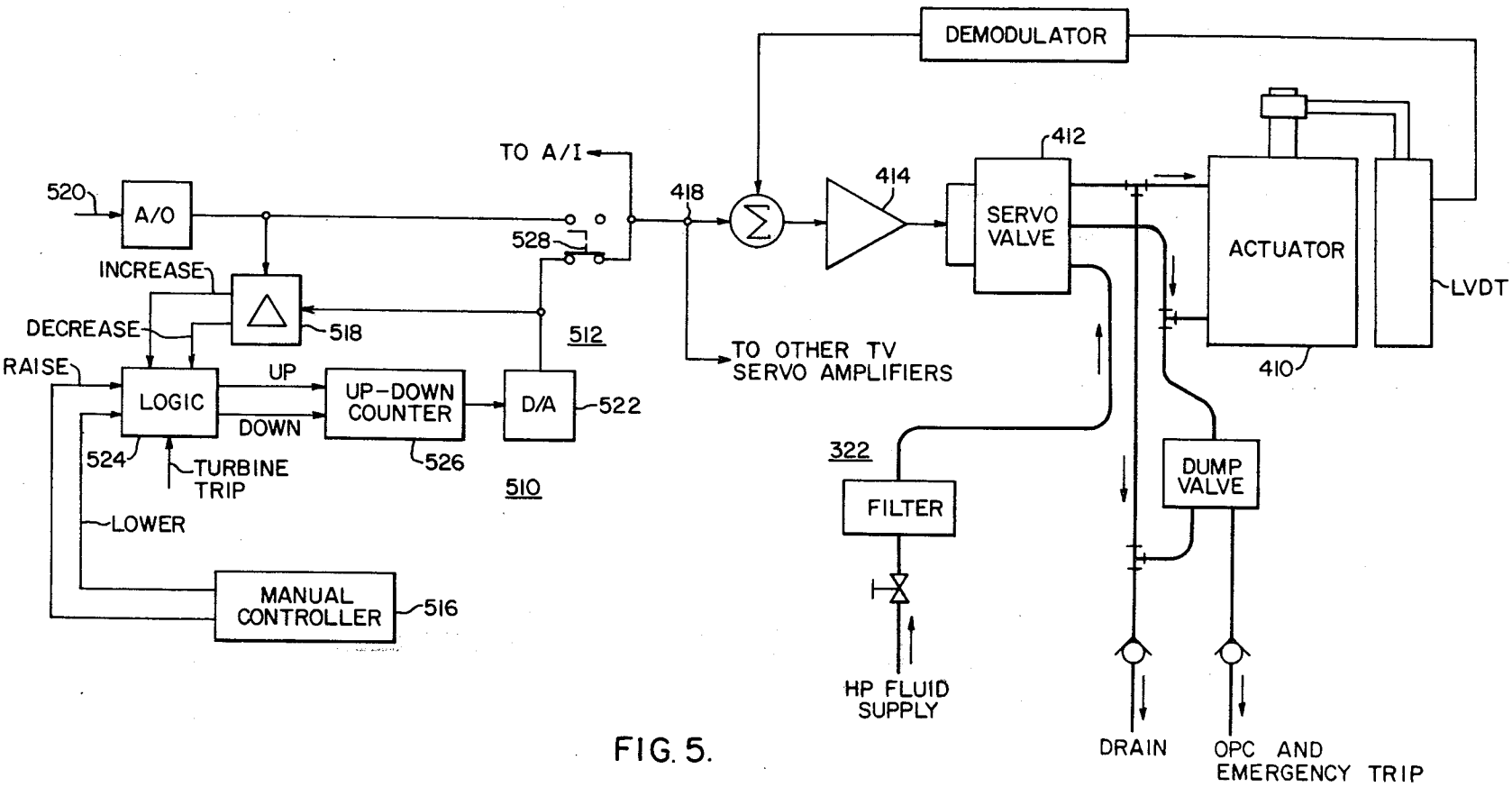
FIG. 5 shows a schematic diagram of a hybird interface between a manual backup system and the digital computer connected with the servo system controlling the valve actuators.

Making reference now to FIG. 5, a hardwired digital-/analog system forms a part of the DEH control system 1100 (FIG. 2). Structurally, it embraces elements which are included in the blocks 50, 52, 42 and 44 of FIG. 1 as well as additional elements. A hybrid interface 510 is included as a part of the hardwired system. The hybrid interface 510 is connected to actuator system servoamplifiers 414 for the various steam valves which in turn are connected to a manual controller 516, an overspeed protection controller, not shown, and redundant DC power supplies, not shown.

A controller shown in FIG. 5 is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 511 tracks single valve analog outputs 520 from the digital computer 210. A comparator 518 compares a signal from the digital-to-analog converter 522 of the manual system with the signal 520 from the digital computer 210. A signal from the comparator 518 controls a logic system 524 such that the logic system 524 runs an up-down counter 526 to the point where the output of the converter 522 is equal to the output signal 520 from the digital computer 210. Should the hardwired system 511 fail to track the signal 520 from the digital computer 210 a monitor light will flash on the operator's panel.

When the DEH control system reverts to the control of the backup manual controller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 (FIG. 4) is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

Figure 6:
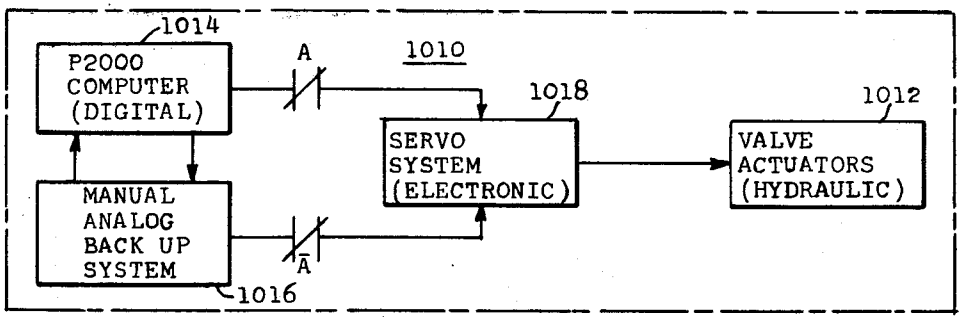
FIG. 6 shows a simplified block diagram of the digital Electro Hydraulic Control System in accordance with the principle of the invention.

With reference now to FIG. 6, an overall generalized control system of this invention is shown in block diagram form. The digital electrohydraulic (DEH) control system 1100 operates valve actuates 1012 for the turbine 10. The digital electrohydraulic control system 1100 comprises a digital computer 1014, corresponding to the digital computer 210 in FIG. 2, and it is interconnected with a hardwired analog backup control system 1016. The digital computer 1014 and the backup control system 1016 are connected to an electronic servo system 1018 corresponding to blocks 220 and 222, in FIG. 2. The digital computer control system 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reacch an understanding of the invention. More functional detail on various programs is presented in Appendix 2. Further, a detailed listing of a DEH system program substantially conforming to the description presented herein is presented in Appendix 3 in symbolic and machine language. Most of the listing is compiled by a P2000 compiler from instructions written in Fortran IV. A detailed dictionary of system parameters is presented in Appendix 1, and a detailed computer input/output signal list is presented in Appendix 4. Appendix 5 mainly provides additional hardware information related to the hardwired system previously considered as part of the DEH control system.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

Figure 7:
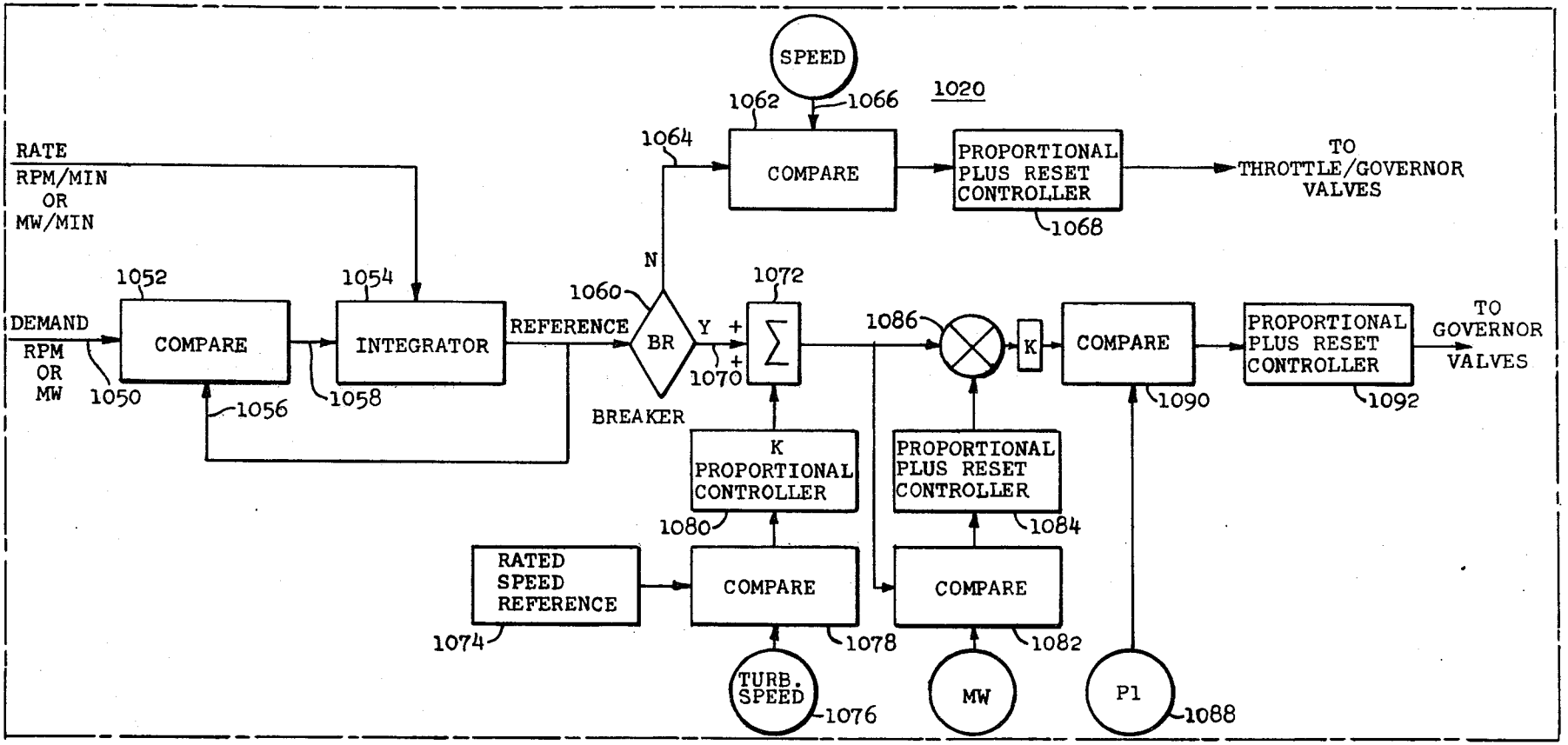
FIG. 7 shows a block diagram of a control program used in accordance with the principles of the invention.

With reference now to FIG. 7, a functional control loop diagram in its preferred form includes the CONTROL task or program 1020 which is executed in the computer 1010. Inputs representing demand and rate provide the desired turbine operating setpoints. The demand is typically either the target speed in specified revolutions per minute of the turbine systems during startup or shutdown operations or the target load in megawatts of electrical output to be produced by the generating system 16 during load operations. The demand enters the block diagram configuration of FIG. 7 at the input 1050 of a compare block 1052.

The rate input either in specified RPM per minute or specified megawatts per minute, depending upon which input is to be used in the demand function, is applied to an integrator block 1054. The rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 them makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1060 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves.

If the main generator circuit breaker 17 is closed, the CONTROL task 1020 advances from the breaker block 1060 to a summer 1072 where the REFERENCE acts as a feedforward setpoint in a combined feedforward-feedback load control system. If the main generator circuit breaker 17 is closed, the turbine generator system 10 is being loaded by the electrical network connected thereto.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value. To provide for frequency participation, a rated speed value in box 1074 is compared in box 1078 with a "two signal" speed value represented by box 1076. The two signal speed system provides high turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim.

The feedforward speed compensated reference is trimmed by the megawatt feedback error multiplicatively to correct load mismatch, i.e. they are multiplied together in the feedforward turbine reference path by multiplication function 1086. Multiplication is utilized as a safety feature such that if one signal e.g. MW should fail a large value would not result which could cause an overspeed condition but instead the DEH system 1100 would switch to a manual mode. The resulting speed compensated and megawatt trimmed reference serves as an impulse pressure setpoint in an impulse pressure controller and it is compared with a feedback impulse chamber pressure representation from input 1088. The difference between the feedforward reference and the impulse pressure is developed by a comparator function 1090, and the error output therefrom functions in a feedback impulse pressure control loop. Thus, the impulse pressure error is applied to a proportional plus reset controller function 1092.

During load control the megawatt loop comprising in part blocks 1082 and 1084 may be switched out of service leaving the speed loop 1310 and an impulse pressure loop operative in the DEH system 1100.

Impulse pressure responds very quickly to changes of load and steam flow and therefore provides a signal with minimum lag which smooths the output response of the turbine generator 10 because the lag dynamics and subsequent transient response is minimized. The impulse pressure input may be switched in and out from the compare function 1090. An alternative embodiment embracing feedforward control with impulse pressure feedback trim is applicable.

Between block 1092 and the governor valves GV1–GV8 a valve characterization function for the purpose of linearizing the response of the values is interposed. The valve characterization function described in detail in Appendix III infra herein is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller output 1092 causes positioning of the governor valves GV1–GV8 in load control to achieve the desired megawatt demand while compensation is made for speed, megawatt and impulse pressure deviations from desired setpoints.

Figure 8:
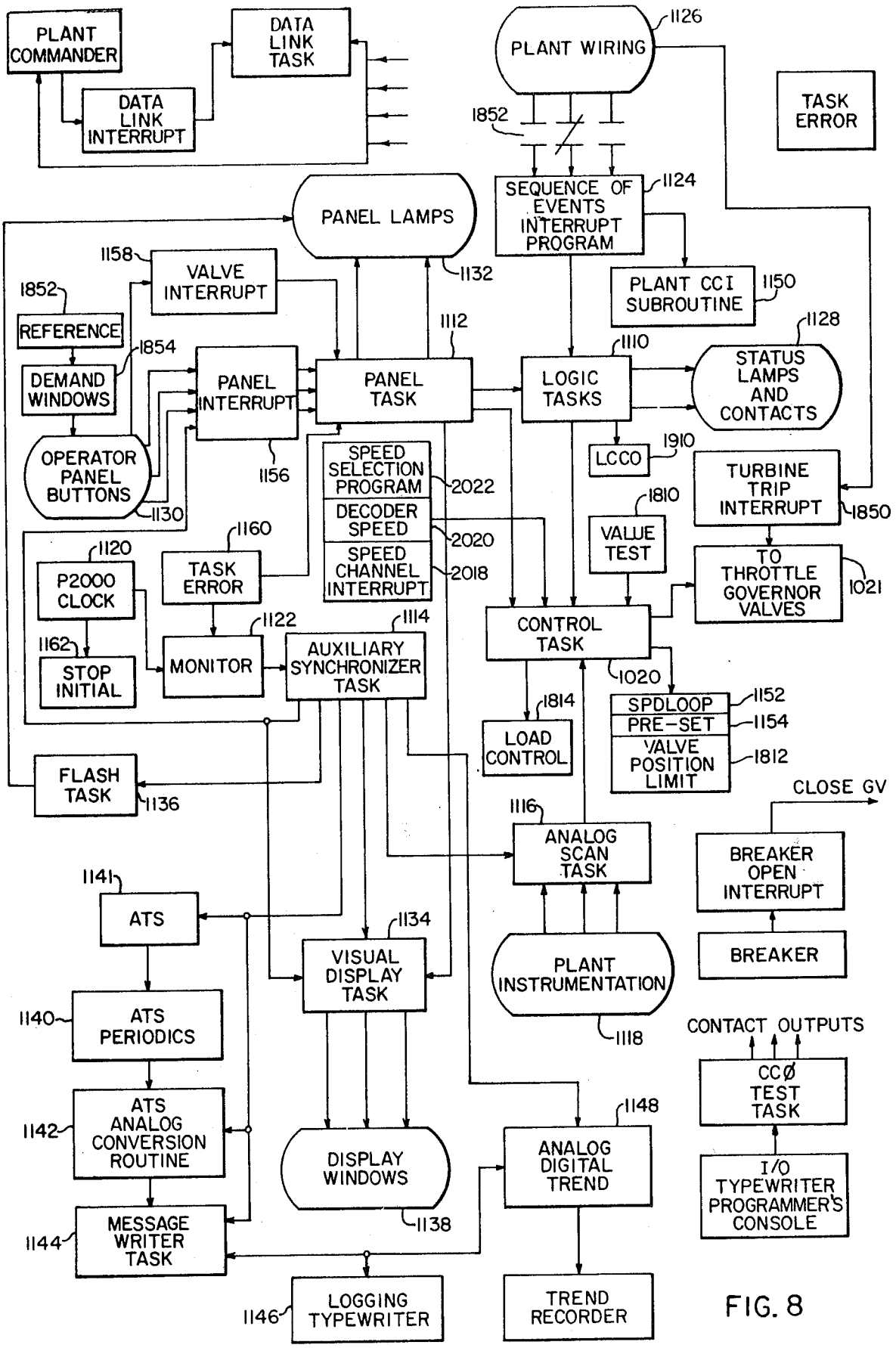
FIG. 8 shows a block diagram of the programs and subroutines of the digital Electro Hydraulic and the automatic turbine startup and monitoring program in accordance with the principles of the invention.

Making reference to FIG. 8, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through a monitor program 1122 to run the auxiliary synchronizer program 1114.

The monitor program or executive package 1122 also provides for controlling certain input/output operations of the computer and, more generally, it schedules the use of the computer to the various programs in accordance with assigned priorities. For more detail on the P2000 computer system and its executive package, reference is made to Appendix 4. In the appendix description, the executive package is described as including analog scan and contact closure input routines, whereas these routines are considered as programs external to the executive package in this part of the disclosure.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. Bids from the interrupt program 1124 are registered with and queued for execution by the executive program 1111. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 1111 the bidding of the control program 1020, the analog scan program 1116, a visual display task 1134 and a flash task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1–TV4 and governor valves GV1–GV8 in the turbine system 10, thereby controlling the megawatt load and the speed of the turbine 10.

To interface the control and logic programs efficiently, the sequence of events program 1124 normally provides for the logic task 1110 contact status updating on demand rather than periodically. The logic task 1110 computes all logical states, according to predetermined conditions and transmits this data to the control program 1020 where this information is utilized in determining the positioning control action for the throttle valves TV1–TV4, and the governor valves GV1–GV8. The logic task 1110 also controls the state of various lamps and relay type contact outputs in a predetermined manner.

E. TASK PRIORITY ASSIGNMENTS

With reference now to FIG. 9, a table of program priority assignments is shown as employed in the executive monitor. A program with the highest priority is run first under executive control if two or more programs are ready to run. The stop/initializer program function has top priority and is run on startup of the computer or after the computer has been shut down momentarily and is being restarted. The control program 1020 is next in order of priority. The operator's panel program 1130, which generates control data, follows the control task 1020 in priority. The analog scan program 1116 also provides information to the control task 1020 and operates at a level of priority below that of the operator's panel 1130. The automatic turbine starting (ATS) periodic program 1140 is next in the priority list. ATS stands for automatic turbine startup and monitoring program, and is shown as a major task program 1140 of FIG. 8 for the operation of the DEH system 1100. The ATS-periodic program 1140 monitors the various temperatures, pressures, breaker states, rotational velocity, etc. during start-up and during load operation of the turbine system.

The logic task 1110, which generates control and operating mode data, follows in order of operating priority. The visual display task program 1134 follows the logic task program 1110 and makes use of outputs from the latter. A data link program for transmitting data from the DEH system to an external computer follows. An ATS-analog conversion task program 1142 for converting the parameters provided by the ATS-periodic program 1142 to usable computer data follows in order of priority. The flash task program 1136 is next, and it is followed by a programmer's console program which is used for maintenance testing and initial loading of data tapes. The next program is an ATS-message writer 1144 which provides for printout of information from the ATS analog conversion program 1142 on a suitable typewriter 1146. The next program in the priority list is an analog/digital trend which monitors parameters in the turbine system 10 and prints or plots them out for operator perusal. The remaining two programs are for debugging and special applications.

In the preferred embodiment, the stop/initialize program is given the highest priority in the table of FIG. 9 because certain initializing functions must be completed before the DEH system 1100 can run. The auxiliary synchronizer program 1114 provides timing for all programs other than the stop/initialize program while the DEH system 1100 is running. Therefore, the auxiliary snychronizer task program 1400 has the second order of priority of the programs listed. The control program 1020 follows at the third descending order of priority since the governor valves GV1 through GV8 and the throttle valves TV1 through TV4 must be controlled at all times while the DEH system 1100 is in operation.

The operator's panel progam 1130 is given the next order of priority in order to enable an operator to exercise direct and instantaneous control of the DEH system 1100. The analog scan program 1116 provides input data for the control program 1020 and, therefore, is subordinate only to the initialize, synchronizer control and operator functions.

In the preferred embodiment the ATS-periodic program 1140 is next in order of priority. During automatic turbine startup, the scanning of inputs by the ATS-periodic program 1140 is almost on the same order of priority as the inputs to the DEH system 1100. However, the ATS program 1140 in alternative embodiments, could be reduced in its priority, without any considerable adverse effect, because of the relatively limited duty cycle problems in the ATS system.

The logic task 1110 which control the operations of some of the functions of the control task program 1020 is next in order of priority. The visual display task 1134 follows in order of priority in order to provide an operator with a visual indication of the operation of the DEH program 1100. The visual display program 1134 is placed in the relatively low eighth descending order of priority since the physical response of an operator is limited in speed to 0.2 to 0.5 sec. as to a visual signal. The rest of the programs are in essentially descending order of importance in the preferred embodiment. In alternative embodiments of the inventions, alternate priority assignments can be employed for the described or similar programs, but the general priority listing described is preferred for the various reasons presented.

A series of interrupt programs interrupt the action of the computer and function outside the task priority assignments to process interrupts. One such program in FIG. 8 is the sequence events or contact interrupt program 1124 which suspends the operation of the computer for a very short period of time to process an interrupt. Between the operator panel buttons 1130 and the panel task program 1112 a panel interrupt program 1156 is utilized for signalling any changes in the operator's panel buttons 1130. A valve interrupt program 1158 is connected directly between the operator's panel buttons 1130 and the panel task program 1112 for operation during a valve test or in case of valve contingency situations.

Proportional plus reset controller subroutine 1154 (FIG. 11) is called by the control task program 1020 of FIG. 7 as previously described when the turbine control system is in the speed mode of control and also, for computer use efficiency, when the turbine 10 is in the load mode of control with the megawatt and impulse pressure feedback loops in service. Utilizing the proportional plus reset function 1068 during speed control provides very accurate control of the angular velocity of the turbine system.

In addition to previously described functions, the auxiliary synchronizer program 1114 is connected to and triggers the ATS periodic program 1140, the ATS analog conversion routine 1142 and the message writer 1144. The ATS program 1140 monitors a series of temperature, vibration, pressures, speed, etc. in the turbine system and also contains a routine for automatically starting the turbine system 10. The ATS analog conversion routine 1142 converts the digital computer signals from the ATS periodic program 1140 to analog or digital or hybrid form which can be typed out through the message writer task 1144 to the logging typewriter 1146 or a similar recorder.

The auxiliary synchronizer program 1114 also controls an analog/digital trend program 1148. The analog digital trend program 1148 records a set of variables in addition to the variables of the ATS periodic program 1140.

Ancillary to a series of other programs is a plant CCI subroutine 1150 where CCI stands for contact closure inputs. The plant CCI subroutine 1150 responds to changes in the state of the plant contacts as transmitted over the plant wiring 1126. Generally, the plant contacts are monitored by the CCI subroutine 1150 only when a change in contact state is detected. This scheme conserves computer duty cycle as compared to periodic CCI monitoring. However, other triggers including operator demand can be employed for a CCI scan.

As shown in FIG. 8, the control task 1020 calls ancillary thereto a speed loop task 1152 and the preset or proportional plus reset controller program 1154. Ancillary to the executive monitoring program 1122 is a task error program 1160. In conjunction with the clock program 1120 a stop/initialize program 1162 is used. Various other functions in FIG. 8 are described in greater detail infra.

1. PLANT CONTACT CLOSURE INPUT (PLANTCCI) SUBROUTINE PROGRAM

Figure 11:
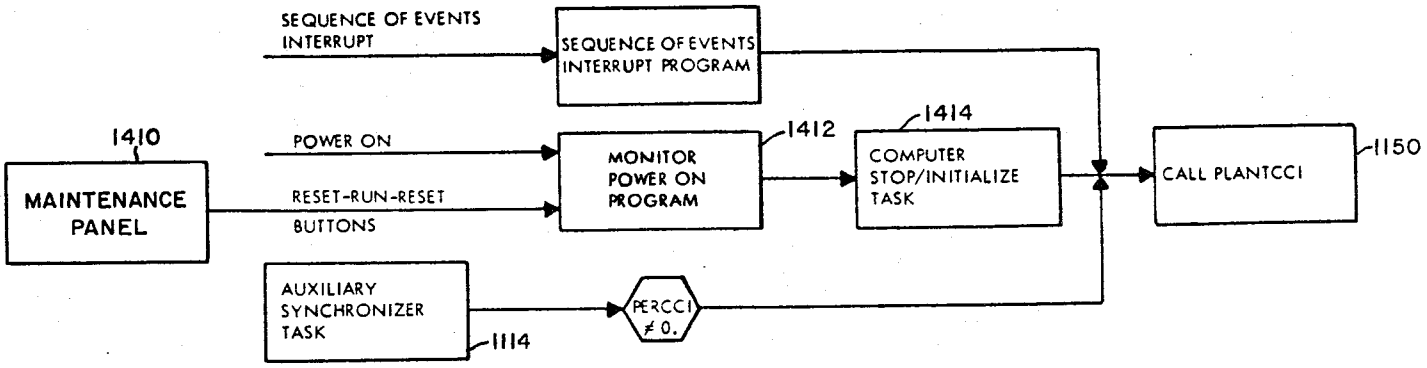
FIG. 11 shows a block diagram of a subroutine for scanning contact close inputs of the Digital Electro Hydraulic System which is operable in accordance with the principles of the invention.

A plant contact closure input subroutine 1150 as shown in FIG. 8 scans all the contact inputs tied to the computer through the plant wiring 1126 and sets logic data images of these in designated areas within the memory 214 of the computer 210. A block diagram illustrating the operation of the plant contact closure input subroutine 1150 is shown in FIG. 11. The plant contact closure input subroutine 1150 is also utilized when power to the computer 210 is turned on or when the computer buttons reset-run-reset are pressed on a maintenance panel 1410. Under these circumstances, a special monitor power-on routine 1412 is called upon. This executes the computer STOP/INITIALIZE task program 1414 described previously, which in turn calls the plant contact closure input subroutine 1150 for performance of the initializing procedure.

The operator can also call the plant contact closure input subroutine 1150 through the auxiliary synchronizer program 1114, if desired, whereby a periodic scan of the entire computer CCI system is implemented for checking the state of any one or group of relays in the CCI system.

2. AUXILIARY SYNCHRONIZER PROGRAM

Figure 12:
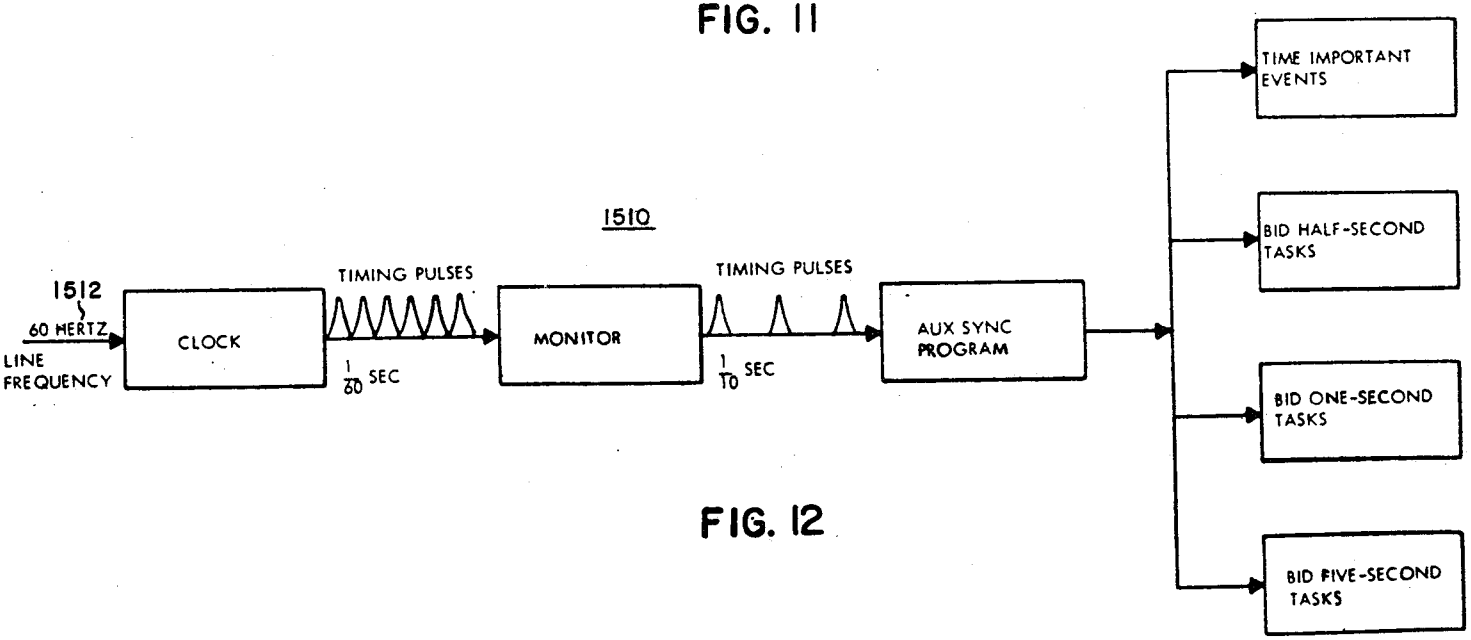
FIG. 12 shows a block diagram of an auxiliary synchronizer computer program which is operable in accordance with the principles of the invention.

With reference to FIG. 12, the block diagram shows an overall scheme which illustrates the operation of the auxiliary synchronizer program 1510. The auxiliary synchronizer program 1510 has two functions. It performs accurate counting to determine the time duration of important events to be described in more detail and it synchronizes the bidding for execution of all periodic programs in the digital electrohydraulic system 1100 on a predetermined schedule.

3. SEQUENCE OF EVENTS INTERRUPT

Figure 13:
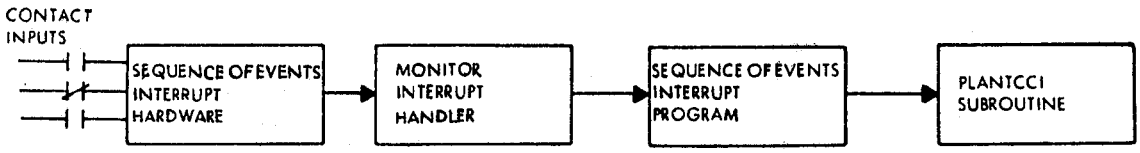
FIG. 13 is a block diagram of a contact input scan program with a sequence of events interrupt program therein which is operable in accordance with the principles of the invention.
Figure 14:
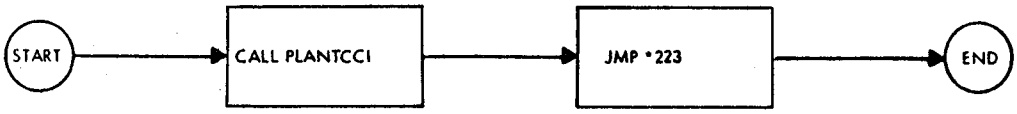
FIG. 14 is a flow chart of the sequence of events interrupt program which is operable in accordance with the principles of the invention.

The sequence of events interrupt program 1124 is shown in block form in FIG. 13. Once the PLANTCCI subroutine identifies the plant condition that changed state and activated the sequence of events program 1124 the execution of an appropriate function program may be initiated in accordance with the task priorities. Contact inputs scanned by the CCI subroutine are set forth in the input/output signal list in Appendix 4.

4. TASK ERROR PROGRAM

A task error program 1810 shown in FIG. 8 has supervisory control over all the other programs in the DEH system 1100. If any program is not functioning properly in correspondence to certain predefined error conditions, the task error program 1810 will switch the DEH system 1100 to manual control thereby preventing any accident, overload, underload, overspeed, or underspeed from happening.

An example of the usual operation of the P2000 Monitor in this particular case, i.e. in the DEH system, would be when a turbine operating program such as the panel task 1112 calls to use an input/output system such as the panel lamp program 1132. The panel task 1112 calls the monitor program 1122 with a set of arguments describing the function to be performed. The monitor program 1122 then carries out the request and returns to the panel task program 1112 at the completion of the function. However, if the monitor program 1122 finds erroneous information in the arguments or data passed along by the panel task 1112 then the input/output request for the panel lamp 1132 is ignored and the panel task 1112 is disabled. A monitor reference manual, TP043, of the Computer and Instrumentation Division of the Westinghouse Electric Corporation describes in detail all possible error conditions.

Figure 15:
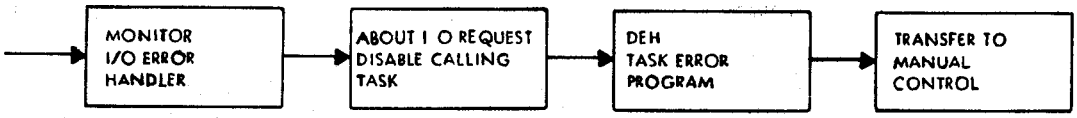
FIG. 15 is a block diagram of error action with a task error program which is operable in accordance with the principles of the invention.

FIG. 15 shows a block diagram of the task error program 1810. High safety and high reliability of operation of the DEH system 1100 are assured by the linking of the task error program 1810 to other DEH programs.

5. TURBINE TRIP INTERRUPT PROGRAM

Figure 16:
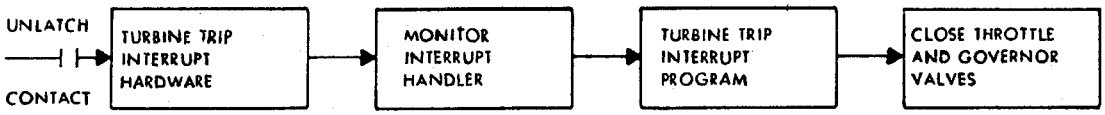
FIG. 16 is a block diagram of a turbine trip interrupt program which is operable in accordance with the principles of the invention.

In FIG. 8, a turbine trip interrupt program 1850 is shown coupled to the plant wiring 1126 and to the throttle valves TV1–TV4 and the governor valves GV1–GV8 1021. If the turbine system 10 reaches a trip condition, a latch open contact 1852 changes state and indicates a trip to the turbine trip interrupt program 1850 by means of an interrupt signal. By closing all the valves in the turbine system 10, dangerous turbine overspeed and other conditions are avoided. A block diagram of the turbine trip interrupt system 1850 is shown in FIG. 16.

6. PANEL INTERRUPT PROGRAM

Figure 17:
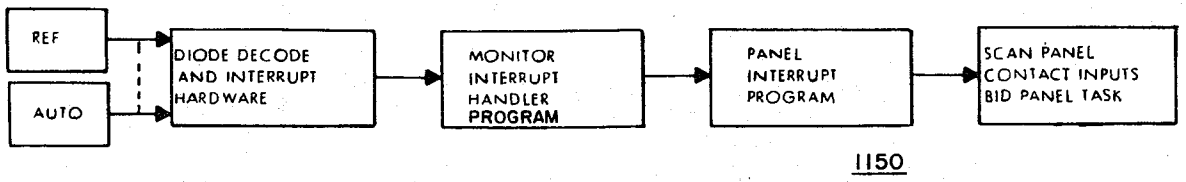
FIG. 17 is a block diagram of a panel interrupt program which is operable in accordance with the principles of the invention.

A block diagram of the panel interrupt program 1156 is shown in FIG. 17.

The PANEL INTERRUPT program responds to Operator's Panel pushbutton requests by decoding the pushbutton identification and bidding the PANEL task to carry out the appropriate response. The PANEL INTERRUPT program is initiated by the Monitor interrupt handler.

The DEH turbine control system is designed to provide maximum flexibility to plant personnel in performing their function of operating the turbine. This flexibility is evidenced by an Operator's Panel with an array of pushbuttons arranged in functional groups, and an internal software organization which responds immediately to pushbutton requests by the operator. The heart of this instant response is the interrupt capability of the DEH control system.

Pressing any panel pushbutton activates a diode-decoding network which identifies the pushbutton, sets a group of six contacts to an appropriate coded pattern, and generates an interrupt to the computer. The Monitor interrupt handler responds within microseconds and runs the PANEL INTERRUPT program, which does a demand contact input scan of the special panel pushbutton contacts and bids the PANEL task to carry out the function requested by the operator.

7. ANALOG SCAN PROGRAM

The analog scan program 1116, shown in FIG. 8 periodically scans all analog inputs to the DEH system 1100 for control and monitoring purposes. The function of the analog scan program 1116 is performed in two parts. The first part of the analog scan program 1116 comprises the scanning of a first group of analog inputs. Values of scanned inputs are converted to engineering units and the values are checked against predetermined limits as required for computations in the DEH computer.

The second part of the function of the analog scan program 1116 comprises the scanning of the analog inputs required for the automatic turbine startup program as shown in FIG. 8. The automatic turbine startup program is shown in FIG. 8 as the ATS periodic program 1140, the ATS analog conversion routine 1142 and the ATS message writer program 1144.

8. LOGIC TASK

Figure 21:
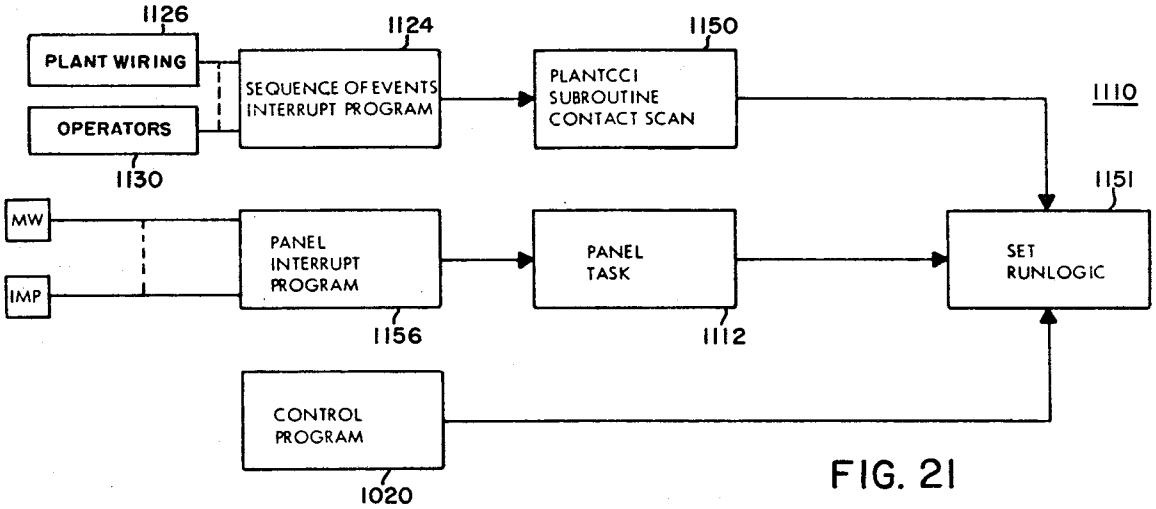
FIG. 21 is a block diagram of conditions which cause initiation of a logic program which is operable in accordance with the principles of the invention.
Figure 20:
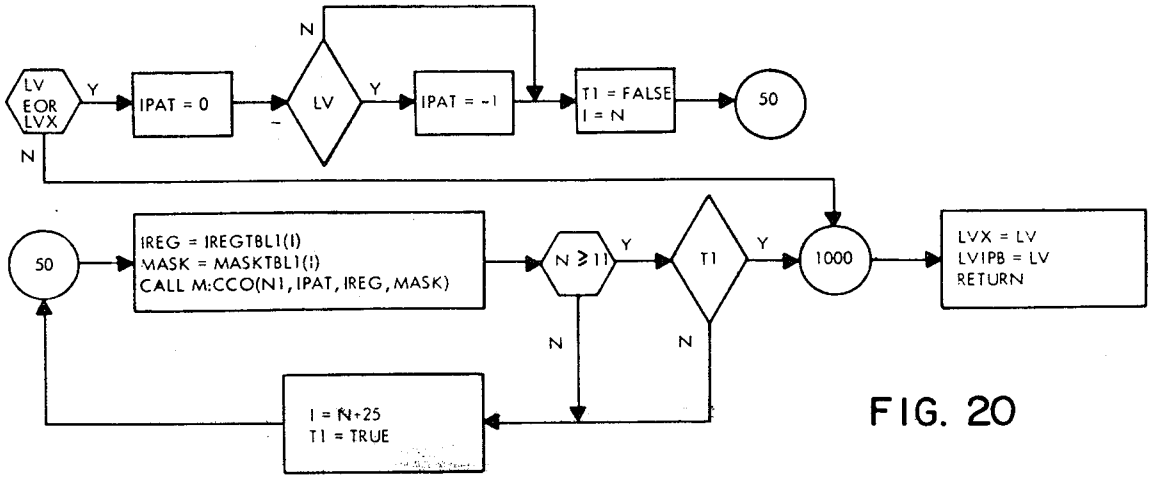
FIG. 20 is a flow chart of a logic contact closure output subroutine which is operable in accordance with the principles of the invention.
Figure 22:
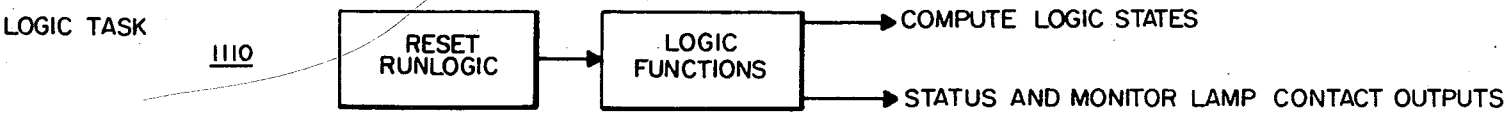
FIG. 22 is a simplified block diagram of a portion of the logic function which is operable in accordance with the principles of the invention.
Figure 23:
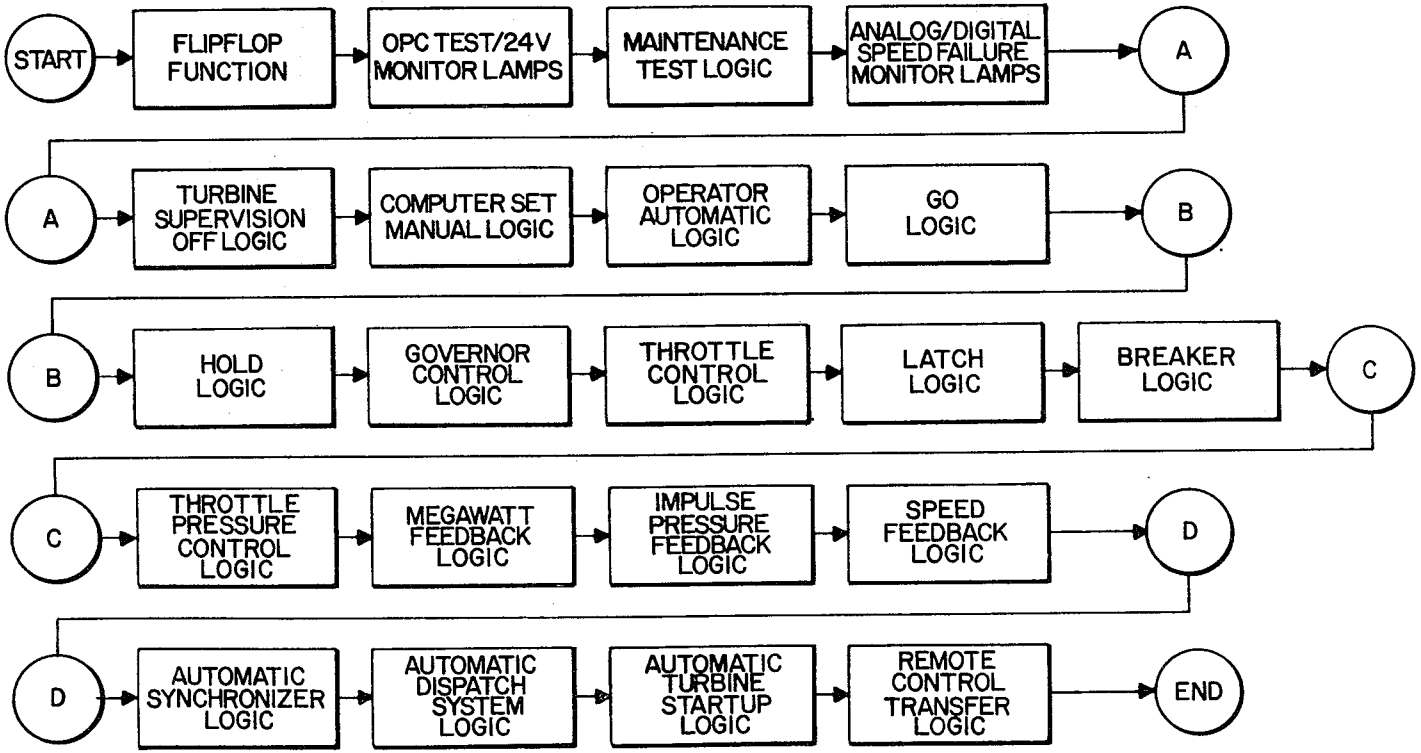
FIG. 23 is a block diagram of the logic program which is operable in accordance with the principles of the invention.

Referring now to FIGS. 20 and 21, a block diagram representing the operation of the logic task 1110 is shown. A contact input from the plant wiring 1126 triggers the sequence of events or interrupt program 1124 which calls upon the plant contact closure input subroutine 1150 which in turn requests that the logic program 1110 be executed by the setting of a flag called RUNLOGIC 1151 in the logic program 1110. The logic program 1110 is also run by the panel interrupt program 1156 which calls upon the panel task program 1112 to run the logic program 1110 in response to panel button operations. The control task program 1020 in performing its various computations and decisions will sometimes request the logic program 1110 to run in order to update conditions in the control system. In FIG. 22, the functioning of the logic program 1110 is shown. FIG. 23 shows a more explicit block diagram of the logic program 1110.

The logic program 1110 controls a series of tests which determine the readiness and operability of the DEH system 1100. One of these tests is that for the overspeed protection controller which is part of the analog backup portion of the hardwired system 1016 shown in FIG. 6. Generally, the logic program 1110 is structured from a plurality of subroutines which provide the varying logic functions for other programs in the DEH program system, and the various logic subroutines are all sequentially executed each time the logic program is run.

LOGIC CONTACT CLOSURE OUTPUT SUBROUTINE

The logic task 1110 includes a subroutine called a logic contact closure output subroutine 1910 (FIGS. 20 and 21) therein. The logic contact closure output subroutine 1910 updates all the digital outputs to the status lamps and contacts 1128 for transmission thereto. The logic program 1110 handles a great number of contact outputs thereby keeping the output logic states of the DEH computer current. Thus, the logic contact closure output subroutine 1910 reduces the total storage requirements otherwise required for the logic program 1110.

TURBINE SUPERVISION OFF LOGIC

In the DEH control system, the ATS program 1141 is an optional feature which automatically accelerates the turbine during speed control and performs monitoring functions during load control. When this option is purchased by the user, the operator's panel has an extra back-lighted pushbutton which allows these turbine supervisory functions to be turned on or off at the operator's discretion. In addition to this off-on control, another mechanism exists to turn off the supervision programs. To understand this method, it is first necessary to realize that supervision means monitoring of a large number of analog inputs which represent various turbine metal and steam temperatures, steam pressures, and turbine mechanical vibrations. These analog inputs are converted to digital signals by an electronic analog-to-digital (A/D) converter and an analog scan program. As happens with any device occasionally, the A/D converter may be out of service for a short interval of time; since all analog inputs are then meaningless, it is necessary to immediately turn the turbine supervision programs off.

When the supervisory programs are off, whether due to the operator pressing the pushbutton or due to the A/D converter being out of service, the lamp behind the pushbutton is turned on. To place the supervisory programs back on, it is only necessary to press the button again and, assuming the A/D converter is in service, the lamp will be turned off.

MEGAWATT FEEDBACK LOGIC

Figures 24, 25:
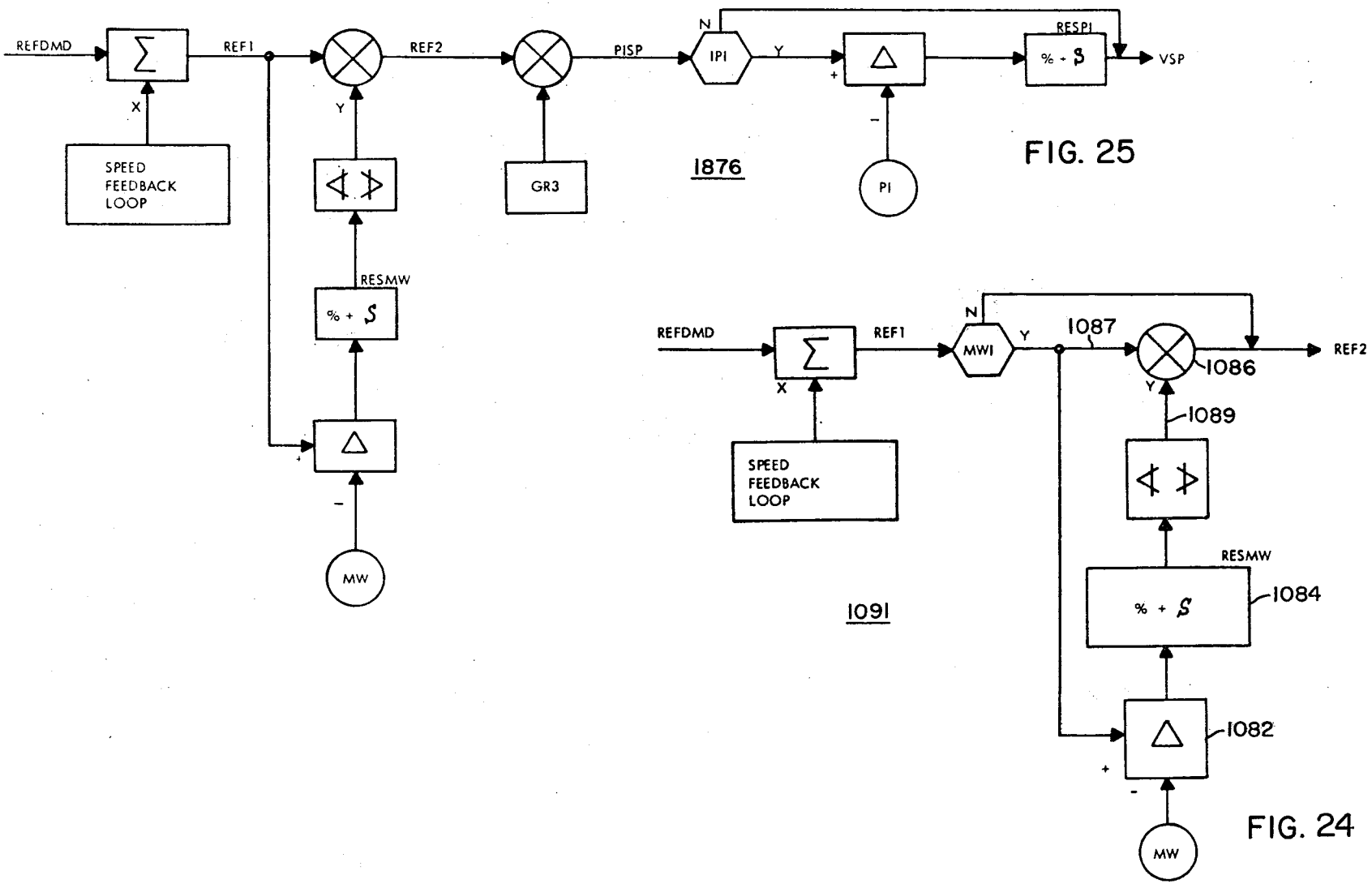
FIG. 24 is a block diagram of a megawatt feedback loop subroutine which is operable in accordance with the principles of the invention.
FIG. 25 is a block diagram of an impulse pressure loop with megawatt loop in service which is operable in accordance with the principles of the invention.
Figure 26:
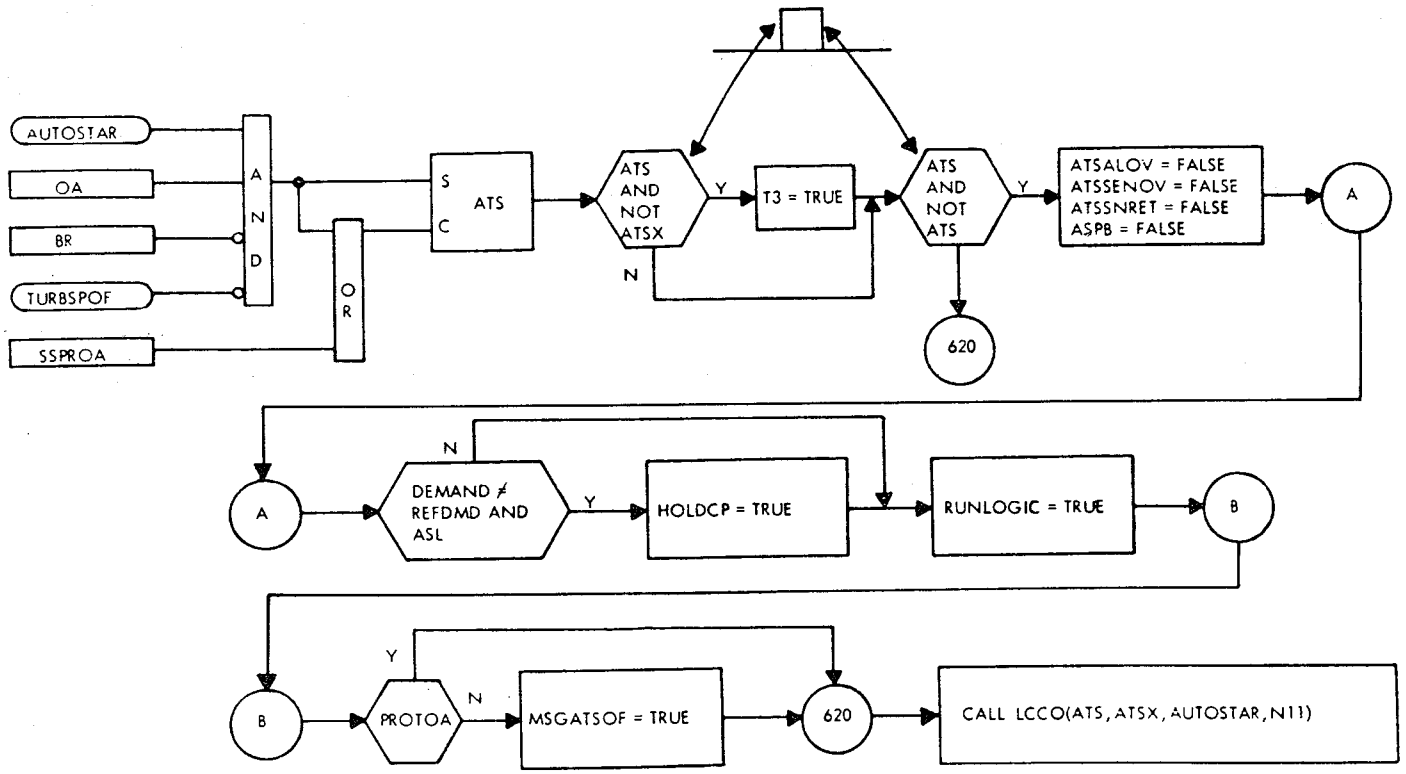
FIG. 26 is a flow chart of an automatic turbine startup program which is operable in accordance with the principles of the invention.

Referring to FIG. 24, a block diagram of the megawatt feedback loop is shown in greater detail than in FIG. 7. It should be noted that the speed compensated reference 1087, at the input of multiplication function 1086, is multiplied by the megawatt compensation 1089. The multiplication of the signals instead of a differencing provides an additional safety feature since the loss of either of the signals 1087 or 1089 will produce a zero output rather than a runaway condition.

IMPULSE PRESSURE FEEDBACK LOGIC

The impulse pressure feedback logic is shown in greater detail in FIG. 25. With a digital computer bumpless transfer is achieved without the use of elaborate external circuitry because of the digital computational nature of the machine. A value can be computed instantaneously and inserted in the integrator 1218 of the proportional plus reset controller subroutine 1068 as shown in FIG. 11. In the preferred embodiment of the Digital Electro-Hydraulic control system 1100, the proportional plus reset controller 1168 is utilized by the following functions: the megawatt feedback loop 1091, the impulse pressure feedback loop 1816 and the speed feedback loop made up of the rated speed reference 1074, the compare function 1076 and the actual turbine speed function 1076.

AUTOMATIC TURBINE STARTUP (ATS) LOGIC

Modern methods of starting up turbines and accelerating to synchronous speed require careful monitoring of all turbine metal temperatures and vibrations to assure that safe conditions exist for continued acceleration. Until recently, these conditions have been observed by plant operators visually on various panel instruments. However, all of the important variables are rarely available from the plant instrumentation, and even if they were, the operator can not always be depended upon to make the right decision at a critical time. In addition to these factors, it is impossible to instrument the internal rotor metal temperatures, which are extremely important for indicating potentially excessive mechanical stresses.

To improve the performance at startup, automatic turbine accelerating programs have been written and placed under computer control. Such programs monitor large numbers of analog input signals representing all conceivable turbine variables, and from this information the program makes decisions on how and when to accelerate the unit. In addition, these programs numerically solve the complex heat distribution equations which describe temperature variations in the critical rotor metal parts. From these thermal computations it is possible to predict mechanical stresses and strains, and then to automatically take the proper action in the acceleration of the turbine.

The DEH system has such an automatic turbine startup program available as an optional item. Besides supervising the acceleration as described above, the program provides various messages printed on a typewriter to keep the operator informed as to the turbine acceleration progress. In addition, a group of monitor lamps are operated to indicate key points in the startup stages and to indicate alarm or contingency conditions. The automatic turbine startup logic program detects those conditions concerned with this DEH feature and sets all logical states accordingly.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode — pulse type contact input for adjusting the turbine speed reference and speed demand and moving the turbine 10 to synchronizing speed and phase.

2. Automatic turbine startup program mode — provides turbine speed demand and rate.

3. Operator automatic mode — speed, demand and rate of change of speed entered from the keyboard on the operator's panel.

4. Maintenance test mode — speed demand and rate of change of speed are entered by an operator from the keyboard while the DEH system 1100 is being used as a simulator or trainer.

5. Manual tracking mode — the speed demand and rate of change of speed are internally computed by the DEH system 1100 and set to track the manual analog back-up system 1016 as shown in FIG. 6 in preparation for a bumpless transfer to the operator automatic mode of control.

With the breaker 17 closed and the turbine 10 in the level mode control, the following modes of operation may be selected:

1. Throttle pressure limiting mode — a contingent mode in which the turbine load reference is run back or decreased at a predetermined rate to a predetermined minimum value as long as a predetermined condition exits.

2. Run-back mode — a contingency mode in which the load reference is run back or decreased at a predetermined rate as long as a predetermined condition exists.

3. Automatic dispatch system mode — pulse type contact inputs are supplied from an automatic dispatch system to adjust turbine load reference and demand when the automatic dispatch system button 1870 on the operator's panel 1130 is depressed.

4. Operator automatic mode — the load demand and the load rate are entered from the keyboard on the control panel.

Figure 18:
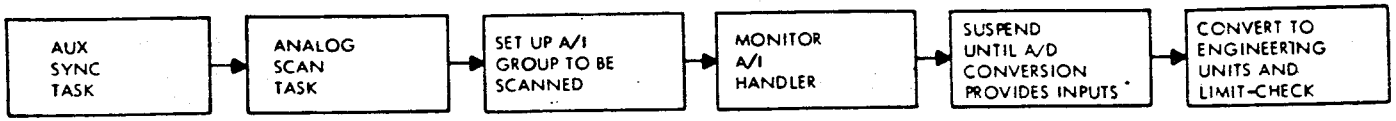
FIG. 18 is a block diagram of an analog scan system which is operable in accordance with the principles of the invention.
Figure 19:
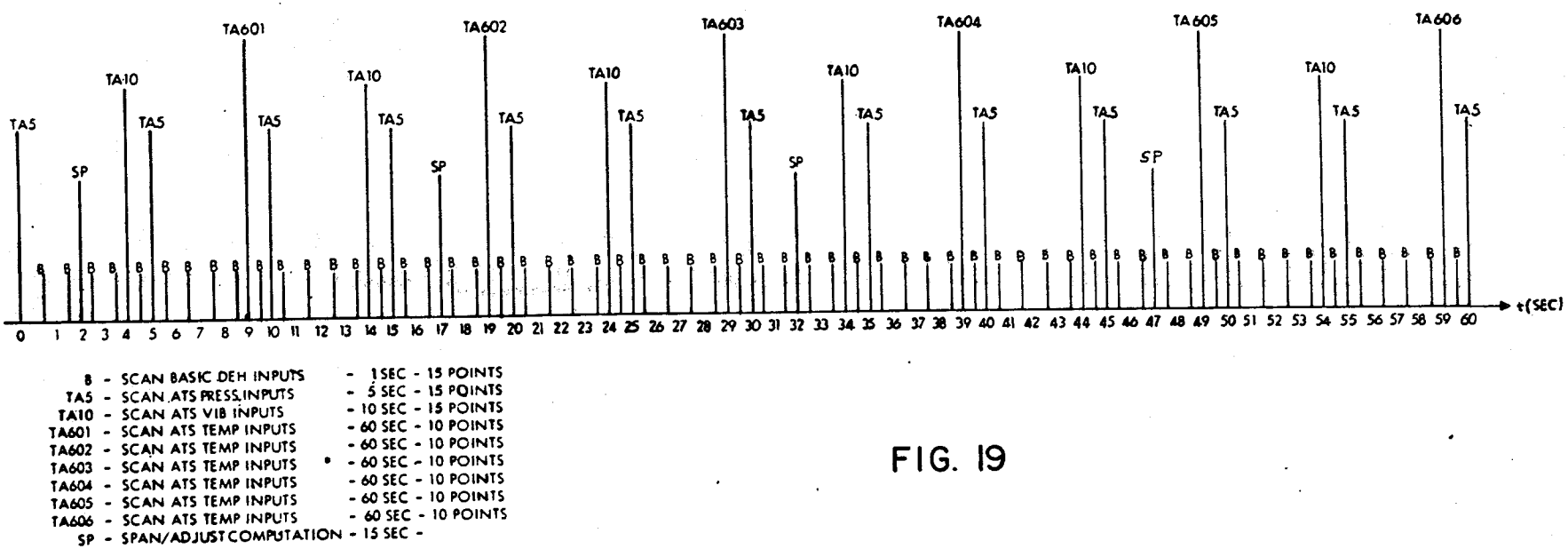
FIG. 19 is a timing chart of the various programs and functions within the Digital Electro Hydraulic System which is operable in accordance with the principles of the invention.

5. Maintenance test mode — load demand and load rate are entered from the keyboard 1860 of the control panel 1130 in FIG. 18 while the DEH system 1100 is being used as a simulator or trainer.

6. Manual tracking mode — the load demand and rate are internally computed by the DEH system 1100 and set to track the manual analog back-up system 1016 preparatory to a bumpless transfer to the operator automatic mode of control.

Figure 27:
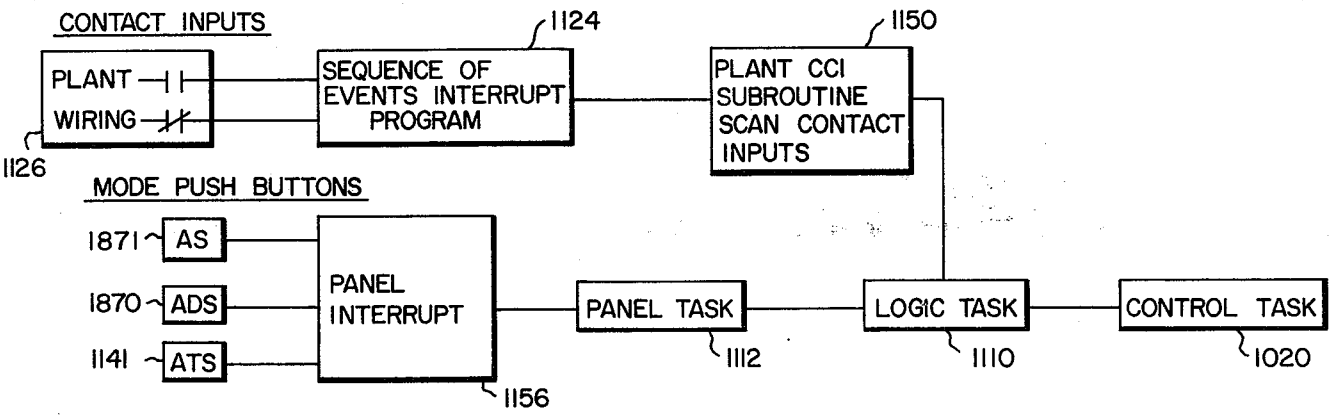
FIG. 27 shows a block diagram of an operating mode selection function which is operable in accordance with the principles of the invention.

Referring now to FIG. 27, a block diagram is shown illustrating the select operating mode function 2050. Contact inputs from plant wiring 1126 activate the sequence of events interrupt program 1124 which calls the plant contact input subroutine 1150, to scan the plant wiring 1126 for contact inputs. Mode pushbuttons such as automatic turbine startup 1141, automatic dispatch system 1170 and automatic synchronizer 1871 activate the panel interrupt program 1156 which calls the panel program 1112 for classification and which in turn calls upon the logic program 1110 to compute the logic states involved. The logic program 1110 calls the control program 1020 to select the operating mode in that program.

SPEED/LOAD REFERENCE FUNCTION

Figure 28:
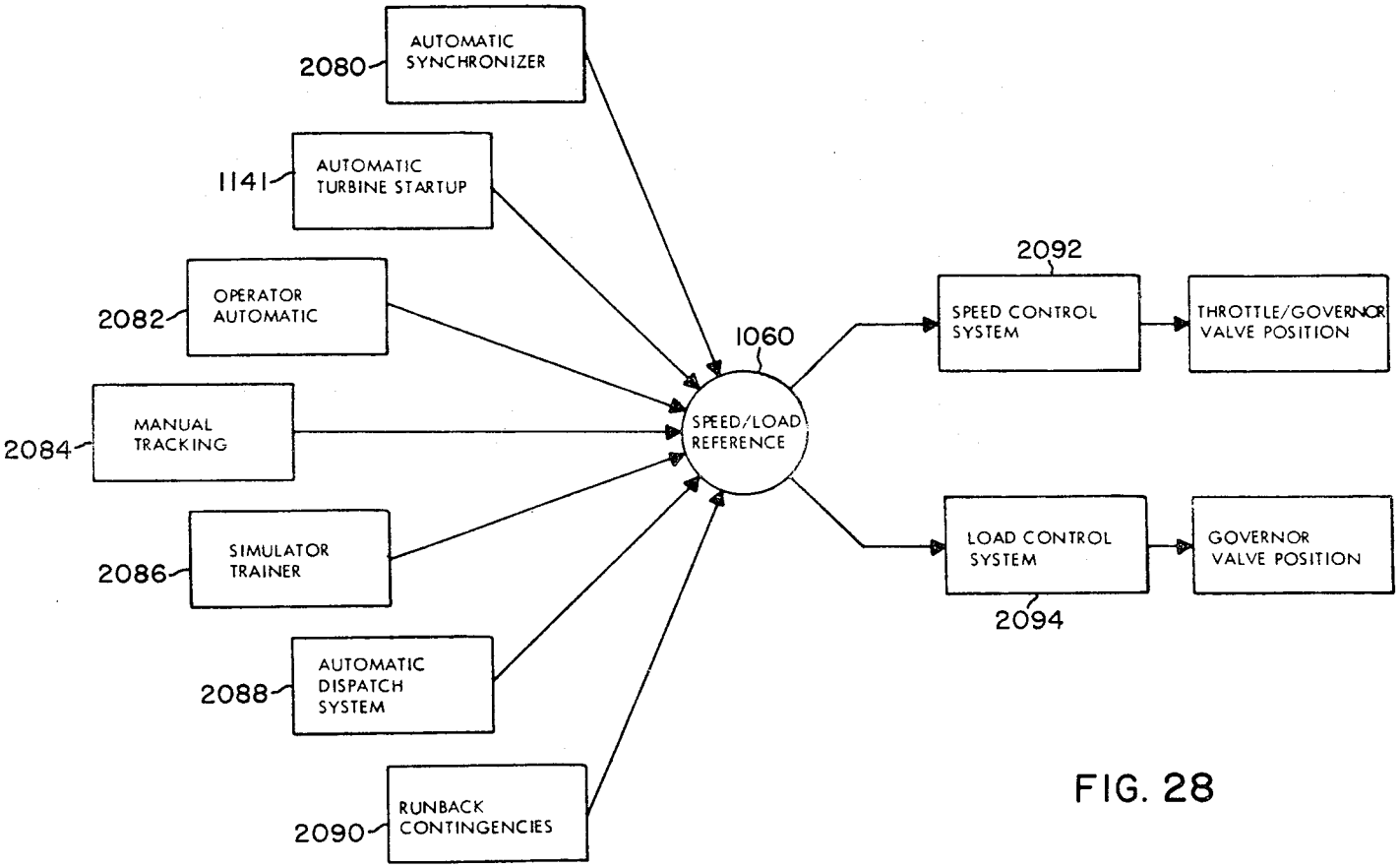
FIG. 28 shows a symbolic diagram of the use of a speed/load reference function which is operable in accordance with the principles of the invention.

In the DEH turbine controller, the speed/load reference is the central and most important variable in the entire control system. The reference serves as the junction or meeting place between the turbine speed or load demand, selected from any of the various operating modes discussed in the last section, and the Speed or Load Control System, which directs the reference through appropriate control system strategy to the turbine throttle and governor valves to supply the requested demand. FIG. 28 is a diagram which indicates the central importance of the reference in the DEH control system.

The speed/load reference function increments the internal turbine reference at the selected rate to meet the selected demand. This function is most useful when the turbine is on Operator Automatic, in the AUTOMATIC TURBINE STARTUP program, or in the Simulator/Trainer modes. This is because each of these control modes requests unique rates of change of the reference, while the remaining control modes, such as the Automatic Synchronizer and the Automatic Dispatch System, move the reference in pulses or short bursts which are carried out in one step. The Runback and Throttle Pressure contingency modes use some of the features of the reference function, but they bypass much of the subtle reference logic in their hurry to unload the turbine.

For these modes which request movement of the reference at a unique rate, the reference function must provide the controlled motion. Not only must the rate be ramped exactly, but the logic must be such that, at the correct time, the reference must be made exactly equal to the demand, with no overshot or undershoot. In addition, the reference logic must be sensitive to the GO and HOLD states, and must start or stop movement instantly if requested to do so. Finally, the reference system must turn off the GO and HOLD lamps, if conditions dictate, by passing on to the LOGIC task the proper status information to accomplish this important visual indication feature.

Figure 29:
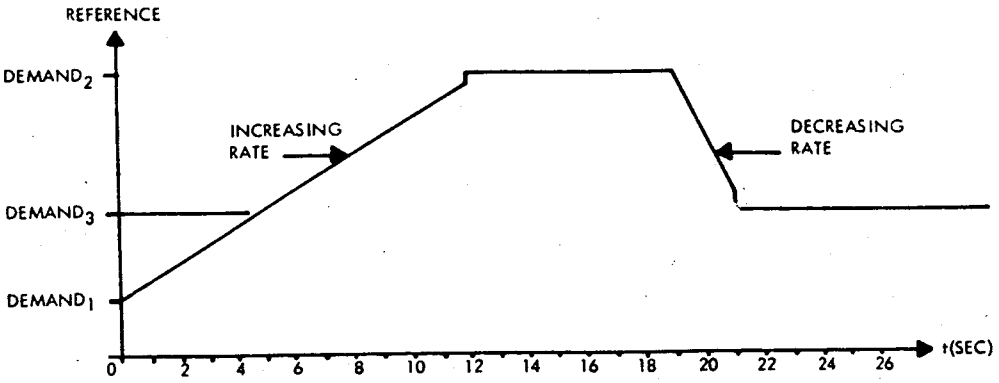
FIG. 29 shows a speed/load reference graph which is operable in accordance with the principles of the invention.

FIG. 29 is a plot of the reference as it moves to meet a given demand, both in the increasing and decreasing direction. The slope of the reference curve is the rate selected by the controlling mode. A key point in the reference system is the detection of the instant in time when the reference is within one increment of the demand; this increment is the step size associated with the selected rate, taken each second by the CONTROL task whose sampling interval is once a second. For example, an acceleration rate of 120 rpm per min yields an incremental speed size of 2 rpm each sec, while a load rate of 30 MW per min yields an incremental load step size of 0.5 MW each sec. Thus when the reference approaches to within this step size of the demand, then the reference system immediately sets the internal reference to the demand. This condition is indicated by the step jumps at the 12-sec and the 21-sec points in time on the graph of FIG. 29. Special logical and numerical decisions are required to detect these points. The decision breaker function 1060, of FIG. 7, is identical to the speed/load reference function 1060, of FIG. 28. A software speed control subsystem 2092 of FIG. 28, corresponds to the compare function 1062, the speed reference 1066 and the proportional plus reset controller function 1068, of FIG. 7. The software load control subsystem 1094, of FIG. 62, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the proportional plus reset controller 1092, of FIG. 7. The speed/load reference 1060 is controlled by, depending upon the mode, and automatic synchronizer 1080, the automatic turbine starter program 1141, and operator automatic mode 1082, a manual tracking mode 2084, a simulator/trainer 2086, an automatic dispatch system 2088, or a run-back contingency load 2090. Each of these modes increments the speed/load reference function 1060 at a selected rate to meet a selected demand. A typical demand/reference rate is shown in FIG. 63 drawn as a function of time.

SPEED CONTROL FUNCTION

F. AUTOMATIC TURBINE STARTUP PROGRAMS — FUNCTIONAL DESCRIPTION

AUTOMATIC TURBINE STARTUP PROGRAM FOR FOSSIL UNITS

A digital computer is a powerful tool for achieving a better and more efficient control of a turbo-generator unit. To take advantage of the computer's ability to scan, memorize, calculate, make decisions and take executive actions, the computer program should go further than the operating instructions, normally provided with each turbine, by scanning additional parameters if necessary, determining the trends in the parameter changes and performing computations beyond the capacity and duties of a human operator.

The general objective of the starting and load changing recommendations is the protection of the turbine parts against thermal-fatigue cracking caused by internal temperature variations. In the large turbined of present design the critical element is the H.P. rotor due to its relatively large diameters and high number of temperature variations at the first stage zone produced during startups and load changes. The operating procedures provided with each turbine, in the form of charts, assume that the machine is normally passing from one steady state to another, during a transient period, and the transition between the two selected states should be performed in a determined time to keep the thermal stresses below the allowable limit.

With the help of the computer, the thermal stresses in the rotor can be calculated minute by minute based on the actual temperature at the first stage provided by a thermocouple. The assumption that the turbine was in a steady state condition is not necessary. Once the thermal stress (or strain) is calculated, it can be compared with the allowable value, and the difference used as the index of the permissible first stage temperature variation, translated in the computer program as a variation of speed or load or rate of speed or load change.

Using the memory of the computer, values of some parameters can be stored for use in the estimation of their future values or rate of change, which in turn are used to take corrective measures before alarm or trip points are reached. Such is the case with metal temperature differentials and differential expansions.

Bearing vibration is another of the parameters for which the computer capacity is used in making logical decisions. Each bearing is under close supervision and when one of the vibrations reaches an alarm limit, its behavior is studied and a decision is made according to the estimated future value of the vibrations, and whether it is an increasing, steady or decreasing function. A priority system is also inserted due to the possibility that two or more bearings may be in a different stage of alarm.

Under the approach used in the program, the rotor stress (or strain) calculations, sub-program P No. 01, and its decision-making counterpart, sub-program P No. 04, are the main controlling sections. They will allow the unit to roll with relatively high acceleration until the anticipated value of strain or other controlling parameters predict that limiting values are to be reached in the near future. Then a lower rate is selected and, if the condition persists, a speed hold is generated.

The following describes the Automatic Turbine Start-Up Program (ATS) in the DEH-P2000 Controller. The ATS program employs general concepts including the rotor stress control concepts described in the aforementioned Berry patent. In providing automatic control and monitoring, the ATS provides improvements over the Berry patent and earlier control systems in which digital computers have been used to provide supervisory startup control over analog EH controls.

The ATS Program is stored and executed in the same Central Processing Unit (CPU) as the basic DEH programs. Both programs work directly together by means of shared core locations. They also share the same input/output hardware and software, which is needed to communicate with the outside world, i.e., to read and operate contacts. The ATS Program is capable of rolling the turbine from turning gear to synchronous speed and application of initial load. It will check the preroll conditions, determine if a soak period is required, transfer from throttle valve (TV) to governor valve (GV) operation, check the presynchronizing conditions and allow the automatic synchronizer to put the unit on line or otherwise allow synchronization to occur, i.e., under accurate speed loop control.

During the operation of the turbine, whether during the acceleration period or under load, the computer will monitor the various parameters of the turbine, compare their values with limit values and print messages to inform the operator about the conditions of the machine to guide him in the operation of the unit.

The modes of operation are ATS Control and ATS Supervision. If both the "turbine auto-start" and the "turbine supervision off" pushbuttons are not backlighted the ATS Program is in ATS Supervision and messages are printed out. Pressing the turbine autostart button brings the ATS Program into ATS Control. Pressing the turbine supervision off button stops the messages from being printed out while the ATS Programs are still running. If the turbine supervision off button is pushed a second time, all current alarm messages and all subsequent messages are printed.

The computer performs the following evaluations and control actions:

a. Every minute prior to rolling off turning gear, the program checks and compares with allowable limits, the following parameters: Throttle temperature, differential expansions, metal temperature differentials, vacuum, exhaust temperatures, eccentricity, bearing metal temperatures, drain valve positions.
b. Requests a change in throttle steam conditions to match impulse chamber steam temperature to metal temperature within −100° & +200°F.
c. Allows the turbine to roll off turning gear.
d. Sets the target speed and selects the acceleration in the DEH controller.
e. Determines the heat soak time at 2200 RPM and counts it down.
f. Accelerates the turbine to 3300 RPM at controlled rates.
g. Commands the DEH controller to transfer from throttle to governor control.
h. Accelerates the turbine to synchronous speed.
i. Allows the Automatic Synchronizer and DEH Controller to put the turbine on the line and apply minimum load.
j. Calls for a "Load hold" at initial load if required by the thermal conditions of the turbine.

Under ATS Supervision, the function of the computer is limited to monitoring the various parameters and generating appropriate messages to assist the operator in the control of the turbine. The strain calculation is continuously performed to advise the operator about the thermal condition of the rotor. It is the operator's responsibility to match steam and metal temperatures, set demands, select rates of speed and load changes, determine the heat soak requirements and take all the necessary sequential steps to bring the turbine up to speed and load it.

Figure 30:
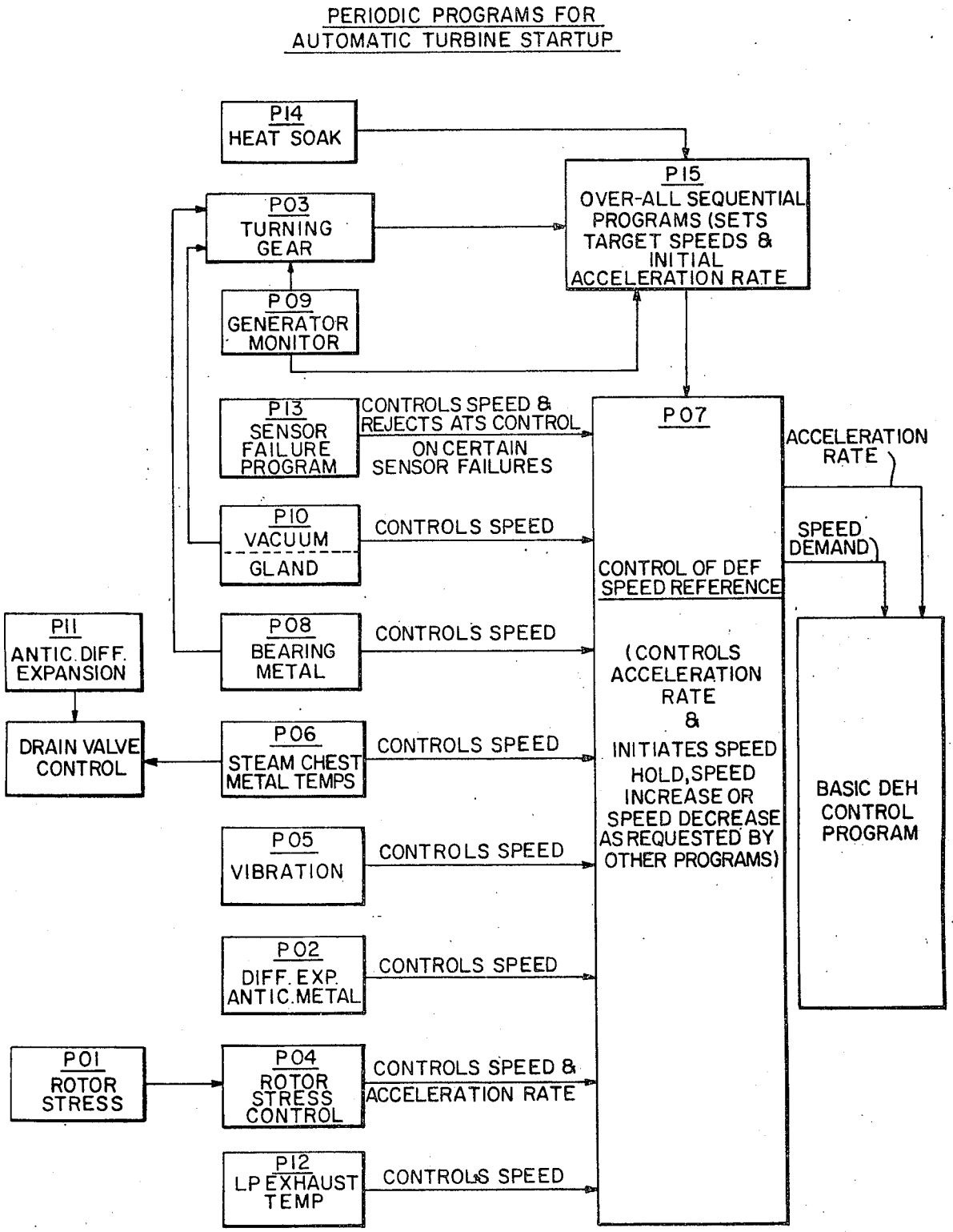
FIG. 30 shows a block diagram of the sense parameters in the automatic turbine startup and monitoring program which is operable in accordance with the principles of the invention.

All programs are called periodically and will run to completion unless preempted by a higher priority program. Program P15 determines the appropriate action to be performed in a sequential operational order. Programs P01 through P14 check the turbine and generator parameters. They compute rotor temperatures and strain at impulse chamber zone; they calculate anticipated metal temperature differentials and differential expansions. Depending on the mode of operation these programs generate the new DEH demands or holds. See FIG. 30, titled "Periodic Programs For Automatic Turbine Startup".

PROGRAM LIST

P01 Determination of rotor thermal conditions.
P02 Periodic computation and supervision of anticipated steam chest wall, bolt flange temperature differentials and differential expansion.
P03 Supervision of turning gear operation.
P04 Control of rotor stress at first stage.
P05 Supervision of eccentricity and vibration.
P06 Turbine metal temperature supervision.
P07 Control of EH speed reference.
P08 Supervision of bearing temperatures.
P09 Supervision of generator.
P10 Supervision of gland seal, turbine exhaust and condenser vacuum conditions.
P11 Supervision of drain valves and computation of anticipated differential expansion.
P12 Supervision of LP exhaust temperatures.
P13 Sensor failure action.
P14 Computation and timing of heat soak time.
P15 Acceleration sequence.

The ATS automatic startup program 1141 is able to control the speed of the turbine generator 10 to well within a maximum deviation of 1 rpm over tens of minutes. Because of the extreme accuracy with which the ATS program 1141 can hold the speed of the turbine generator 10, a preferred method for synchronization in the present embodiment is the use of manual synchronization of the generator 16 to the line. The automatic dispatch system sends signals to the ATS program 1141 thereby allowing the ATS program to hold the speed of the turbine generator system 10 to well within 1 rpm. By the use of simple lamps to indicate the differential phase between the generator 16 and the lne an operator is conveniently able to manually synchronize the system.

A more common approach, in the prior art, is the use of conventional automatic synchronizer equipment. However, because of the high degree of accuracy which the ATS program 1141 controls the turbine generator 10 the present system is easily synchronized without conventional automatic synchronizer equipment.

PROGRAM P01

DETERMINATION OF THE ROTOR THERMAL CONDITIONS

Figure 31:
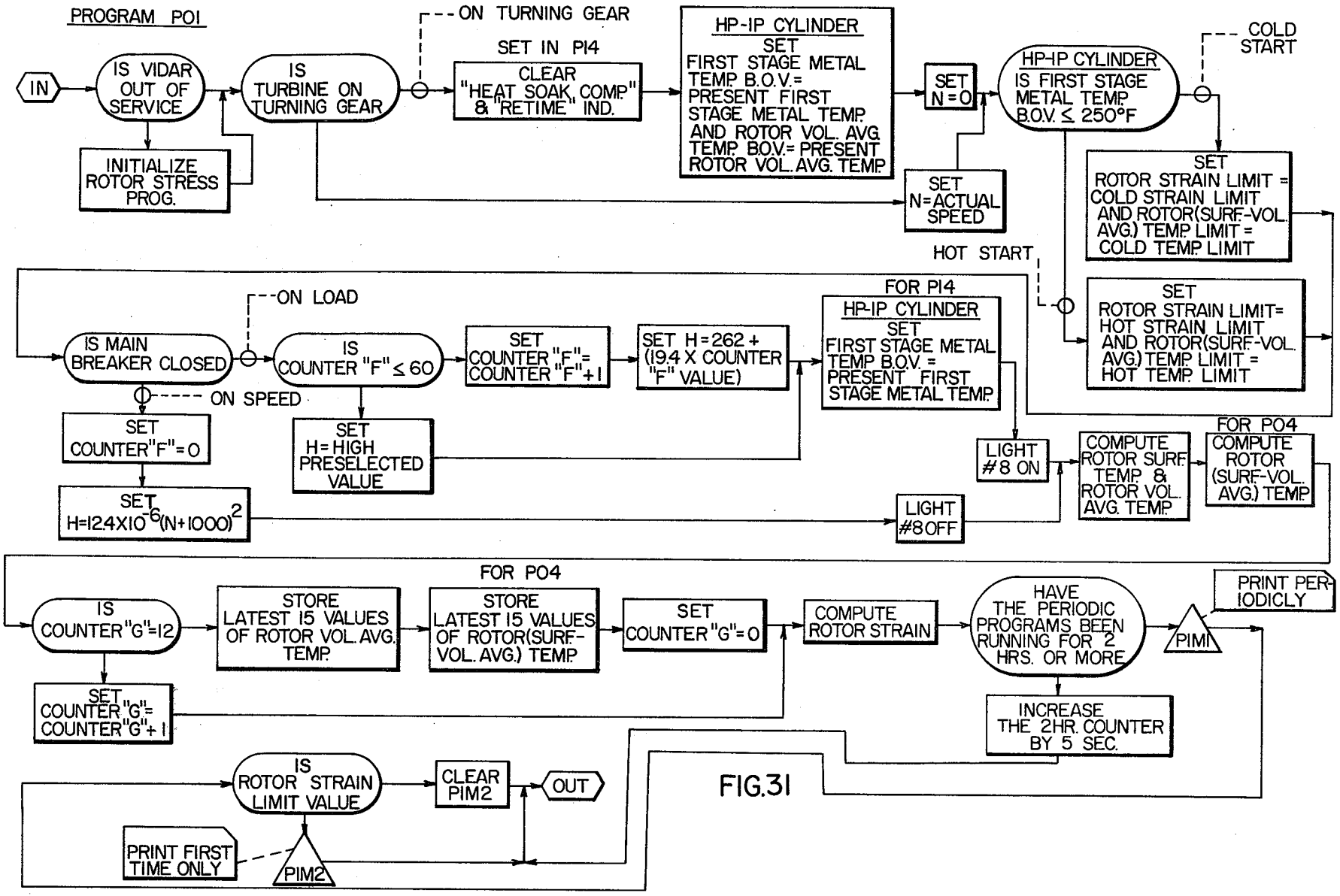
FIG. 31 shows a flow chart of a program for determining the rotor stresses in the turbine rotor which is operable in accordance with the principles of the invention.

This program runs periodically to calculate and update the temperature of the H.P. rotor at the first stage zone, based on the temperature of its environment. Heat Transfer coefficient, rotor temperatures, temperature differentials, and rotor strain are calculated. The results are invalid if the rotor temperature has not been calculated continuously for at least 2 hours i.e. if the program was not running or the relevant sensor not in service. Then the ATS control mode cannot be entered, only STS Supervision is possible. See FIG. 31.

Program Sequence

If the analog signal to frequency (A/F) converter is out of service the rotor stress program is initialized with the actual first stage metal temperature.

If it did not run one cycle the variable values used in the program to start the calculations would be misleading.

If the unit is on turning gear (TG) the "HEAT SOAK COMPLETE" indicator is cleared to allow the calculation and timing of heat soak to be initiated.

The HP first stage metal and IP metal temperatures before opening the valves (bov) to be used in the heat soak calculation program are set equal to the present metal temperatures, this being an updating process that occurs only when the unit is on TG. Until the unit has been synchronized these temperatures are not changed since the heat soak calculation is based only on initial metal temperature values.

If the unit is not on TG, the variable N used to calculate the heat transfer coefficient is set equal to actual speed, otherwise it will be N = 0.

The first stage metal temperature will determine if the turbine will go through a cold or hot start procedure. Rotor strain limits as well as rotor (surface-volume average) temperature are chosen based on the above temperature.

The heat transfer coefficient H will be computed as a function of speed reaching its higher value in the speed mode at rated speed. (see FIG. 1). Once the breaker is closed H will increase linearly as a function of time reaching its maximum value after 5 minutes. The heat coefficient algorithms for speed and load modes are:

$$H_{speed} = 12.4\ (1000 + N)^2 \times 10^{-6}\ N = \text{RPM}$$

$$H_{Load} = 262 + (12.3 \times \text{Time Counter}).$$

The rotor surface temperature is calculated as a function of the first stage steam temperature, the present heat transfer coefficient, and the rotor metal temperature's history. The magnitude of the rotor stress is determined by the rotor (surface-volume average) temperature which is stored in memory to be used by program P04 to analyze the rotor conditions based on present and past history. If the computer has been running afer initialization for 2 hours or more the rotor temperature calculation will be considered valid. Rotor strain, which is a direct function of the rotor temperature, is then calculated, compared to the selected limit and printed out if it is found to exceed the limit.

Rotor surface temperature $= T_s$
Rotor Volume Average $= \overline{T}$
Rotor strain $= C.f(T_s, \overline{T})$ Principal steps accomplished in this program are:

1. Set:
   a. 1st stage metal temperature b.o.v.
   b. rotor strain limits
   c. rotor (surface-volume average) temperature limits
2. Calculate:
   a. heat transfer coefficient (H)
   b. rotor (surface-volume average) temperature
   c. rotor strain
3. Store and Update:
   a. latest 15 values of rotor volume average every 1 min.
   b. Latest 15 values of rotor (surface-volume average) every 1 min.

PROGRAM P02

Computation and supervision of anticipated steam chest wall, bolt flange temperature differentials and differential expansion. This program runs every 1 minute to calculate the anticipated steam chest wall temperature difference in both chests. The actual generator and governor end differential expansion are compared against limits to determine the best course of action.

Program Sequence

The SKIP NO PART OF P02 indicator is used to avoid erroneous calculations of the anticipated temperature differentials when this program runs for the first time. This is accomplished by setting this indicator when the programs are initialized. Likewise P13 sets this indicator in order to avoid misleading actions and messages when at least one of the thermocouples used in this part of the program is out of service.

This program will calculate the 5 MINUTES ANTICIPATED STEAM CHEST WALL TEMPERATURE DIFFERENTIAL as a linear interpolation for a 5 minute period from the latest stored temperature difference and the one stored one minute before. The algorithms used is $T_A = T_j + 5\ (T_j - T_{j\sim 1})$. The heating-/cooling limit for the ANTIC. (IN-OUT) WALL TEMP. DIFF. is ± 150. A speed or load hold is generated by ANTIC. METAL COND REQUIRE HOLD indicator.

The GENERATOR END and GOVERNOR END differential expansion input is checked against the alarm and trip limits resulting in different actions taken by program P07.

Generator End: If the input exceeds the ALARM limit the DIFF. EXP. SPD HOLD indicator is set. This results in a speed or load hold.

If the input exceeds the TRIP limit the DIFF. EXP. TRIP indicator is set and a tripping action is initiated.

Governor End: Two different actions are taken when the alarm limits are exceeded.

If the rotor is short the DIFF. EXP. INCR SPEED RATE indicator is set in order to increase the ACCELERATION which will result in an increase of the heat transfer coefficient. Therefore the rotor will heat faster counteracting the cause that generated the alarm.

If the rotor is long the DIFF. EXP. SPD. HOLD indicator. This results in a speed or load hold. If the TRIP limit is exceeded the DIFF. EXP. TRIP indicator is set and a tripping action is initiated.

Any of the conditions analyzed will set the DIFF. EXP. OF NORMAL indicator which will prevent the turbine from rolling off turing gear (Ref to P03), if the turbine is on turning gear.

Figure 3:
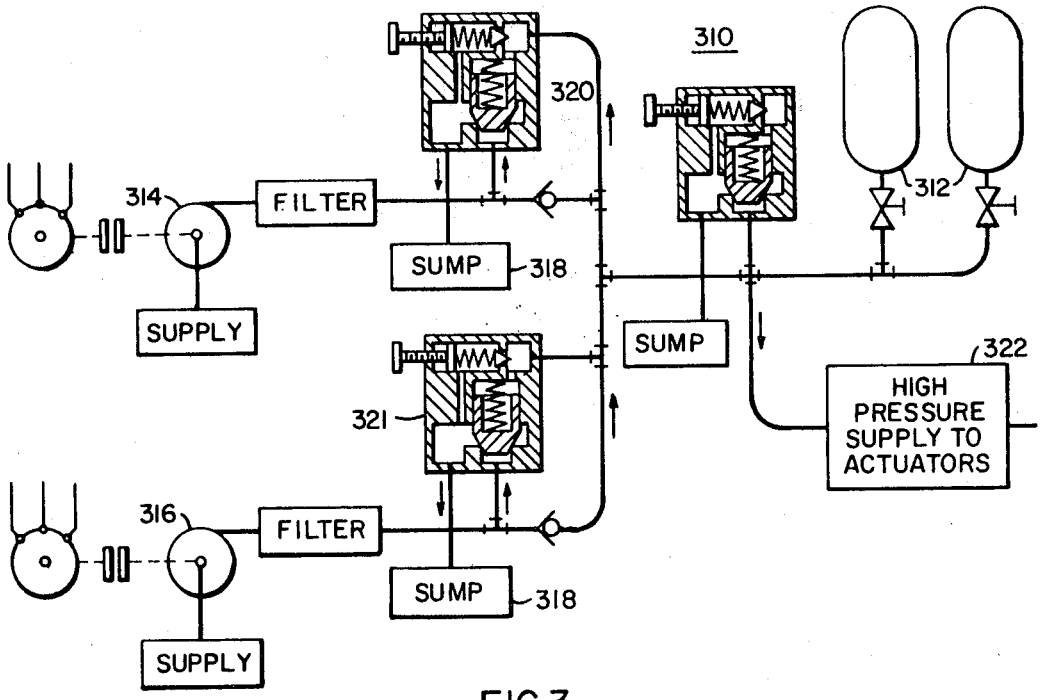
FIG. 3 shows a hydraulic system for supplying hydraulic fluid to valve actuators of the steam turbine.

In the Figures, there are shown the GENERATOR END and GOVERNOR END differential expansion non-contacting sensors in relationship to the thrust bearing and turbine elements for the rotor long and rotor short relative position. A representation of the supervisory recorder scale and the pointer movement in relation to the sensors and shaft position are shown. FIG. 3 shows the alarm and trip limits in relation to the pointer movement in the supervisory recorder scale.

P02

Principal steps accomplished in this program are:

1. Calculate the:
   a. 5 MIN. anticipated steam chest wall temperature differential
   b. 5 MIN. anticipated HP & IP (flange-bolt) temperature differential.
2. Compares against limits the:
   a. anticipated HP & IP (flange-bolt) temperature differential
   b. anticipated steam chest wall differential
   c. governor end present differential expansion
   d. generator end present differential expansion.

Action Taken

Generator End exceed alarm short - speed/load hold exceed alarm long - speed/load hold exceed trip - short or long - turbine trip request Governor End exceed alarm - short - accelerate exceed alarm - long - speed/load hold exceed trip - short or long - turbine trip request.

PROGRAM PO3

Supervision of Turning Gear Operation

Figure 32:
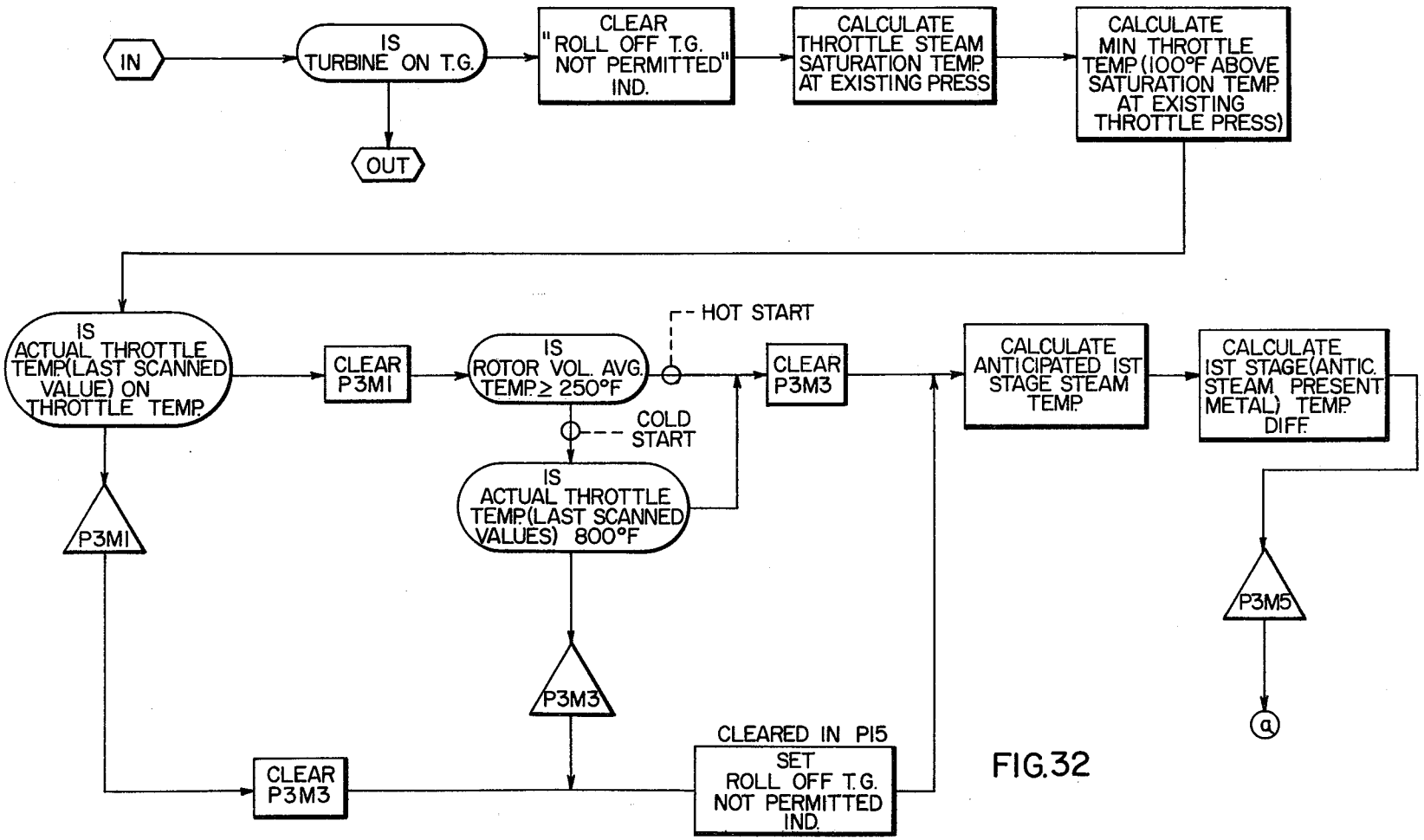
FIG. 32 shows a flow chart of the ATS roll-off subroutine which is operable in accordance with the principles of the invention.
Figure 34A:
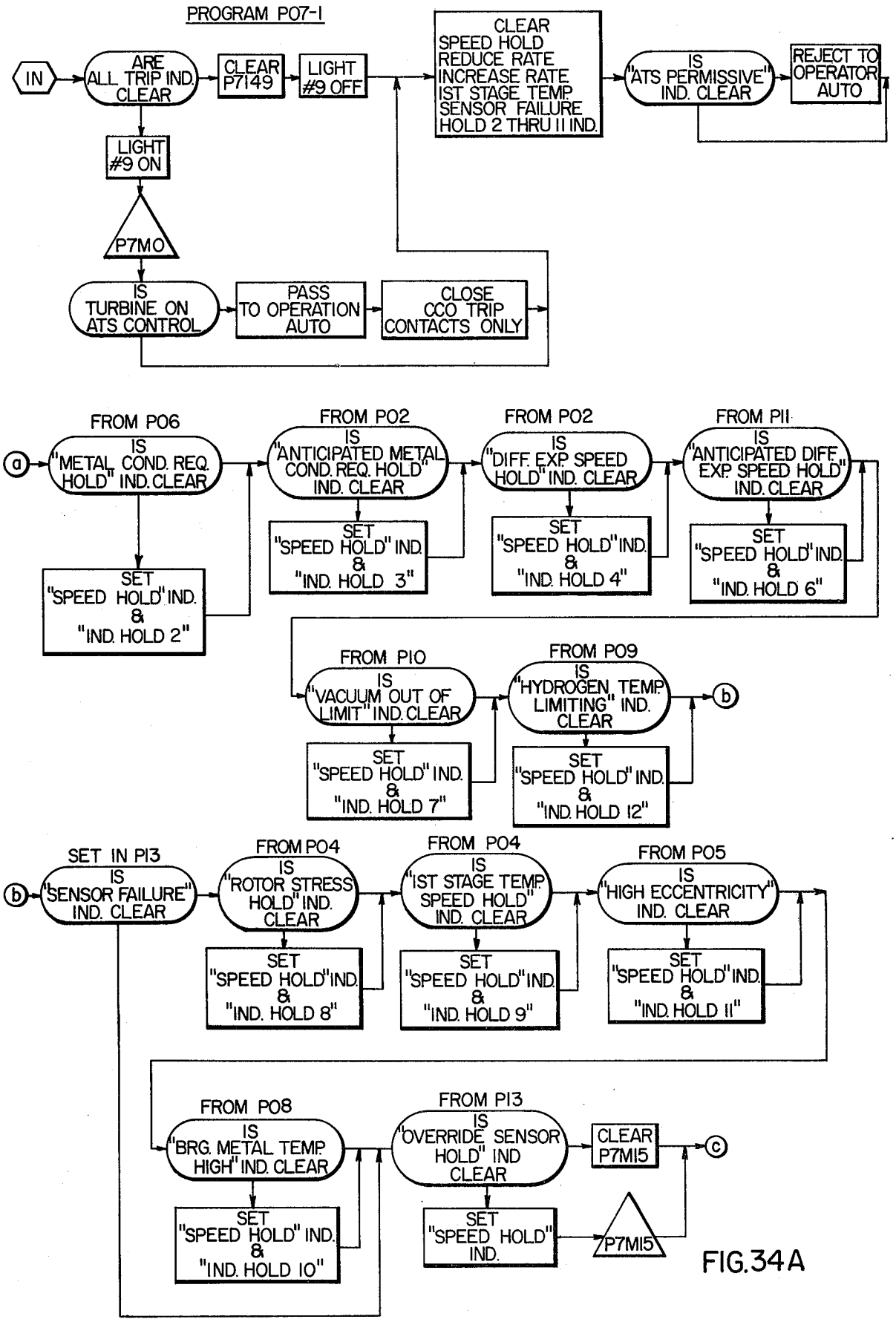
FIGS. 34A and 34B show a portion of the flow chart of the ATS program which is operable in accordance with the principles of the invention.
Figure 34B:
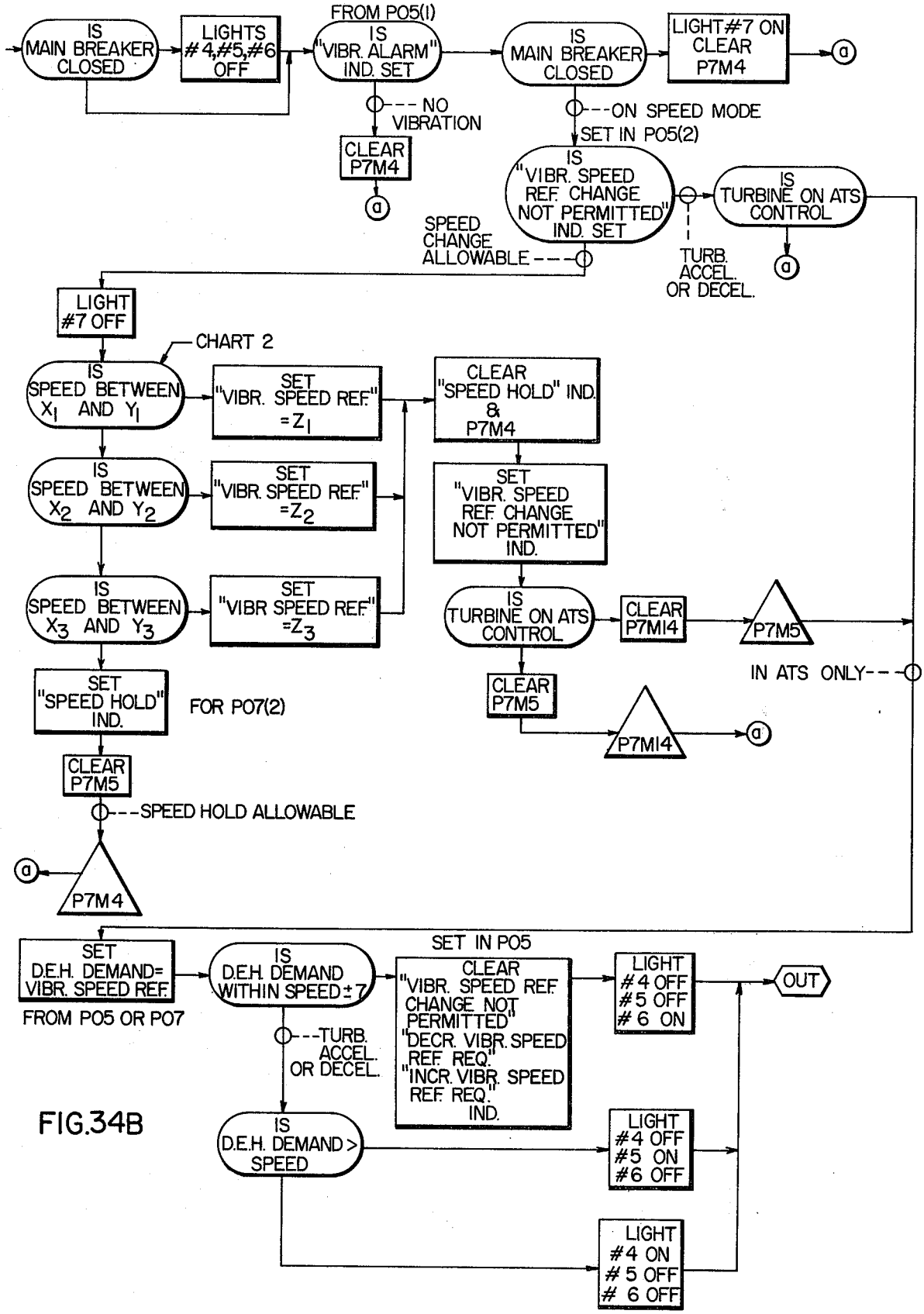
Figure 35A:
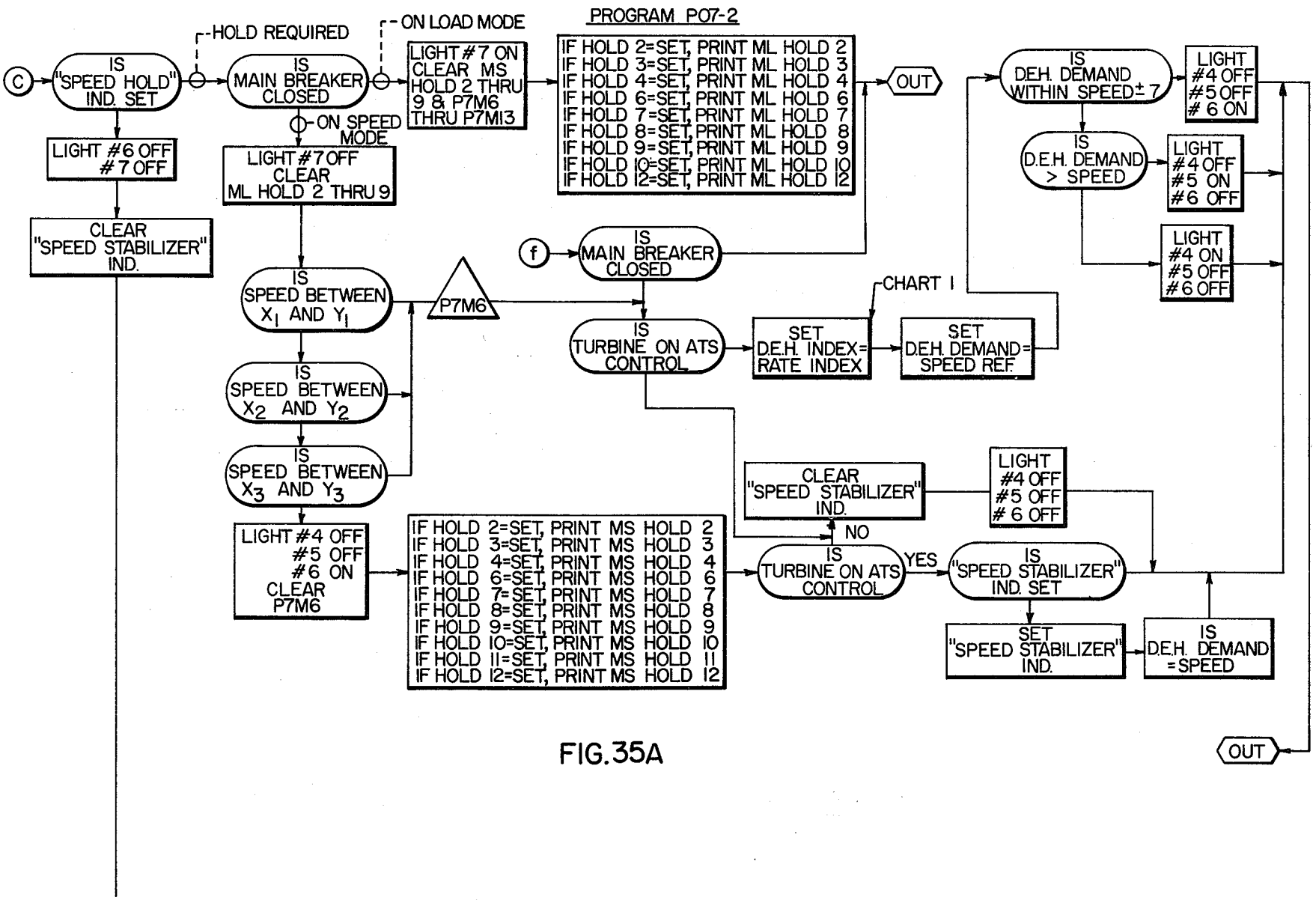
FIGS. 35A and 35B show a flow chart of the ATS program with library charts which is operable in accordance with the principles of the invention.
Figure 35B:
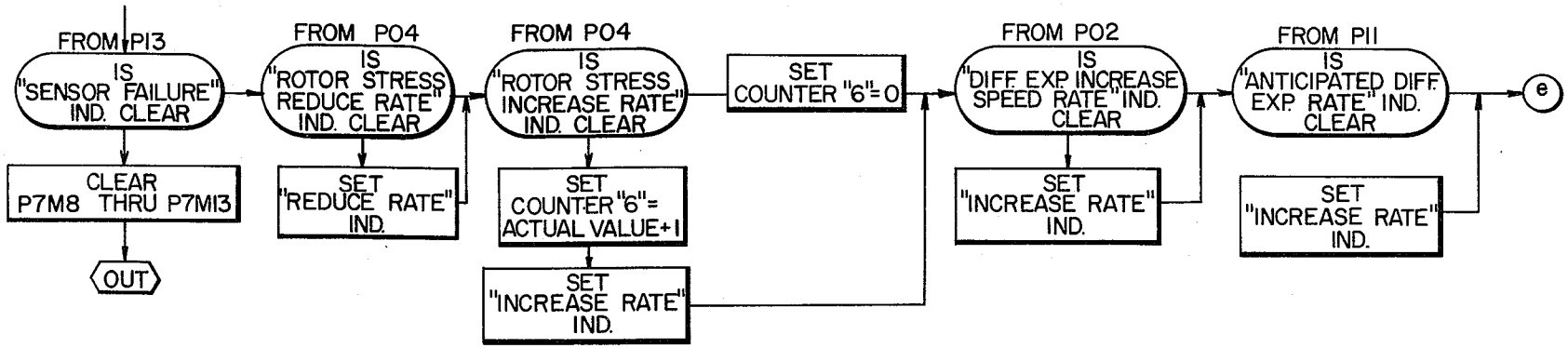
Figure 36A:
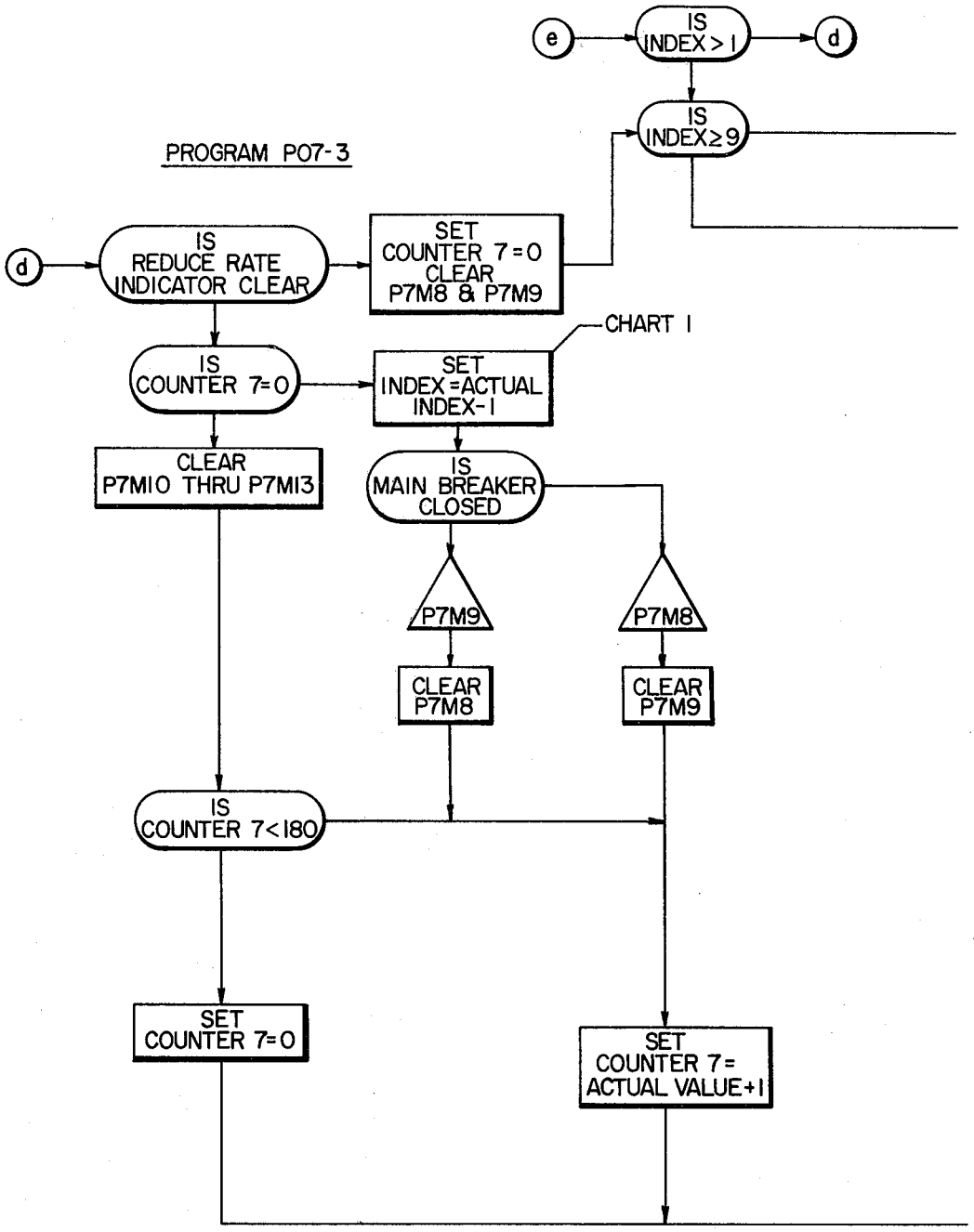
FIGS. 36A and 36B show the flow chart of the ATS acceleration program which is operable in accordance with the principles of the invention.
Figure 36B:
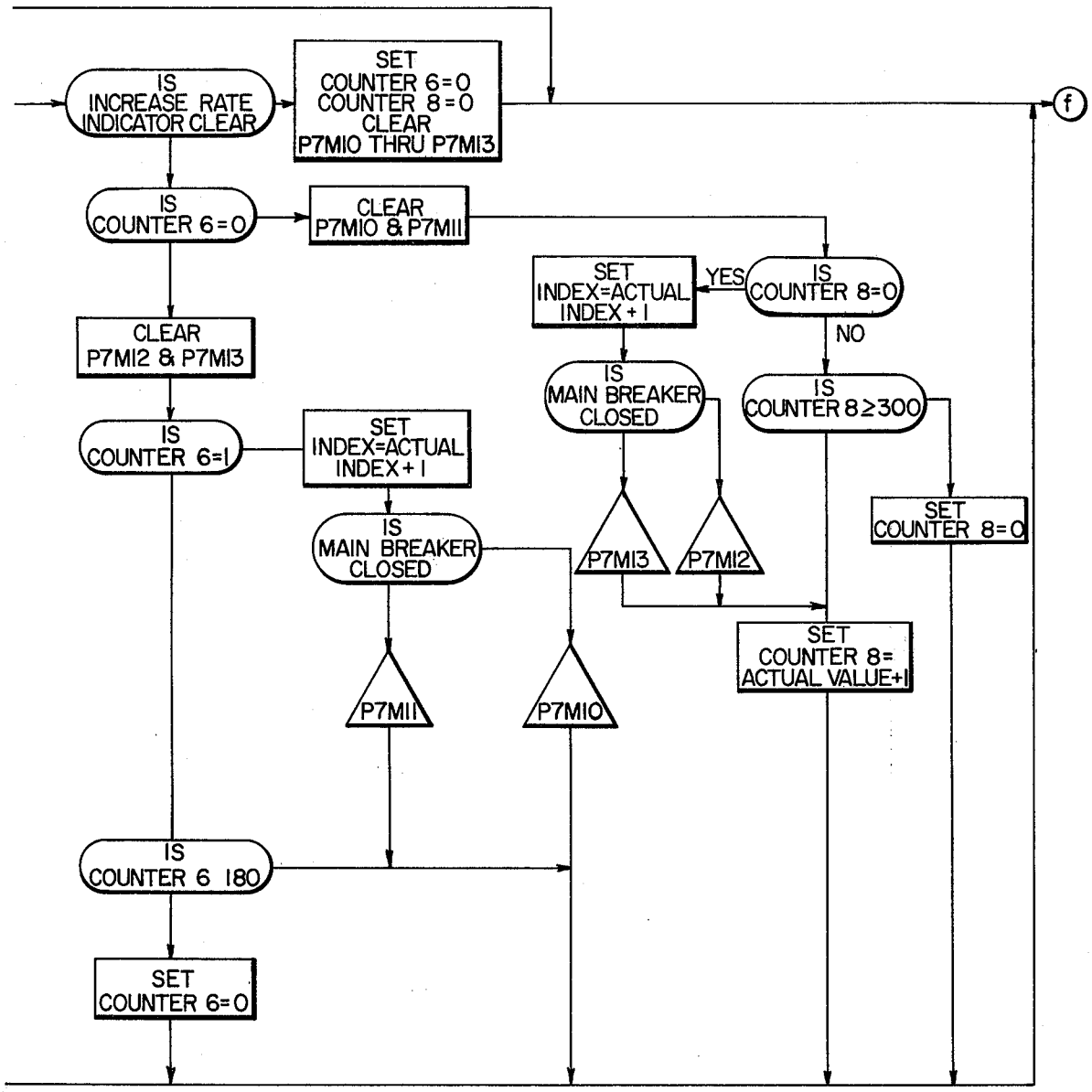

All conditions that would hold the unit from rolling-off turning gear are checked. Messages will guide the operator on how to obtain the allowable mismatch between the impulse chamber steam and metal temperatures. See FIG. 32

Program Sequence:

This program runs to completion only if the unit is on turning gear. The minimum allowable throttle steam temperature at the existing pressure is checked against the actual throttle steam temperature (TST).

In the event of low TST the minimum allowed TST necessary to avoid steam condensation is printed out.

If the TST is too high in respect to the rotor the TST will have to be decremented.

The two above mentioned conditions will prevent an automatic roll-off turning gear. The computer estimates what the first stage steam temperature would be when the valves open, as a function of the actual throttle steam temperature and pressure.

The expected temperature mismatch between the expected or anticipated first stage steam and metal temperature is checked. If the mismatch is out of specified limits a message will tell the operator what the first stage steam temperature should be to fall within limits and therefore permit the roll-off as soon as the inlet conditions are adjusted accordingly.

The following conditions checked and flagged in another program have to be within limits before a roll-off is allowed.

| FROM | CONDITION |
|---|---|
| P02 | Present differential expansion (governor & generator end) |
| P05 | Rotor eccentricity |
| P06 | Present steam chest wall temperature differential |
| P06 | Present cover-base wall temperature differential |
| P08 | Bearing oil temperature and pressures |
| P08 | Lube oil out of cooler temperature |
| P09 | Generator and exciter cooling media |
| P10 | Gland steam and rotor metal temperatures |
| P10 | LP exhaust pressure |
| P10 | LP exhaust hood temperature |
| | Drain valve conditions |
| | EH fluid pressure |

The above listed conditions will be alarmed by setting a common indicator for P15.

PROGRAM PO4

Control Of Rotor Stress At First Stage

Since the rotor surface thermal stress (or strain) is proportional to the surface-to-volume average temperature differential calculated in PO1, this is the parameter selected to determine the acceleration. By comparing the present value with previous values, the program finds the type of thermal transient the rotor is undergoing, and selects the path to be followed. An extrapolated value is also calculated and compared with the allowed value, according to this difference. See FIG. 33.

Program Sequence:

If the turbine is off turning gear, latched, and the periodic programs have been running for 2 hours or more we proceed to:

1. Calculate the 15 minute anticipated rotor (surface-volume average) temperature.
2. To set permissive indicators for the PO7 periodic program that will hold, reduce or increase turbine speed.

If the turbine is in turning gear and latched but the periodic programs have not been running for 2 hours or more we proceed to:

1. Store and update the latest ten values of 1st stage steam temperature to calculate the temperature gradient.
2. Hold speed by means of PO7 if the 1st stage steam temperature rate of change is $\gtrsim$ 300°/hr. and turbine speed is > 600 RPM.

An increase in speed or load rate will be requested making use of the ROTOR STRESS INCREASE RATE indicator if, 1.1 The load is increasing and the rotor heating or, 1.2 The load decreasing and the rotor cooling, the anticipated (surface-volume average) temperature difference is less than 50% of specified limit, and the present difference is less than 90% of the same limit.

2.1 The load is increasing and the rotor cooling.

2.2 The load is decreasing and the rotor heating, and the present (surface-volume average) temperature is less than 90% of limit.

3.1 In speed mode the motor is cooling, the anticipated difference is less than 10% of limit, and the present difference is less than 90% of limit.

4.1 In speed mode the rotor is heating, the anticipated difference is less than 50% of limit and the present difference is less than 90% of limit.

A reduction in speed or load rate will be requested making use of the ROTOR STRESS REDUCE RATE indicator, if 1.1 The load is increasing and the rotor heating, or
1.2 The load is decreasing and the rotor cooling, or
1.3 In speed mode the rotor is heating and the anticipated difference larger than the limit and the actual difference less than 85% of limit, or
The anticipated difference larger than 75% of limit.

Finally the remaining action, a speed or load hold will be requested making use of the ROTOR STRESS HOLD indicator which is set when 2.1 The load is increasing and the rotor heating
3.1 The load is decreasing and the rotor cooling
and a. the present temperature difference is larger than the limit
or b. the anticipated temperature difference is larger than the limit and the present temperature difference is large than 85% of limit.

PROGRAM PO5

Supervision Of Eccentricity and Vibration

This program analyzes present vibration inputs and takes action in accordance with the previously determined vibration trend.

Program Sequence:

The program starts by clearing the vibration trip and vibration alarm indicators. If the turbine speed is below 600 rpm it checks for eccentricity. If the eccentricity is below the alarm limit, the high eccentricity indicator is cleared and the program is completed. Otherwise it prints "high eccentricity" and sets the high eccentricity indicator. If the turbine speed is larger than 600 rpm it proceeds to set alarm limits as a function of turbine speed. Below 2400 rpm the vibration alarm limit wll be 8 mils. Above 3200 rpm it will be 5 mils. Between 2400 and 3200 rpm the vibration alarm will be a linear function of speed.

All vibration inputs to the computer are checked. This is done by as many loops as vibration inputs. Each loop represents one input as is referenced by an index number, according to the bearing number.

A trip is requested if a vibration input is equal to or higher than 10 mils. Tables are used to record the vibration values of each input. As more than one input may be in alarm at the same time, separate loops must be used. Also each input may be in a different stage of alarm requiring a speed hold or a change of speed to correct the vibration. Therefore, a priority system is necessary. Top priority is the decreasing mode, next is the hold condition and third the increasing mode of speed reference. Thus, a decrease is always checked before a hold or increase is called for by the conditions in the other vibration inputs. By applying the described method the following is accomplished for each bearing:

| Speed, N in RPM | Vibration, VIB in mils | Action |
|---|---|---|
| For all N | VIB ≥ 10 | Req. a Trip |
| 600 <N ≤ 2400 | VIB ≥ 8 | Alarm |
| 2400 < N ≤ 3200 | VIB>8-000375 ×(N-2400) | Alarm |
| 3200 < N | VIB> 5 | Alarm |

Vibration Trend

The program scans each vibration input in sequential order and determines if a vibration alarm condition exists. The alarm limit is decreased slightly to avoid an unstable alarm condition that would occur in the event of an input signal with ripple and/or noise. If a decrease or increase condition has not been set previously the program makes sure that the speed is not going to be held within the blade resonance range. If this is the case the program continues with the next sensor.

Otherwise, making use of counter "B" the program stores the present vibration level (VIB) for use one minute later and continues the scanning process. Once a minute has elapsed the following is executed.

$$(VIB)_{+1} - (VIB) = VIB$$

1. If Δ VIB> 0 the expected vibration 5 minutes later is computed by $(VIB)_{+5} = (VIB) + ((VIB)_{+1} - (VIB)) \times 5$
   1. If $(VIB)_{+5} \geq$ TRIP LIMIT speed is reduced by 200 rpm.
   If $(VIB)_{+5} <$ TRIP LIMIT the (VIB) is replaced by the present vibration level and the process described is repeated again.
   2. If Δ VIB ≤ 0 the program keeps updating (VIB), $(VIB)_{+1}$ and calculating Δ VIB until the alarm condition is cleared or until 15 minutes has elapsed. The latter would indicate that the vibration has been decreasing steadily for 15 minutes, as a result an increase in speed of 200 rpm will be requested.

The speed change is accomplished by making the SPEED REFERENCE equal to the VIBR. SPEED REF. in program PO7.

The VIB SPEED REF is decreased or increased by 200 RPM every time the conditions mentioned before are satisfied.

To make sure that the SPEED REFERENCE is only decreased or increased in steps of 200 RPM the VIBR. SPEED REF CHANGE NOT PERMITTED indicator is cleared only when the PRESENT TURBINE SPEED = SPEED REF.

PROGRAM PO6

Turbine Metal Temperature Supervision

The temperature difference across the steam chest wall has to be maintained within limits to avoid extreme stresses.

Temperature sensors in the base and cover of the HP or HP-IP turbine will monitor its temperature. A difference larger than 100°F denotes presence of water and the unit should be tripped to avoid further damage.

Program Sequence:

This program monitors and alarms on metal conditions of the steam chest walls, cylinder bolt-flange (in single case units), and cover-base cylinder differentials. When limits are reached speed or load holds are requested.

A trip is requested if the cover-base temperature difference indicates presence of water induction. In this program:

1. Limits are compared to:
   a. both steam chest (outer wall-inner wall) temperature difference.
   b. (flange-bolt) temperature.
   c. (cover - outer cyliner base metal) temperature.
2. Indicators are set to:
   a. hold speed if temperature differentials are above limits.

b. request ATS rejection if the (flange-outer cylinder base metal) temperature is > 100 and the load is 20% or the load is < 20% and the drain valves are open.

PROGRAM PO7

Control Of DEH Speed Reference

This is the speed controlling or action program. It sets DEH speed DEMAND which is used by the DEH speed control programs when in ATS control. Acceleration rates are also selected by checking permissive set by other programs. See FIGS. 34A through 36B.

Program Sequence

Trip conditions requested by other programs will reject the ATS program.

Vibration Trip (PO5)
Met. Temp. Trip (PO6)
Diff. Exp. Trip (PO2)
Brg. Metal Temp. Trip (PO8)

Any of the five sensors listed below will also make this program reject ATS.

1. differential expansion sensor (P13)
2. first stage metal temperature sensor (P13)
3. first stage steam temperature (P13)
4. reheat steam temperature (P13)
5. vibration sensor failed high and an adjacent vibration sensor failed high or is in an alarm condition (P13).

If there is at least one bearing with a vibration level above the ALARM limit and the unit is not on the line and the turbine is not changing speed (turbine not acclerating or decelerating) the program will make sure that the speed hold to be generated will not fall in the blade critical regions designated by "X" and "Y" in the flow chart.

If the turbine is dwelling at a blade resonance speed a new speed reference is generated which will decrease the speed to a lower level out of the resonant region. To avoid another reference change request due to the same cause the VIBR. SPEED REF CHANGE NOT PERMITTED is set, which will make the program go through a different path.

If in ATS mode the DEH demand will be changed to satisfy the new desired speed called by this program or by PO5.

As soon as the demand is within ± 7 RPM of the reference a new speed change will be permitted (if a request exists) by clearing the VIBR. SPEED REF. CHANGE NOT PERMITTED indicator. Lights are turned on and off accordingly.

With reference to connector (a) in the PO7 flow chart, once the vibration alarm is cleared indicators or flags set by other programs are scanned and new flags (to determine the type of message to be printed out) will be set. Following is a list of indicators scanned.

| FROM PROGRAM | INDICATOR |
|---|---|
| P02 | ANT. METAL COND. REQ. HOLD |
| P02 | DIFF. EXP. SPEED HOLD |
| P04 | ROTOR STRESS HOLD |
| P04 | 1st. STAGE TEMP. SPEED HOLD |
| P05 | HIGH ECCENTRICITY |
| P06 | METAL COND. REQ. HOLD |
| P08 | BRG. METAL TEMP. HIGH |
| P09 | HYDROGEN TEMP. LIMITING |
| P10 | VACUUM OUT OF LIMIT |
| P11 | ANTICIPATED DIFF. EXP. SPEED HOLD |

If the first stage steam temperature sensor fails messages requesting a hold because of rotor stresses are inhibited.

If the turbine is not dwelling at a blade resonance speed, a speed hold is requested (i.e. SPEED HOLD ind.) and continues per 3.1 of this program description.

With reference to connector (C) in the PO7 flow chart, if a speed hold other than vibration was requested, with the turbine in speed mode (i.e. breaker open) and not dwelling at blade resonance, speed messages indicating the type of speed hold are output.

The speed hold is accomplished by making the DEH DEMAND equal to the instantaneous REFERENCE.

If it is dwelling in or going through a blade resonance frequency zone the turbine will continue to accelerate toward the next speed reference plateau set by the Acceleration Sequence (P15) program before a hold.

If a speed hold was not requested and the first stage steam temperature sensor did not fail, the rotor stress program PO4 will decrease or increase the present acceleration rate one step down or up at the maximum rate of one step every 3 minutes according to the standard acceleration index table.

Present and anticipated differential expansion increase the acceleration rate at a maximum rate of one step every 5 minutes.

Acceleration rate changes will be carried on within the standard or allowable limit which are represented by index 1 through 9 (refer to PO7-3).

If a rate request change would allow the present rate to exceed the allowable limits the request and corresponding messages will not be acknowledged.

Once a rate is selected, the DEH DEMAND will be made equal to the target speed reference set by the Acceleration Sequencing program P15. This is accomplished by means of a jump to connector (f) in PO7-2.

Going back to connector (c) we will notice that if the turbine is in a hold speed condition and in load control relevant messages will be printed out.

PROGRAM PO8

Supervision of Bearing Temperature

This program monitors the lube oil in and out of cooler temperature, the bearing metal temperature, and the bearing oil header pressure.

Program Sequence

Two different low and high oil out of cooler limits are used. If the turbine is running (speed or load mode) a higher pair of limits are used.

If the turbine is accelerating the oil will increase in temperature therefore if the oil temperature is below the low limit but the turbine is accelerating no action is required from the operator. All journal and thrust bearing metal temperatures are checked against two limits.

If any one of the bearing metal temperatures exceeds 210°F an indicator is used to request a speed or load hold by means of program PO7.

If any of these temperatures exceeds 225°F, a trip request is generated. The bearing oil pressure is monitored continuously, nevertheless the only action taken is a hold if the unit is in the roll-off turning gear routine. The oil returning to the lube oil cooler should be kept below 170°F, otherwise the program will put out a message indicating this alarm condition.

Summarizing in a table like format the following are the different steps and actions that this program takes care of:

1. It compares against limits:
   a. the oil temperature out of cooler in turning gear
   b. the oil temperature out of cooler out of turning gear
   c. each metal bearing temperature (trip and alarm)
   d. the bearing oil pressure
   e. the oil temperature to cooler
2. It sets indicators that will:
   a. hold roll-off T.G. if, the lube oil temperature is too cold, or the lube oil pressure is too low
   b. hold speed or load if any bearing temperature exceeds the alarm limit
   c. request a turbine trip if any bearing temperature exceeds the trip limit.

PROGRAM PO9

Supervision of Generator

The generator cooling and sealing system and exciter cooling system are monitored by this program. Calculations are run continuously to determine if the generator stator coil temperature rise is within calculated limits.

Program Sequence

The generator cooling gas or water is monitored and a roll-off turning gear hold or a prior to synchronizing hold is generated if the cooling fluid exceeds a fixed high limit. A similar action is taken with the exciter cooling air.

The allowable coolant expected temperature rise is continuously calculated as a function of the coolant pressure (if it is a gas), the instantaneous or present stator current ($I_{SA}$) and the nominal stator current ($I_S$). Its limit is a sole function of the gas pressure (if gas cooled). Messages will tell the operator if the temperature rise trend is larger than expected. This will give him enough lead time to take a corrective action. Hydrogen pressure and purity are closely monitored, as well as seal oil pressures (air and hydrogen side).

The latter conditions will prevent the synchronization program to run. This means that the unit will go on a speed hold until these conditions are cleared.

Principal steps accomplished in this program are:

1. Calculate the:
   a. expected generator stator coil coolant discharge temperature rise.
   b. generator stator coil coolant temperature rise limit.
   c. present generator stator coil coolant discharge temperature rise.
   d. present exciter air temperature rise.
2. Compares against limits the:
   a. coolant inlet temperature.
   b. present generator stator coil coolant discharge temperature rise.
   c. exciter coolant air.
   d. exciter previously calculated temperature rise.
   e. hydrogen and air side seal oil pressure and temperature.
   f. hydrogen pressure.
   g. seal pressure difference
3. It checks the running status of the
   a. air side seal oil back-up pump.
   b. hydrogen side seal oil pump.

PROGRAM P10

Supervision of Gland Seal, Turbine Exhaust And Condenser Vacuum Conditions

This program monitors temperatures and pressures in the LP exhaust and temperature differences in the seal LP gland system. Exhaust spray operation is monitored and HP sealing steam temperature are also monitored.

Program Description

The following conditions, which are monitored by this program will not allow the P15 program to carry on the roll-off turning gear operation if the:

1. HP gland seal steam is too cold
2. LP gland seal steam temperature is too high (3500°F)
3. difference between the metal and the sealing steam temperatures in the HP sealing area is too great (± 200°F max.)
4. LP exhaust steam temperature is larger than the allowable limit for the sprays.

If the LP exhaust pressure is larger than 5 inches of Hg Absolute this program will request a speed or load hold carry on by PO7 as usual.

Turbine operation experience recommends that the LP exhaust sprays be open between 600 RPM and 10 percent load. This is properly monitored by this program. Commands to take corrective actions are given to the operator by printed messages.

PROGRAM P11

Figure 38A:
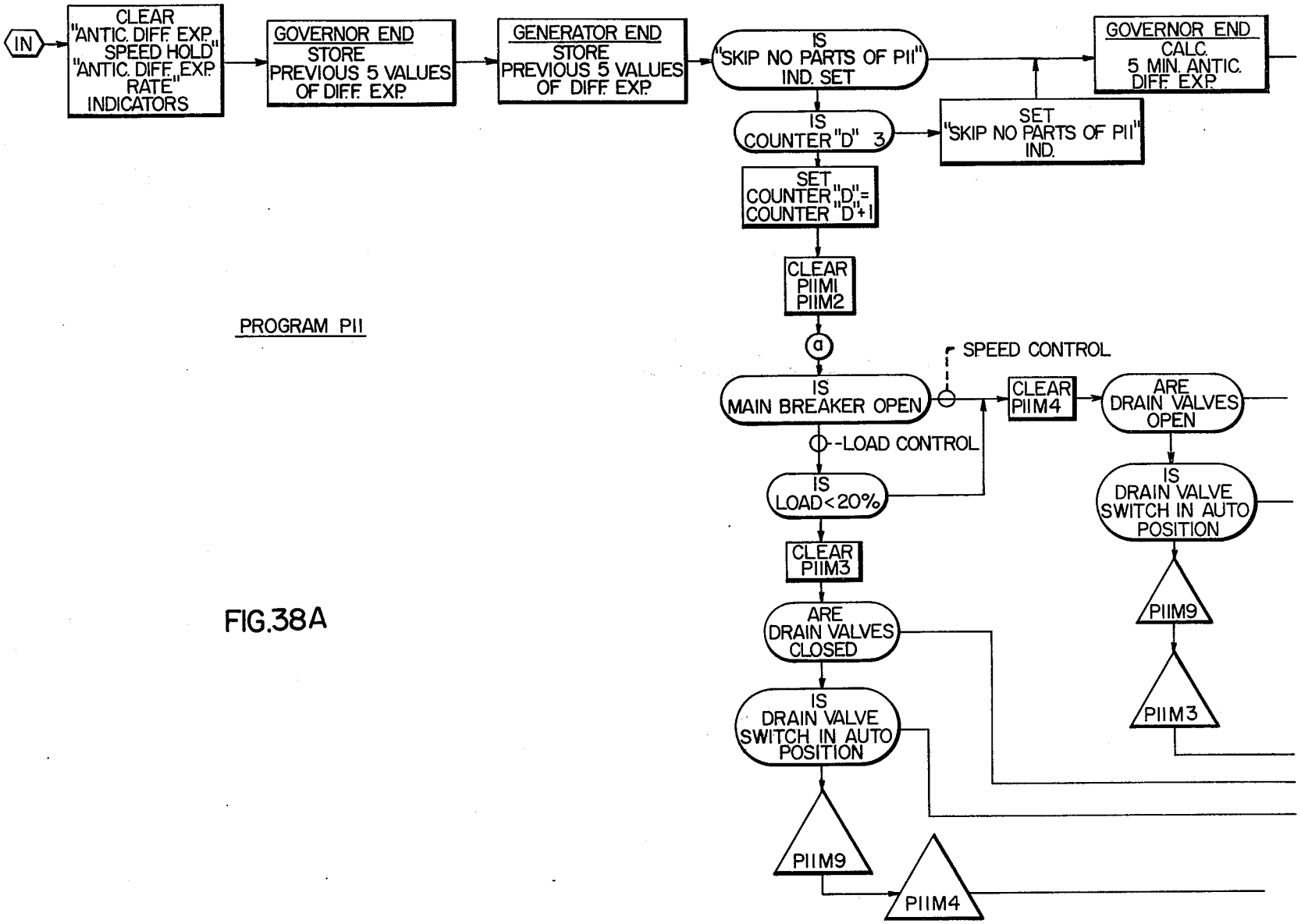
FIGS. 38A and 38B show a flow chart of the ATS program for drain valve control supervision of differential expansion which are operable in accordance with the principles of the invention.
Figure 38B:
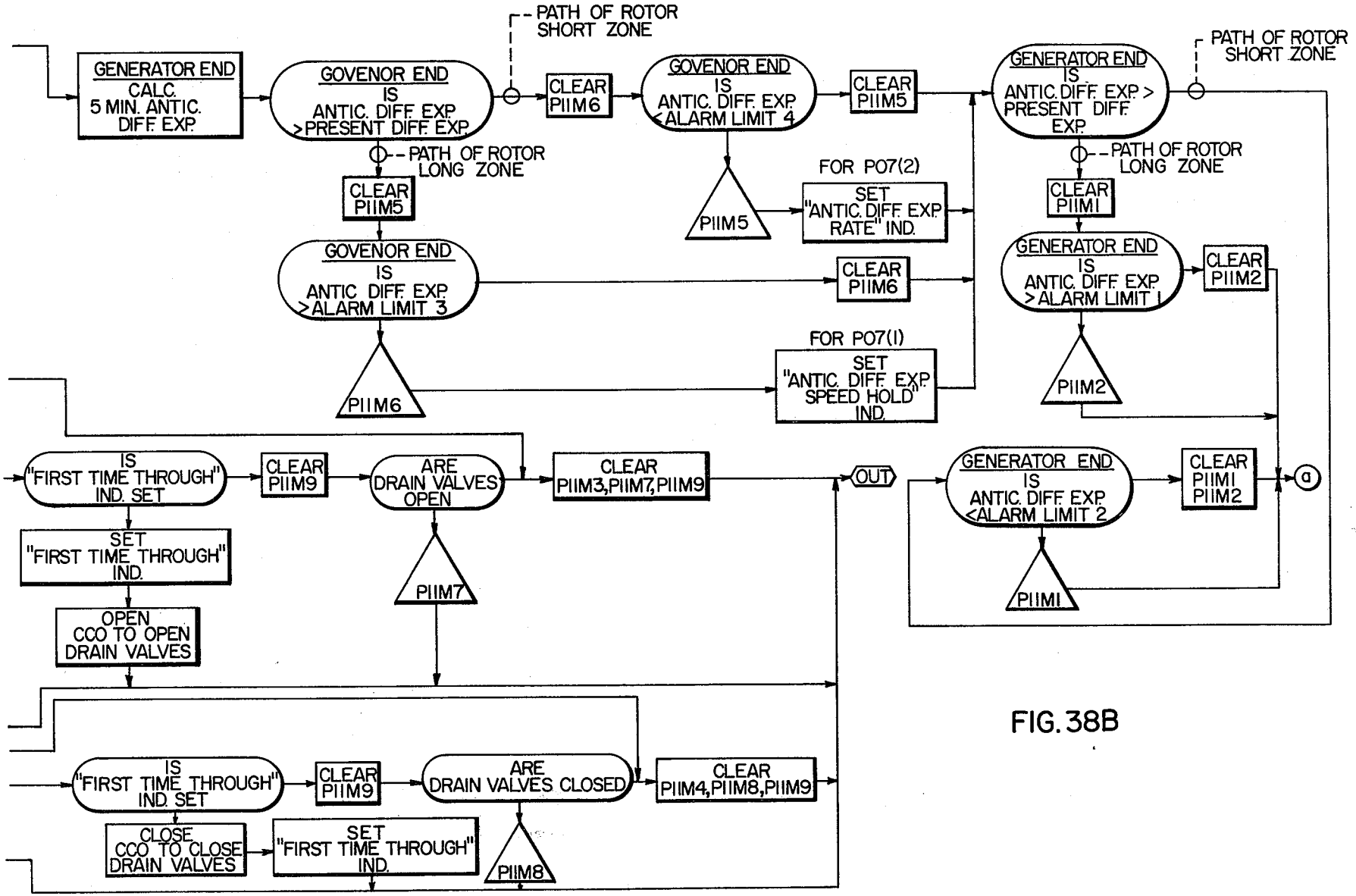
Figure 39A:
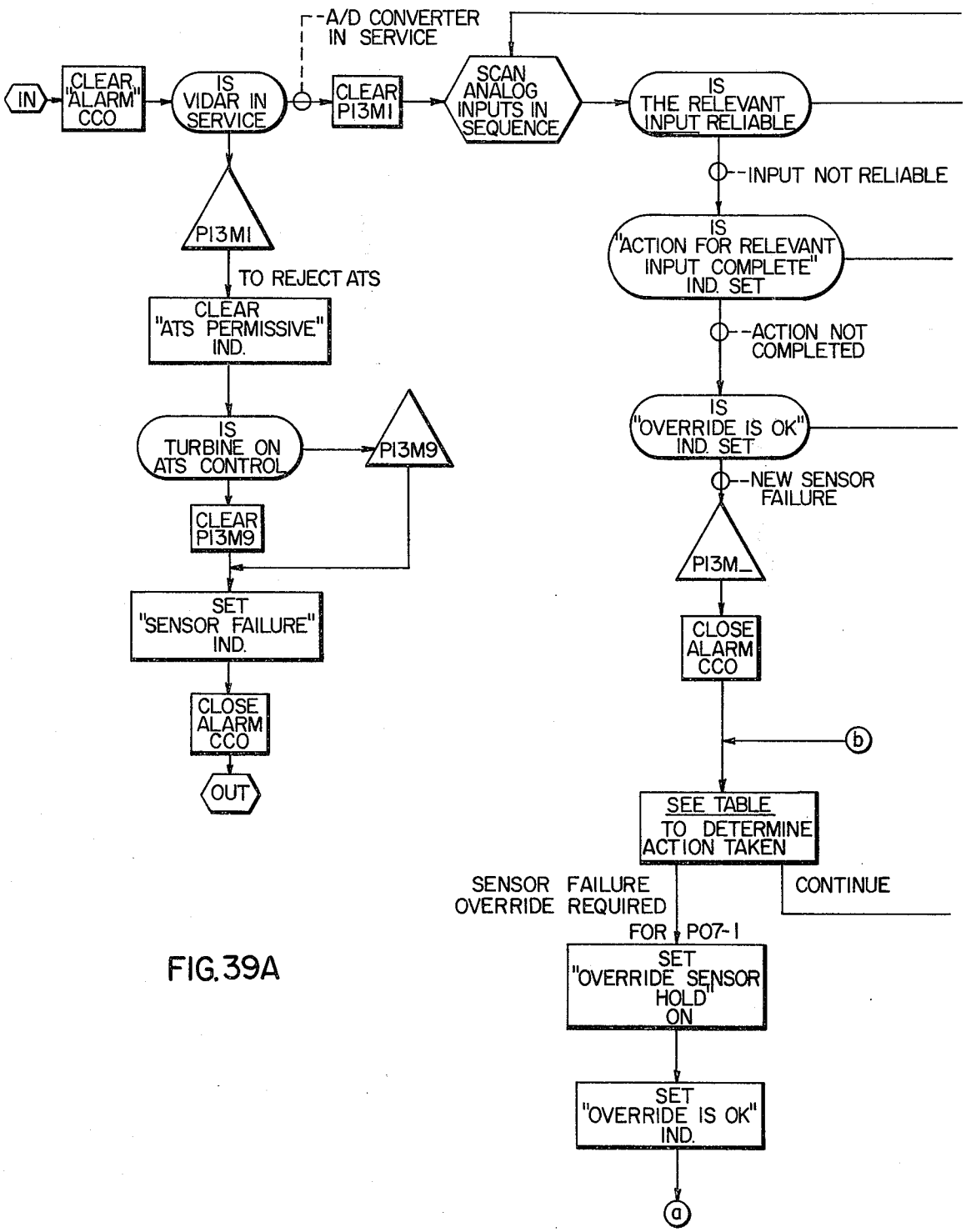
FIGS. 39A and 39B show a flow chart of the ATS program sensor failure detection subroutine which is operable in accordance with the principles of the invention.
Figure 39B:
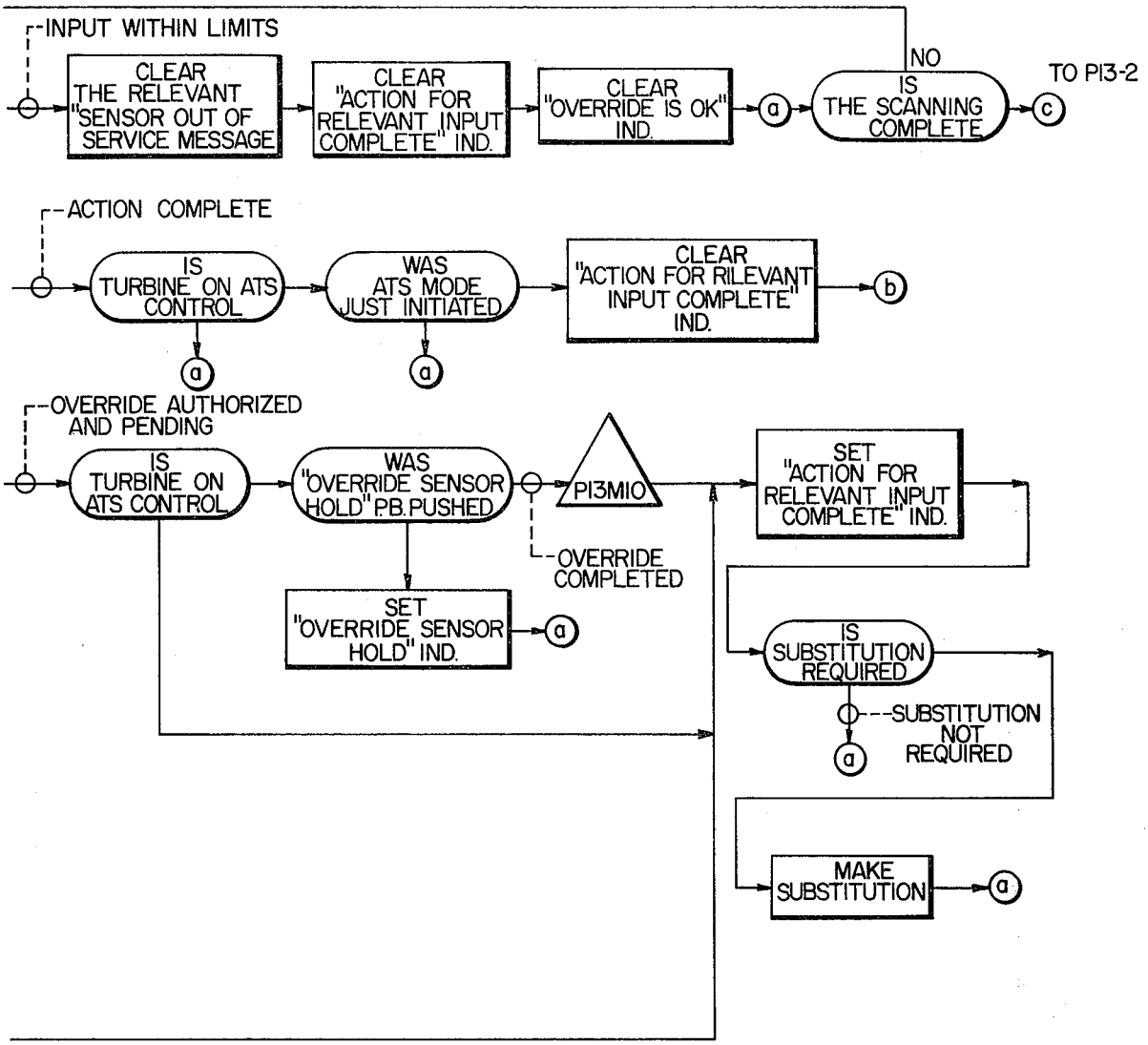
Figure 40A:
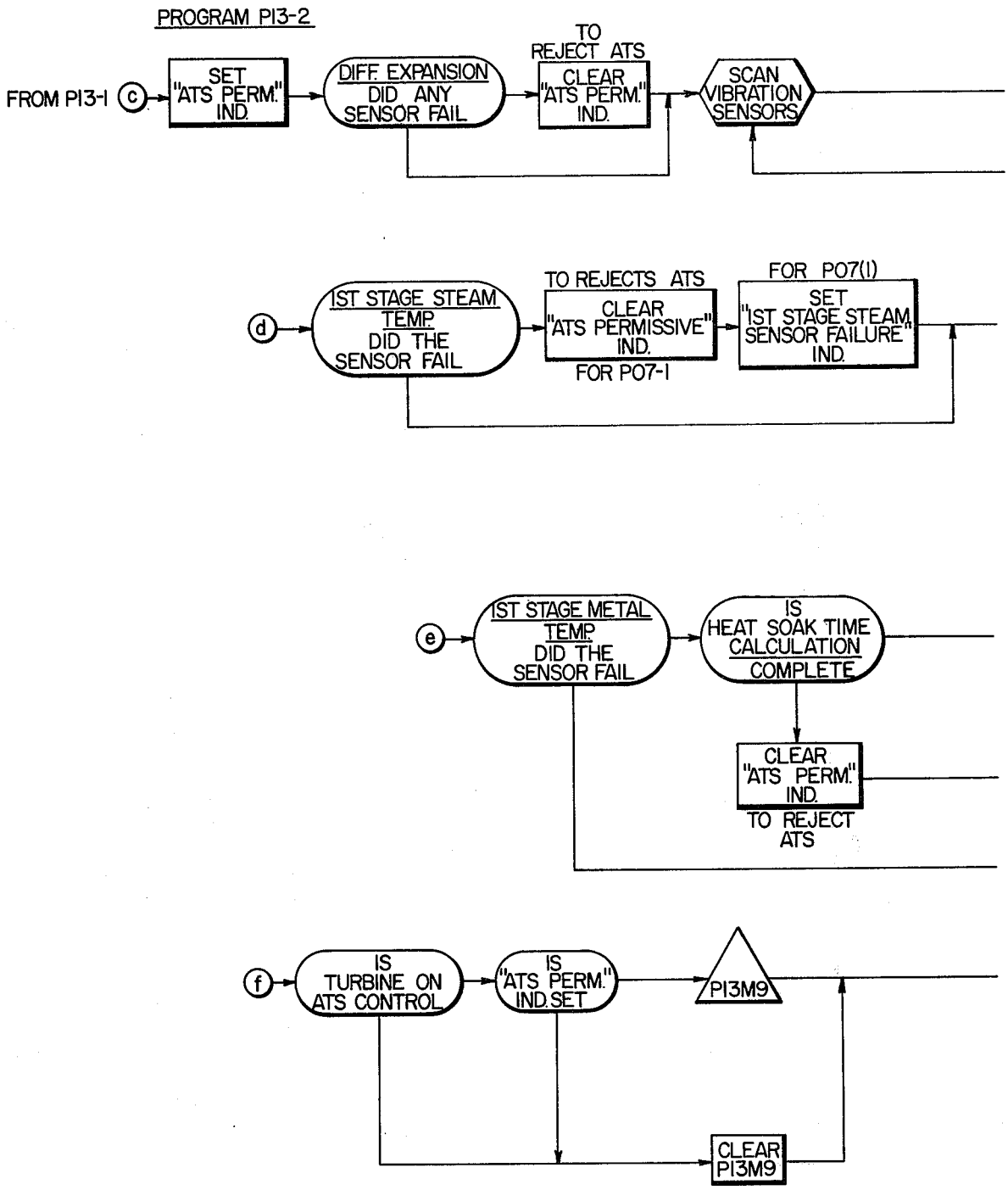
FIGS. 40A and 40B show a flow chart of the ATS vibration scan, reaheat temperature monitoring and heat soak time calculation which are operable in accordance with the principles of the invention.
Figure 40B:
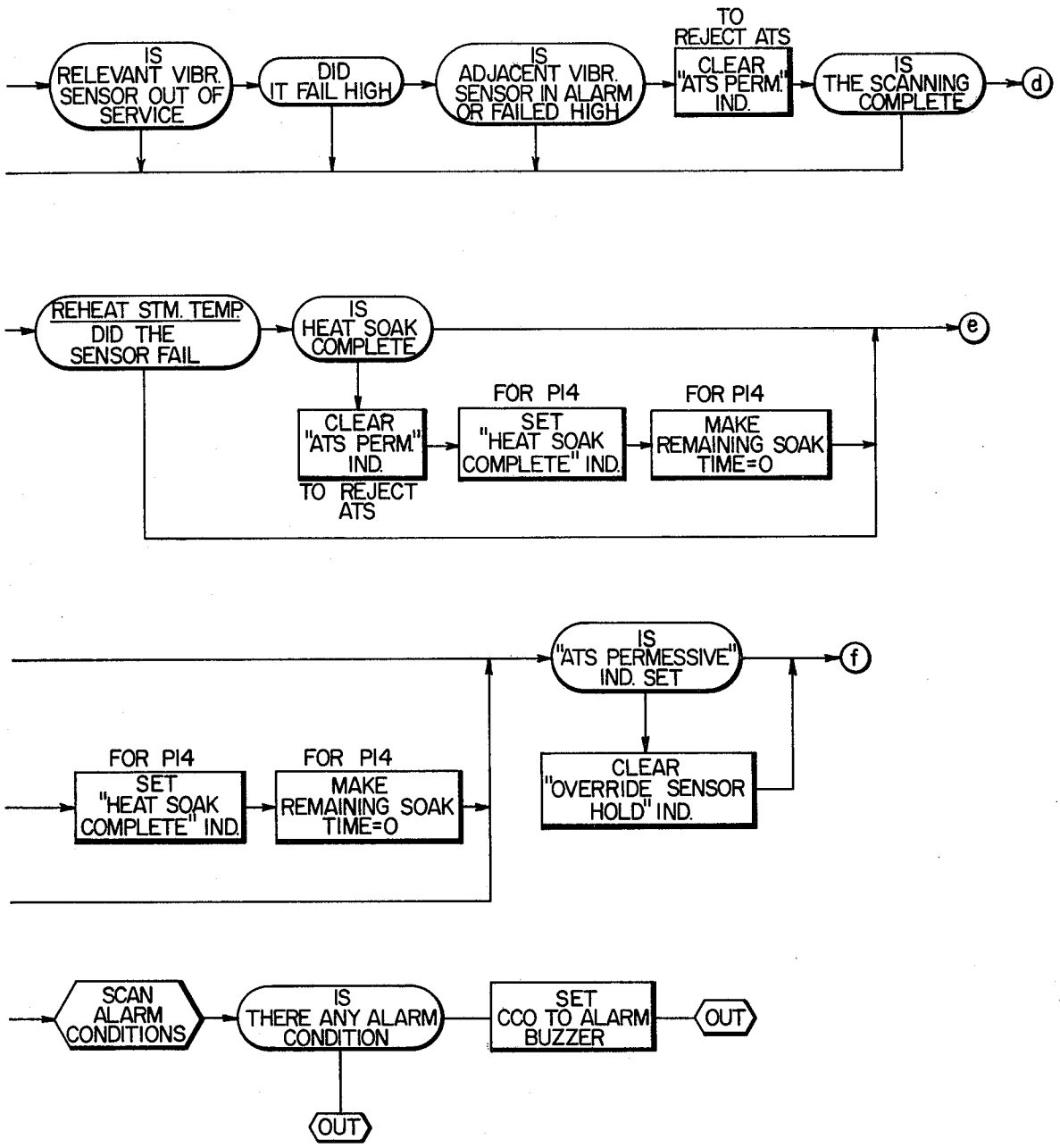
Figure 41A:
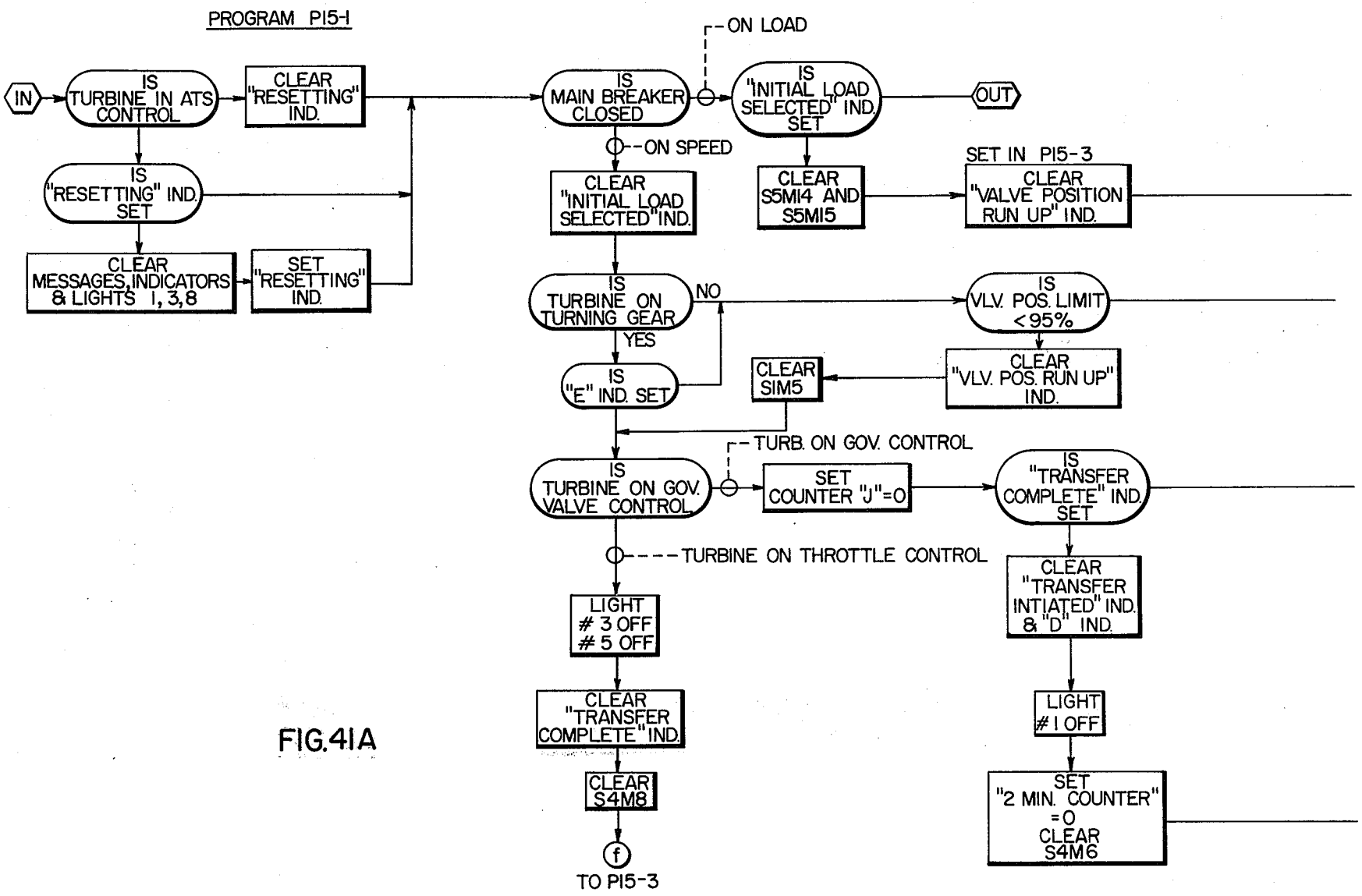
FIGS. 41A and 41B show a flow chart of the ATS program resetting and clear functions which are operable in accordance with the principles of the invention.
Figure 41B:
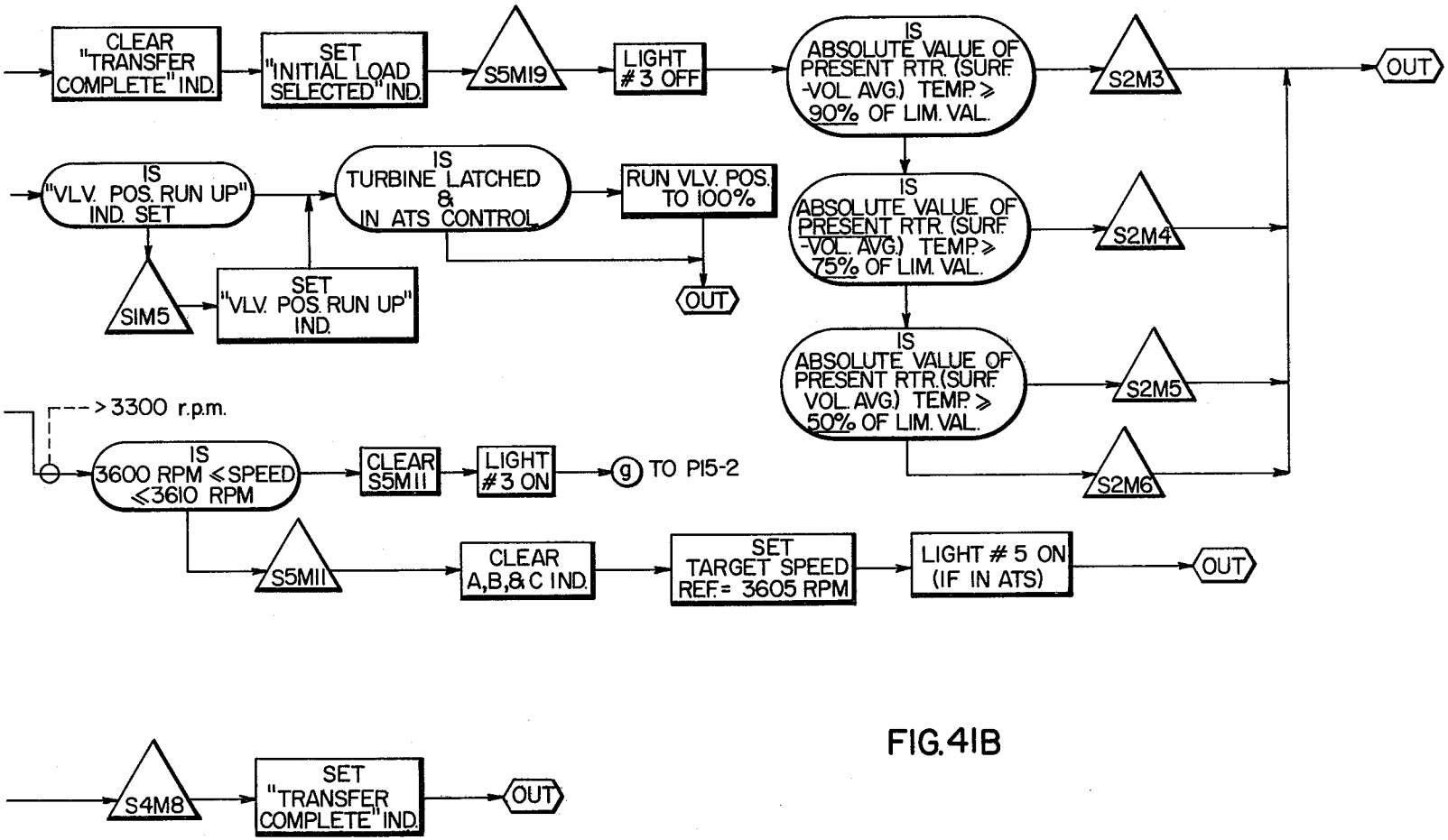
Figure 42A:
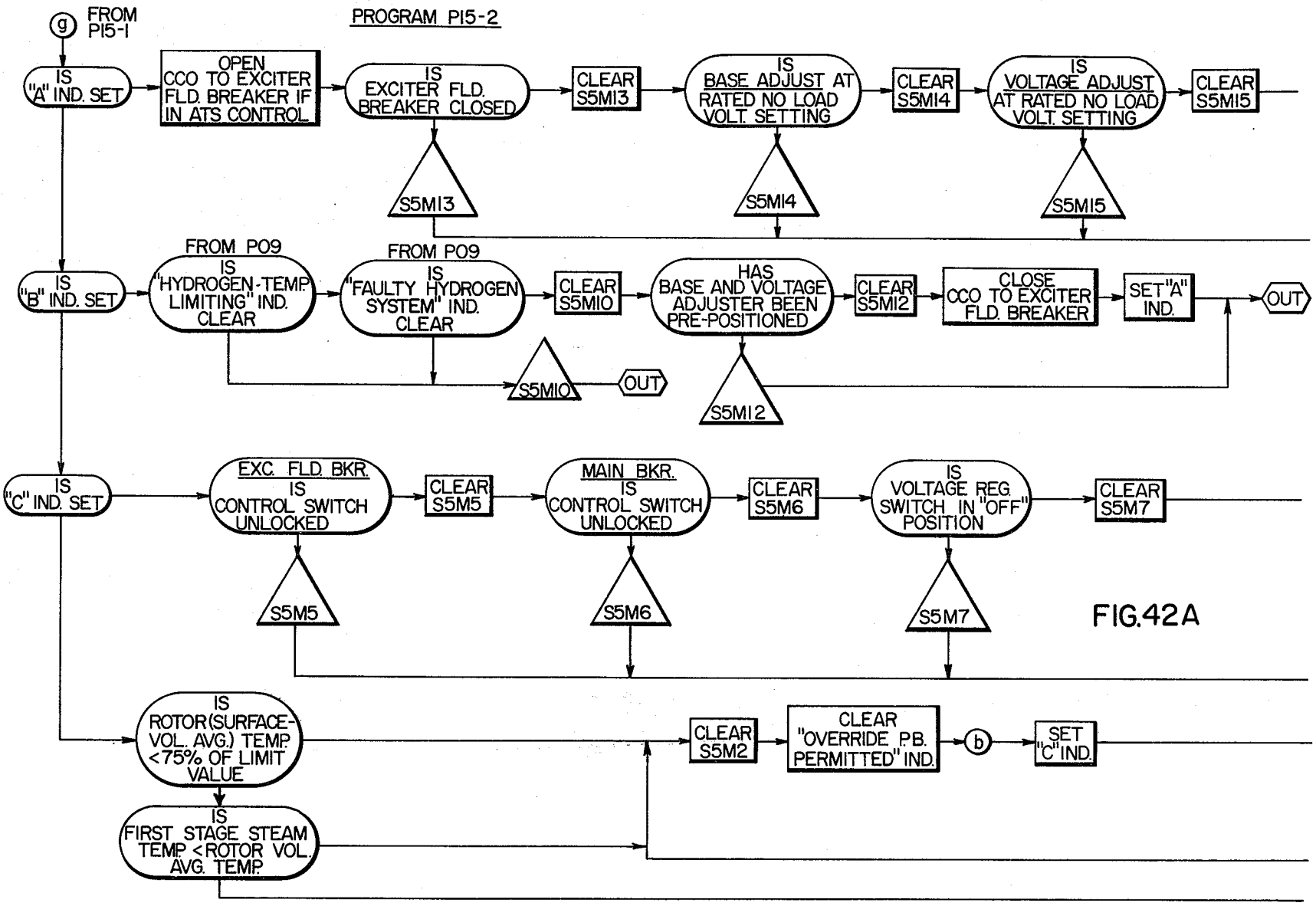
FIGS. 42A and 42B show a flow chart of the ATS generator monitor which is operable in accordance with the principles of the invention.
Figure 42B:
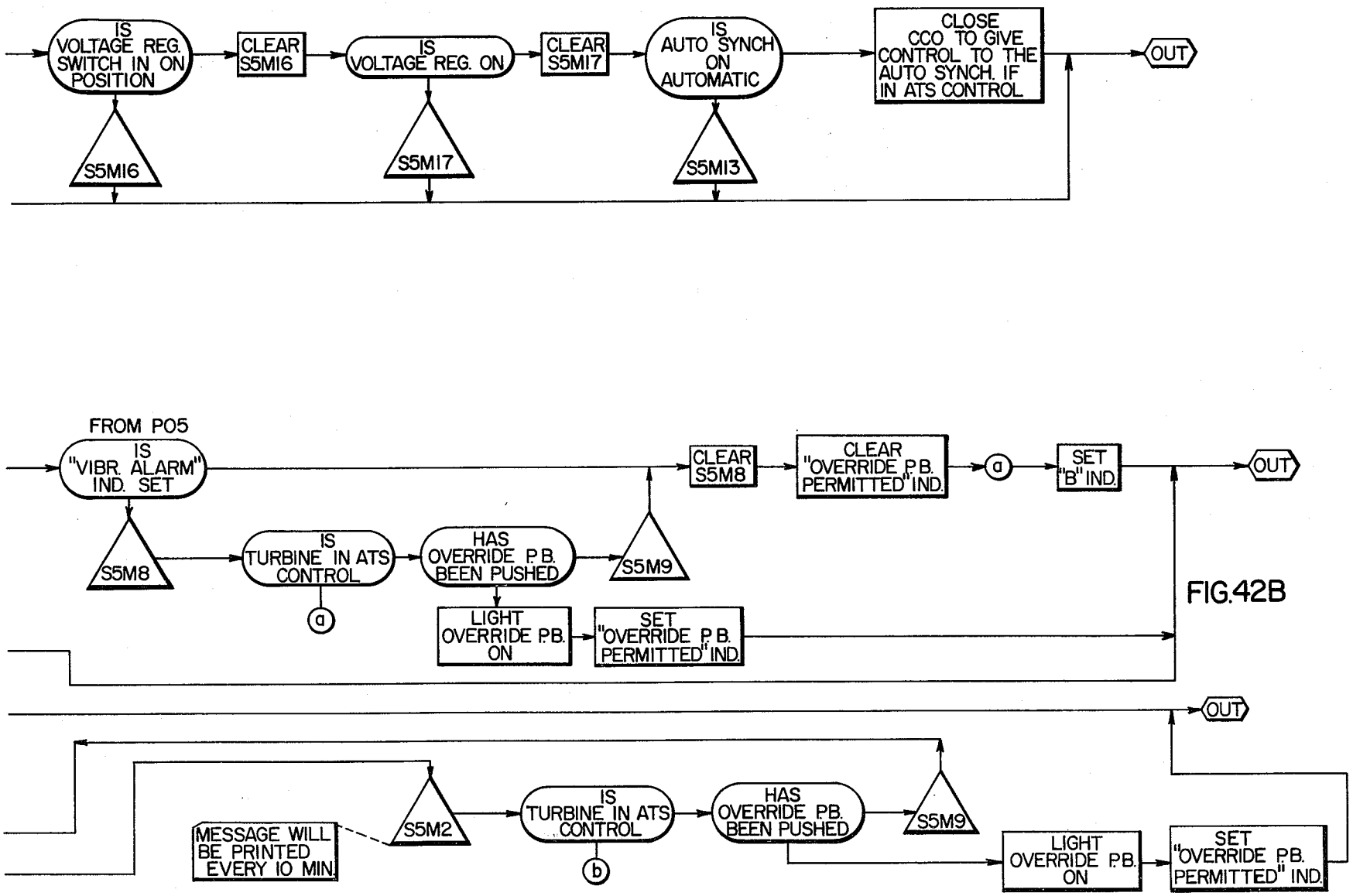
Figure 43A:
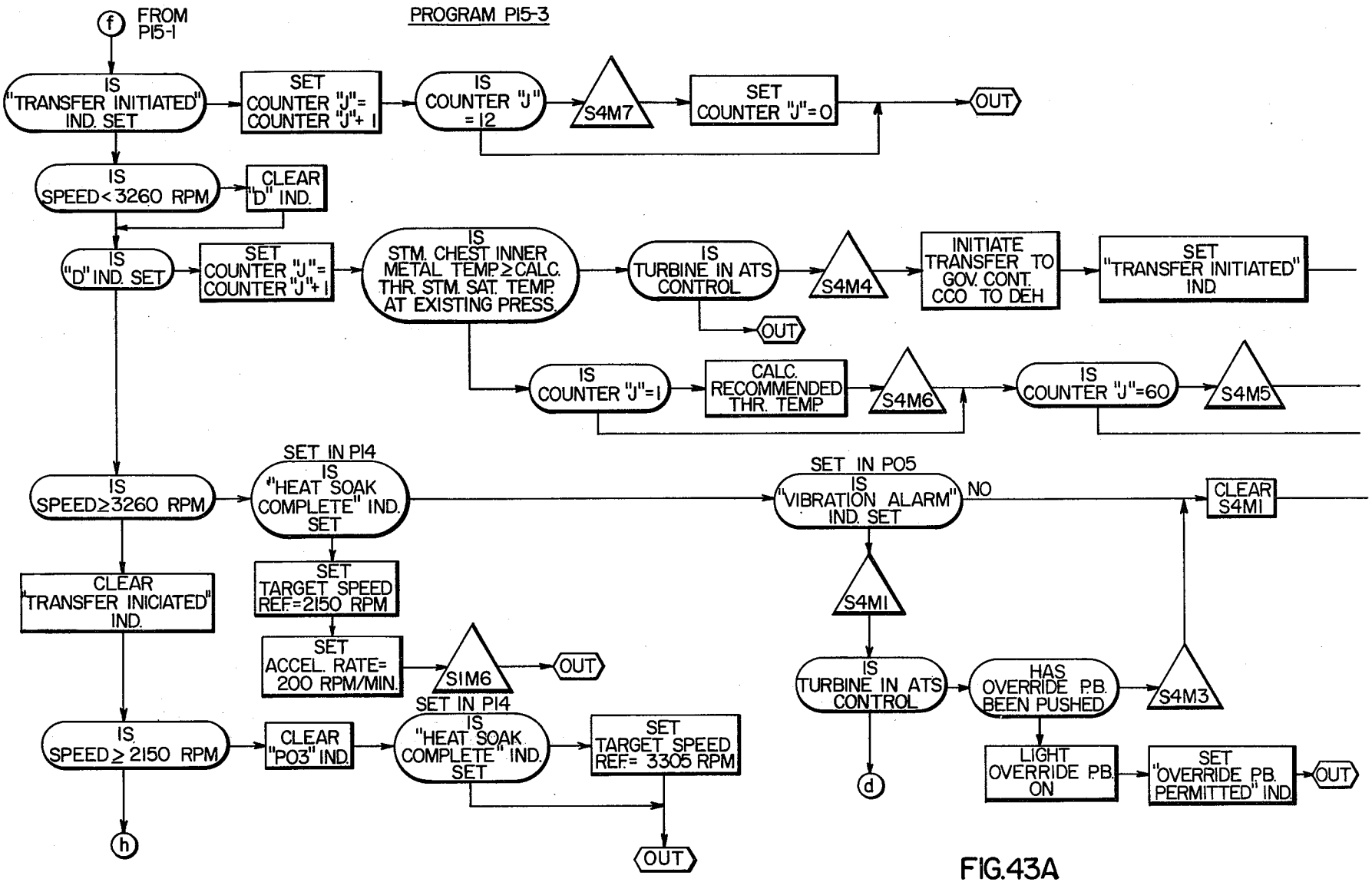
FIGS. 43A and 43B show a flow chart of the ATS transfer logic front speed to load control which is operable in accordance with the principles of the invention.
Figure 43B:
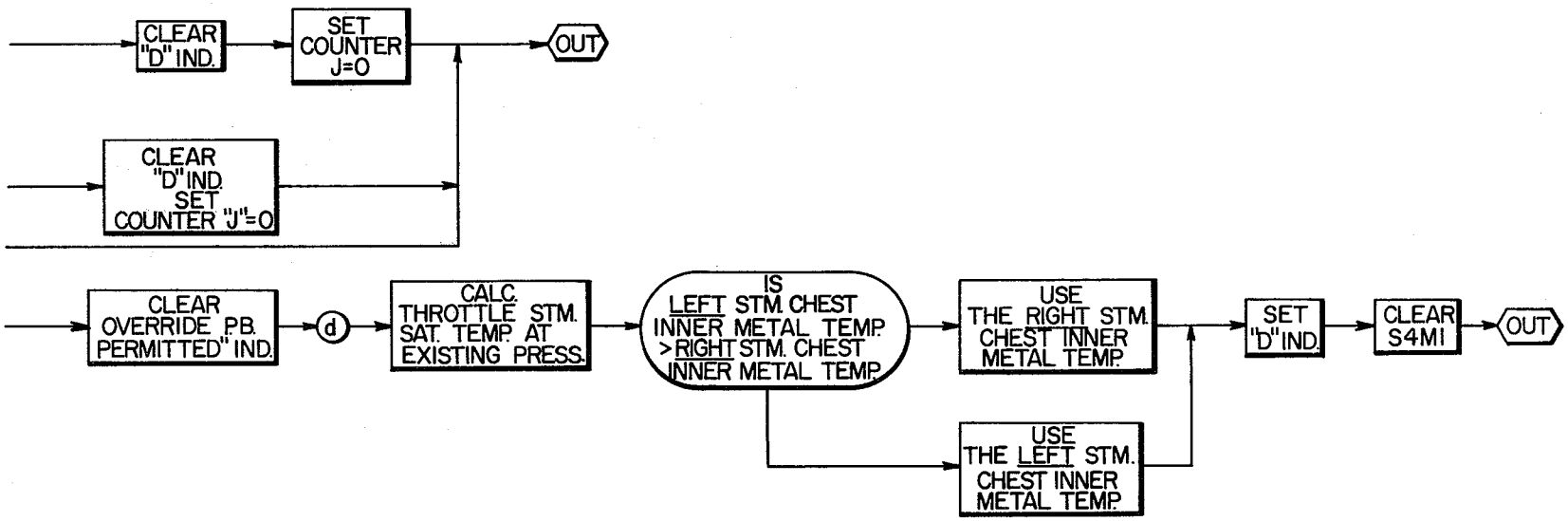
Figure 44A:
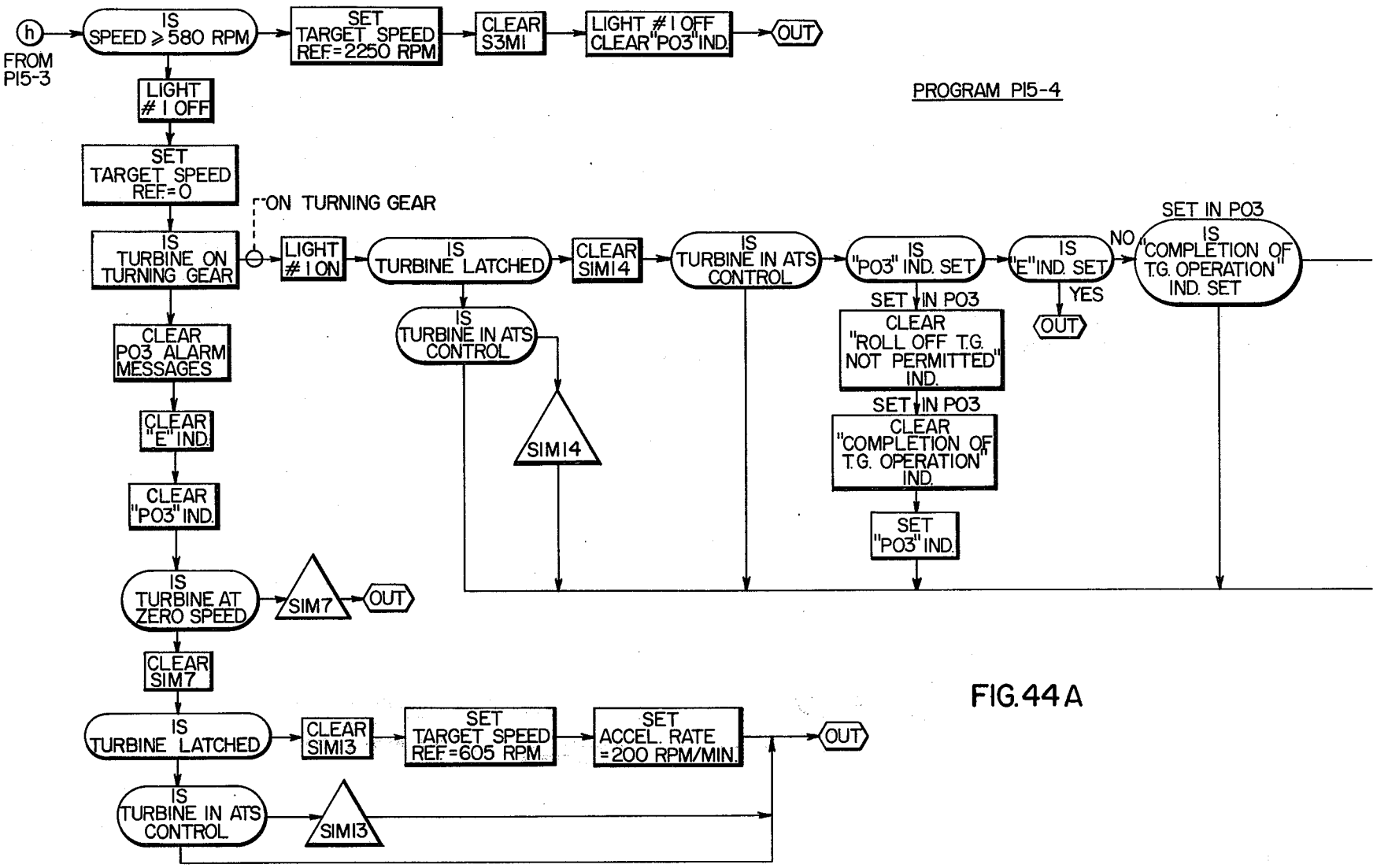
FIGS. 44A and 44B show a flow chart of the ATS program turbine latch which is operable in accordance with the principles of the invention.
Figure 44B:
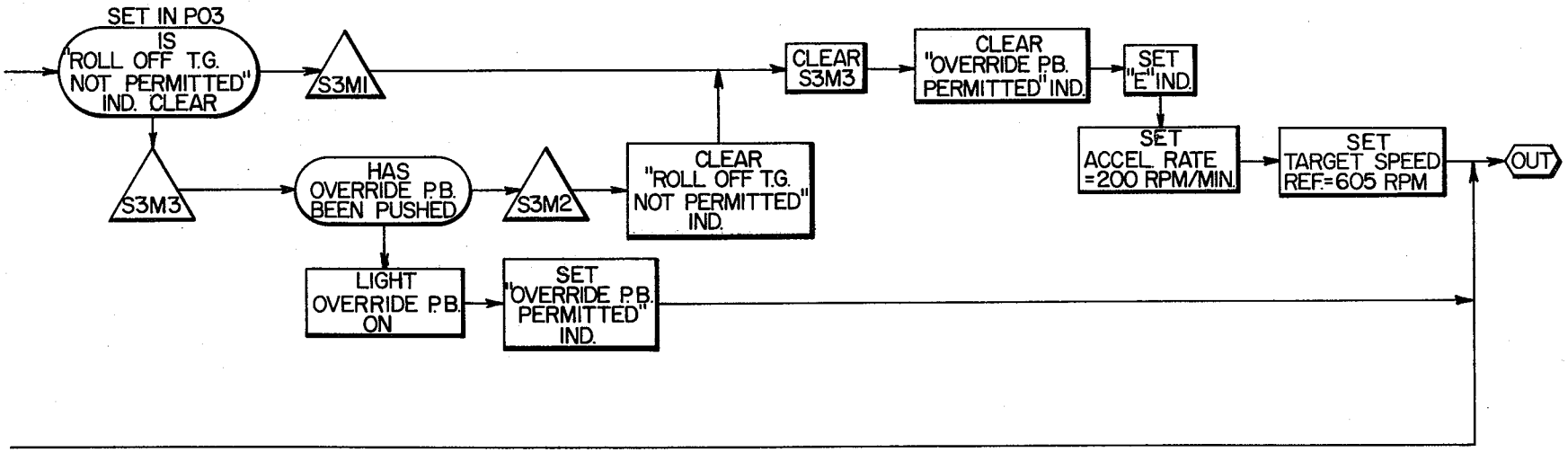
Figure 45:
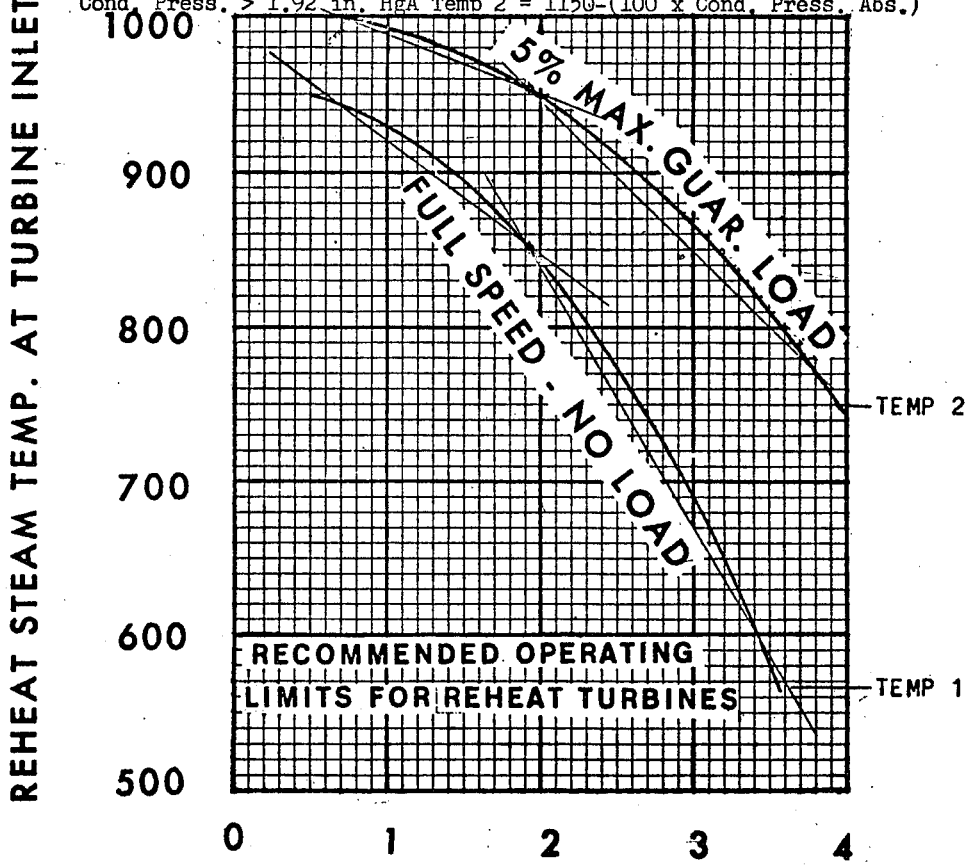
FIG. 45 shows a graph of no load and light load guides which are operable in accordance with the principles of the invention.
Figure 46:
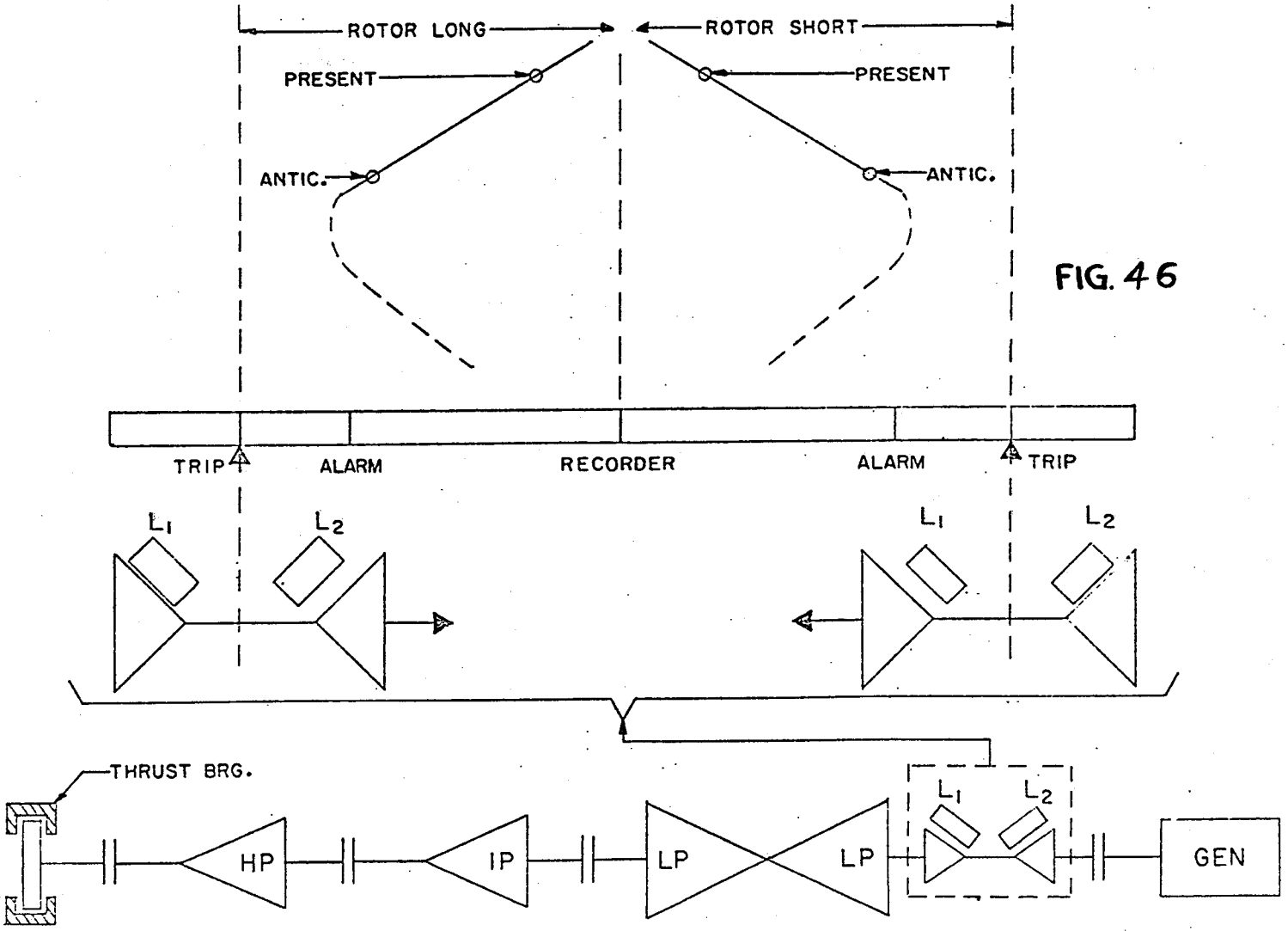
FIG. 46 shows a schematic representation of turbine generator differential expansion which is operable in accordance with the principles of the invention.
Figure 47:
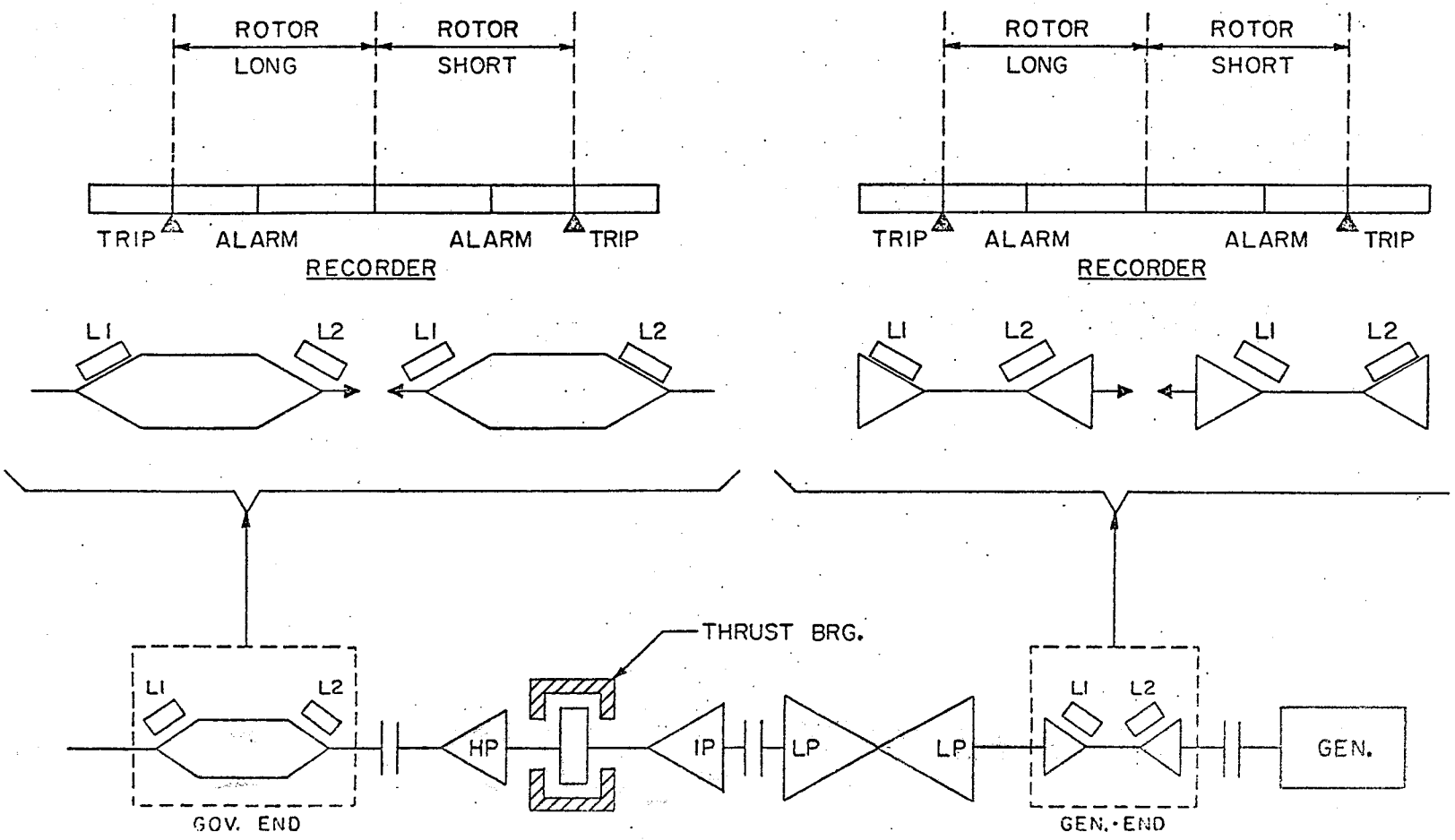
FIG. 47 shows a schematic representation of turbine generator differential expansion which is operable in accordance with the principles of the invention.

Supervision Of Drain Valves And Computation Of Anticipated Differential Expansion This program can be considered an extension of PO2. The anticipated differential expansion in one or both ends is calculated and appropriate actions determined. Drain valves position are monitored and commands to open and close them (generated in accordance with speed and loading conditions as well as recommendation emanated of the recent water prevention operating procedures) are given. See FIGS. 38A and 38B

Program Sequence

The GOVERNOR END AND GENERATOR END anticipated (desired) differential expansion is checked against the alarm and trip limits resulting in different actions taken by PO7. The present temperature is calculated by a desired anticipation algorithm $T_A = T_{-5} + 5\,(T_{-5} - T_{-6})$.

Governor End. Two different actions are taken when the alarm limits are exceeded.

If the rotor tends to become shorter the ANTIC. DIFF. EXP. RATE indicator is set in order to increase the acceleration which will result in an increase of the heat transfer coefficient. Therefore the rotor will heat faster counteracting the trend toward a shorter rotor. If the rotor tends to become longer the ANTIC. DIFF. EXP. SPEED HOLD indicator is set resulting in a speed or load hold made effective by PO7.

Generator End. A speed or load hold is accomplished through program PO7 when the ANTIC. DIFF. EXP. SPEED HOLD indicator is set as a result of an anticipation to a rotor along alarm condition.

If on speed control, the drain valves are opened if not already open.

If on load control at less than 20% load, the drain valves are opened. If load is greater than 20%, the drain valves are closed.

PROGRAM P12

Supervision Of LP Exhaust Temperatures

This program provides additional checks and calculations for a turbine with Building Block 73 to prevent overheating of the low pressure blades.

The temperature in the last row of blades is a direct function of the exhaust or condenser pressure. Therefore the LP exhaust pressure is used as the sensible index to determine low pressure blade conditions.

Program Sequence

To determine if the low pressure end is exceeding preestablished limits a straight linear approximation of Operating Curve No. CT-22596B, attached, is being used.

The intersection of these two straight lines has been selected to be at 1.92 in. HgAbs., and its respective equations are:

1. For full speed - no load

If cond. press. abs. $< 1.92 -$ TEMP 1 $= 1000-(80 \times$ cond. press. abs.)

If cond. press. abs. $> 1.92 -$ TEMP 1 $= 1150-(160 \times$ cond. press. abs.)

2. For 5% of MAX. GUAR. LOAD

If cond. press. abs. $< 1.92 -$ TEMP 2 $= 1023-(33.3 \times$ cond. press. abs.)

If cond. press. abs. $> 1.92 -$ TEMP 2 $= 1150-(100 \times$ cond. press. abs.)

If the reheat temperature does not fall below the curve for FULL SPEED - NO LOAD (see curve No. CT22596B) or in other words if reheat temperature is larger than TEMP 1 an indicator named VACUUM is set to be used in the acceleration program P15. Its function is to hold turbine speed before the speed demand is moved up to the next higher level.

SPEED MODE

If the turbine is not on the line but close to rated speed two actions would be taken:

1. If there is not any bearing vibrating above the alarm limit the program will wait 4 minutes before advising the operator to reduce speed (if in OPER. AUTO) or decrease speed to the next lower step if it was not decreased already within the last 15 minutes. If speed was decreased already the program will wait 15 minutes total before advising the operator to go to OPER AUTO and place the turbine in turning gear.

2. If there is a bearing vibration above the alarm limit the operator will be advised to reduce speed (if in OPER AUTO).

In ATS the turbine speed will be brought down to the next lower step by program P15 making use of the SPEED REF indicator. In any case after 15 minutes total the operator will be advised to go to OPER AUTO and turning gear.

LOAD MODE

No action will be taken if the load applied is larger than 5%. If it is less than 5% and the reheat temperature does not fall below the curve for 5% of MAX. GUAR. LOAD (curve No. CT-22596B) or in other words if reheat temperature is larger than TEMP.2 the operator will be advised to increase load to avoid overheating the LP blades.

PROGRAM P13

Sensor Failure Action

This program monitors the converted ATS analog input values for detection of sensor failures, and initiates special actions (i.e. rejects ATS) for correct system response if a sensor failure is detected. See FIGS. 39A through 40B.

Program Sequence

This program can be distinctly divided into two parts. The main purpose of the first part is scanning all converted analog inputs for detection of sensor failures.

If an input is not reliable the program determines if the action has already been completed for this failure.

If action is complete it determines if action was completed while not in ATS mode. If this is true and the ATS mode was just selected (in the last 5 sec.) the sensor failure conditions must be reevaluated for possible further action.

Otherwise, no further action is taken. If action was not completed, then the failure has just occurred or it occurred previously but has remained incompleted because of an outstanding sensor failure override that has been requested (to allow a substitution) has not been satisfied. This condition will light the OVERRIDE SENSOR HOLD pushbutton on the operator's panel.

If the failure has just occurred (within the last 5 seconds since previous monitoring) a sensor failure message is printed (P13M11), a contact closure is sent to a plant alarm and the required sensor failure action is initiated as well as any required sensor value substitutions if a sensor failure override is not required for the particular sensor in scan.

If the failure is not new and subsequent action is pending a sensor failure override by the operator, a substitution is made if the operator pushed the OVERRIDE SENSOR HOLD pushbutton. Otherwise, no further action is taken until the pushbutton is pressed.

The second part of P13 monitors key sensors for failures which have more serious consequence to the ATS programs than actions initiated in the first part. This action results in, Reverting to OPERATOR AUTO from ATS mode if 1. a differential expansion sensor failed.
2. a vibration sensor failed high and an adjacent vibration sensor failed high or is in an alarm condition.
3. the first stage metal temperature sensor failed.
4. the reheat steam temperature sensor failed.
5. the first stage steam temperature sensor failed.

Substitutions

Depending on the sensor type a direct or reference substitution will be applied. In the substitution table, each substitutable sensor is listed with its predefined substitution sensors with the latter listed in accordance with substitution priorities.

Direct Substitution

This occurs when either the last previous valid value of the failed sensor is used or some preassigned fixed value is inserted for the failed sensor.

The oil out of cooler temperature and the bearing oil pressure are in this class.

Reference Substitutions

This is based on a table of other sensors whose value may be used for the analog input of the failed sensor. Thus, if the left steam-chest inner-temperature sensor fails, the right steam-chest inner-temperature is used in its place, providing that this sensor has not also failed. However, if it too has failed, the next sensor specified in the list is used. If no valid substitute is listed, then no replacement will be made for the original sensor which failed.

Priorities

There is a priority system applied to the order in which failed sensors are monitored for substitution action. Further, certain sensors i.e. vibration, differential expansion, first stage temperature and reheat temperature are classed as nonsubstitutable and processed separately for sensor failure control action.

PROGRAM P14

Calculation And Timing Of Heat Soak Time

This program will compute the necessary soak time based on the more critical temperature in the first stage. It will keep track of the time and allow the start-up sequence control program P15 to continue as soon as the computed time has expired.

Considerations

The soaking time necessary to bring the rotor volume average temperature above 250°F is accomplished between 2200 and 2400 rpm. This speed is chosen as a compromise between soaking temperature and rotor velocity which generates undesirable centrifugal stresses.

The IP rotor is considered the most critical rotor. The energy absorbed by the rotor as a function of rotor temperature is represented by ENERGY versus TEMPERATURE curve (FIG. 2) obtained by the Charpy test method.

The transition point (A) which corresponds approximately to 50% of the ductile fracture falls in the 250°F zone for the IP rotor material. For the LP this transition point is below freezing.

The computation of the heat soak time is based conservatively on the lowest of four temperatures listed below or the combined and separate HP-IP case.

COMBINED HP-IP

Rotor volume average temperature b.o.v. (1)
Rotor volume average temperature present
First stage metal temperature b.o.v.
First stage metal temperature present
(1) b.o.v. stands for BEFORE OPENING THE VALVES.

SEPARATE HP-IP

IP metal temperature b.o.v.
IP metal temperature present
First stage metal temperature b.o.v.
First stage metal temperature present The b.o.v. temperatures are updated only when the unit is on turning gear. Once the unit rolls-off turning gear the updating process stops (See PO1).

Three indicators or flags are used in order to select the appropriate path in the program.

HEAT SOAK COMPLETE indicator which is cleared in PO1 only when the unit is on turning gear, determines if P14 will run. It is set when all thermal operating conditions have been satisfied.

SOAK TIME PERMITTED indicator. It is used as a means of determining the validity of message P14M1 (HEAT SOAK DELAY, SPD LO). This message is printed only when the soak time speed is lower than recommended and the reheat steam temperature is larger than 500°F. The heat soak time calculation is based on that temperature.

RETIME indicator. The selection of the heat soak temperature and the heat soak temperature calculation is done only when the unit is on turning gear and the first time this program runs to completion. This indicator will bypass the calculation portion of the program every time but the first time.

Program Sequence

When the soak time speed has been reached the lowest metal temperature is selected and the heat soak computed unless it is a hot start (lowest temperature 250°F) in which case heat soak is considered unnecessary.

The countdown of the heat soak time will start as soon as the reheat temperature goes above 500°F.

If for any reason the reheat temperature goes below 500°F the countdown will stop until the reheat temperature is reestablished. Once the soak time has timed out a final check on the rotor volume average temperature is done (it should be 250°F) before declaring that the heat soak cycle has been completed and allowing the turbine to continue acceleration.

PROGRAM P15

Acceleration Sequence

This program runs continuously, however, its actions are only accepted by the DEH if on ATS Control. In a normal start-up this program brings the turbine from turning to synchronous speed and turns the DEH Controller REFERENCE to the AUTOSYNCHRONIZER.

If the starting sequence is interrupted by a hold requested by any of the monitoring programs, it will resume its logical sequence where it was interrupted. See FIGS. 41A through 44B.

P15-1

The program will be in ATS Control when a flag set in the DEH Logic Program is set. This flag is set when not in loading mode, not in OPER. AUTO, and when the SENSOR FAILURE REJECT ATS indicator, (which is set by the SENSOR FAILURE ACTION program) is clear.

If in speed control and not in TG (turning gear) the VALVE POSITION LIMIT will be run up if it is set at less than 95%.

None of the conditions questioned in the vertical line between the questions IS TURB. ON T.G. will be affirmatively answered.

For study purposes we will assume that the unit is in TG and the ATS control P.B. has been pushed. Refer to P15-4.

If the unit is latched and in ATS control PO3 flags are cleared. This is done to make sure that the latest PRE-ROLL conditions are being checked.

The "E" flag, set when the program has been overriden or the pre-roll completed successfully, is now not set, therefore, when PO3 has completed successfully the pre-roll check out, an ACC RATE of 200 RPM/MIN. and a TARGET speed of approximately 605 RPM is selected.

The turbine now will accelerate at the selected rate until the selected target speed is reached.

By now the E flag has been set. The program will jump to repeatedly select the target speed until the turning gear disengages. If no HOLD has been requested by the monitoring programs the turbine will continue to accelerate until a speed larger than 580 RPM has been reached. At this point a new target speed between 2200 and 2400 RPM is selected.

The acceleration rate by now could have been increased by PO7 which will every 3 minutes recognize an increase or decrease request by PO4 which looks at the rotor stress computation and determines the course of action.

P15-3

Once the turbine has reached HEAT SOAK SPEED (2200 to 2400 RPM) the program will come down the same path until P14 sets the HEAT SOAK COMPLETION indicator. Then a new target speed of the order of 3300 RPM is selected and the turbine accelerates now at the present acceleration rate. This rate is being updated every 3 minutes as a result of the rotor stress calculation.

Again the turbine will accelerate to reach the new target speed. In the next step the transfer from throttle valves to governor valves occurs. Prerequisites are that all vibration levels be below the alarm limit and that the cooler steam chest inner temperature be larger than the throttle temperature at existing pressure. This is to avoid water condensation on the chest walls once the transfer is accomplished. We must remember that when in governor valve control the pressure in the steam chest is equal to the throttle pressure. "D" is set above 3260 RPM when:

1. there is not any vibration alarm
2. there has been a vibration alarm override.

Once D flag is set and the correct throttle temperature is achieved, the transfer is initiated.

If the throttle temperature is too cold the recommended throttle temperature is recalculated and printed out every 10 minutes.

Also, every 10 minutes a message indicating the cause of the transfer delay is output. Once the transfer has been initiated the system will have 2 minutes to complete it. If it has not been completed in 2 minutes this will be indicative of a malfunction and a message requesting the operator to take control will be printed out with the latter frequency.

The time counter is shown as counter "J" in this program.

P15-1

The unit should now be in GOV. CONTROL, therefore, the transfer is completed and a message indicating this condition is printed out.

The next time the program runs, a new target speed reference (equals synchronous speed) will be selected and the acceleration continued until the turbine speed is within synchronization range (SYNCHRONOUS SPEED ± 50 RPM). At this point the pre-synch check out starts.

P15-2

Indicator A, B and C are used to run this part of the program in a certain sequence.

It is desirable that the (surface-volume average) temperature differential in the rotor be less than 75% of the allowable limit before the unit is synchronized.

If the latter is not so the program will proceed only if the rotor average temperature is larger than the first stage steam temperature. If this second condition is not met the operator will have to override the program in order to complete the automatic start-up.

Otherwise the OPERATOR AUTO mode will have to be selected to make use of the remaining synchronizing monitor sequence. The program continues checking conditions that should have been accomplished by the operator beforehand. These are:

The exciter field breaker should be unlocked.

The generator main breaker should be unlocked.

The voltage regulator switch is in the OFF position.

Vibration and generator system conditions are checked before the program determines if the base adjuster and voltage adjuster have been prepositioned to the rated voltage, no load position. These will be prepositioned by motor operators which are actuated by a contact closure when the exciter field breaker is opened.

The exciter field breaker is closed by a contact closure output from the DEH controller. This contact reopens after 10 seconds.

Successively the program checks if the:

1. exciter field breaker has closed.
2. base adjuster is at rated no load setting.
3. voltage adjuster is at rated no load setting.
4. voltage regulator switch is in the On position.
5. voltage regulator is ON.
6. auto-synchronizer is in AUTOMATIC. This should have been set by the operator beforehand.

Messages indicating the discrepancies with the programmed logic are printed out. Finally the program will instruct the DEH controller to go in AUTO SYNC. mode allowing the automatic synchronizer to change the reference signal in the DEH.

A generator excitation system schematic is shown in FIG. 2.

Once the breaker closes a message dependent on the present rotor stress is printed out advising the operator on the most desirable loading rate.

ATS Control At Any Speed Level

This program will catch the unit on the fly and resume the start-up sequence setting the reference at the next higher reference step (600, 2200, 3300 or 3600 RPM).

G. SUMMARY

Improved Turbine and electric power plant operation is realized through the disclosed turbine startup, synchronizing, and load control systems and methods. Improved turbine and plant operation and management also results from the disclosed turbine monitoring and operator interface systems and methods. The improvements stem from advances in functional performances, operating efficiency, operating economy, manufacturing design and operating flexibility and operating convenience.

The present system supplements, expands and improves over the prior art. In doing so, the present system includes specialized programs for suppressing noise in the reference, demand and sensed parameter signals of the turbine-generator system; the programs are broken down into a series of master task programs and other programs for better utilization of the digital computer; a special program which monitors all of the programs and detects computing, addressing and transmitting errors therein increases the reliability, safety and flexibility of the system. Panel monitoring, information transmission and warning systems greatly increase the usefulness, ease-ofoperation and inherent reliability of the present system. A breaker open interrupt program indicating the loss of load connected to the generator prevents any overspeed condition from becoming serious. A stop and initialization program automatically readies the digital computer for immediate service after any computer or turbine stop or loss of power thereto, either instantaneous or long term. A logic program in the present system provides the capability for maintenance testing of logic functions; monitoring analog and digital speed failure; increasing turbine supervision capabilities, expanding manual control capabilities of the computer allowing an operator to work in conjunction with the automatic operation of the turbine generator system with the digital computer. The logic program also including hold and suspend sytems; governor and throttle valves control interlock systems; turbine latching logic programs; breaker logic programs; throttle pressure control logic programs; megawatt feedback logic; impulse pressure feedback logic; speed feedback logic; automatic synchronizer logic; automatic dispatch system logic; automatic turbine startup logic and remote transfer logic.

The control program of the present system includes the capability of time updating any function in the computer; limiting the position of predetermined valves in the turbine system; testing any valve in the system, checking for contingency conditions such as inoperativeness of any program or hardware; being able to select various speed control functions and various hardware therein for high reliability; selecting a series of operating modes in both load and speed modes of operation, providing speed and load reference functions with flexibility to change these during operation, switching between the speed control function and the load control functions during the automatic operation of the DEH system providing governor valve control functions and peripheral functions, such as, lags and nonlinear characterization of characteristics in the turbine-generator system.

The present system also has an elaborate programming system for better communications between an operator and the digital computer through use of special panel task program. The panel programs include a buttondecoding program, a control switching system, a display system or displaying a vast number of system parameters of the turbine generator system, a system for changing during operation most parameters and constants in the digital computer with great ease and rapidity, a capability to select a great number of operating modes, a system for checking the status of predetermined valves in the system and display devices therefor, a testing system for predetermined valves in the system, a limiting provision for limiting the position of predetermined valves in the system. In addition the panel programs provide for the control of automatic turbine startup programs; the control of the digital computing system through the use of a series of manual buttons, switches, toggles, etc.; the program capability of monitoring keyboard activity for failsafe and improper operation thereby preventing operator mistakes from resulting in improper signals and siganling means or warning an operator of any improper commands or mistakes in his operation of the keyboard, panels etc.

I claim:

1. An electric power generating system comprising:

a. a steam turbine system;

b. a steam generator for providing steam to said steam turbine system;

c. an electric generator rotated by said turbine system, and adapted to be connected to an electric load;

d. means for digitally computing and processing, having a central processor unit and a memory interconnected with said central processor unit;

e. means for converting input signals to digital data, said input converting means connected to said digital computing means;

f. means for converting digital data to output signals, said digital to output converting means connected to said digital computing means;

g. means for sensing the value of predetermined turbine operating parameters, including differential expansion of predetermined parts of said turbine, and for generating input signals representative of said parameters, said sensing means being connected to said input converting means;

h. means for controlling the steam flow to said turbine;

i. means for connecting said output signal converting means to said steam flow control means;

j. said digital computer means being characterized in that it is programmed to perform a plurality of respective functions in accordance with a predetermined priority, said functions including i. computing turbine control signals which are a function of at least one of said input signals, ii. comparing said sensed differential expansion signals with respective predetermined limits, iii. modifying said computed control signals as a function of said comparison; and k. said computed control signals being converted to output signals by said output converting means for controlling said steam flow control means as a function of said sensed parameters so as to control steam flow as an intermediate variable, and to control turbine speed during startup and turbine load during load operation as end operating variables.

2. The system as described in claim 1, wherein said modifying function comprises adjusting said control signals to hold speed during turbine startup when the differential expansion at the turbine generator end is outside of a predetermined range.

3. The system as described in claim 1, wherein said modifying function comprises adjusting said control signals to accelerate speed during turbine startup when the sensed differential expansion at the turbine governor end is less than a predetermined limit.

4. The system as described in claim 1, wherein said modifying function comprises adjusting said control signals to hold speed when said sensed differential expansion at the governor end is greater than a predetermined limit.

5. An electric power generating system comprising:

a. a steam turbine system;

b. a steam generator for providing steam to said steam turbine system;

c. an electric generator rotated by said turbine system, and adapted to be connected to an electric load;

d. means for digitally computing and processing, having a central processor unit and a memory interconnected with said central processing unit;

e. means for converting input signals to digital data, said input converting means connected to said digital computing means;

f. means for converting digital data to output signals, said digital to output converting means connected to said digital computing means;

g. means for sensing the value of predetemined turbine operating parameters, including differential expansion of predetermined parts of said turbine, and for generating input signals representative of said parameter, said sensing means being connected to said input converting means;

h. means for controlling the steam flow to said turbine;

i. means for connecting said output signal converting means to said steam flow control means;

j. said digital computer means being programmed to perform the functions of i. carrying out a plurality of respective computing functions in accordance with a programmed priority, ii. computing turbine control signals which are a function of at least one of said input signals, iii. comparing said sensed differential expansion signals with respective predetermined limits; and iv. modifying said computed control signals when one of said sensed differential expansion signals exceeds its respective predetermined limit;

k. said computed control signals being converted to output signals by said output converting means for controlling said steam flow control means as a function of said sensed parameters so as to control steam flow as an intermediate variable, and to control turbine speed during startup and turbine load during load operation as end operating variables.

6. The system as described in claim 5, wherein said digital computer means comprises means for adjusting said control signals to hold speed during turbine startup when the differential expansion at the turbine generator end is outside of a predetermined range.

7. The system as described in claim 5, wherein said digital computer means comprises means for adjusting said control signals to accelerate speed during turbine startup when the sensed differential expansion at the turbine governor end is less than a predetermined limit.

8. The system as described in claim 5, wherein said digital computer means comprises means for adjusting said control signals to hold speed when said sensed differential expansion at the governor end is greater than a predetermined limit.

9. An electric power generating system comprising:

a. a steam turbine system;

b. a steam generator for providing steam to said steam turbine system;

c. an electric generator rotated by said turbine system, and adapted to be connected to an electric load;

d. means for digitally computing and processing, having a central processor unit and a memory interconnected with said central processing unit;

e. means for converting input signals to digital data, said input converting means connected to said digital computing means;

f. means for converting digital data to output signals, said digital to output converting means connected to said digital computing means;

g. meas for sensing the value of predetermined turbine operating parameters and for generating input signals representative of said parameters, said sensing means being connected to said input converting means;

h. means for controlling the steam flow to said turbine i. means for connecting said output signal converting means to said steam flow control means;

j. said digital computer means being characterized in that it is programmed to perform a plurality of respective functions in accordance with a predetermined priority, said functions including i. computing turbine control signals which are a function of at least one of said input signals;

ii. computing signals representative of stress in the rotor of said turbine;

iii. comparing said stress signals with predetermined limits and modifying said control signals as a function of said comparison; and k. said control signals being converted to output signals by said output converting means for controlling said steam flow control means as a function of said sensed parameters so as to control steam flow as an intermediate variable, and to control turbine speed during startup and turbine load during load operation as end operating variables.

10. The system as described in claim 9, wherein said digital computer means is further characterized in that it is programmed to compute signals representative of anticipated rotor stress, to compare said anticipated stress signals with predetermined limits, and to modify said control signals as a function of said comparison of anticipated stress.

11. A steam turbine system comprising:

a. a steam turbine adapted to receive steam from a steam generator;

b. means for determining representations of at least one predetermined thermal condition of the rotor portion of said turbine and of the differential expansion of predetermined parts of said turbine;

c. means for sequentially i. determining representations of an anticipated value of said at least one predetermined condition, and ii. generating control signals as a predetermined function of said anticipated thermal condition representations and of said differential expansion representations; and d. means for controlling the turbine steam control conditions which affect said predetermined thermal condition, in response to said control signals.

12. The steam turbine system as described in claim 11, wherein said at least one predetermined thermal condition is rotor stress.

13. An electric power generating system comprising:

a. a steam turbine system;

b. a steam generator for providing steam to said steam turbine system;

c. an electric generator rotated by said turbine system, and adapted to be connected to an electric load;

d. means for digitally computing and processing, having a central processor unit and a memory interconnected with said central processing unit;

e. means for converting input signals to digital data, said input converting means connected to said digital computing means;

f. means for converting digital data to output signals, said digital to output converting means connected to said digital computing means;

g. means for sensing the value of predetermined turbine operating parameters and for generating input signals representative of said parameters, said sensing means being connected to said input converting means;

h. means for controlling the steam flow to said turbine;

i. means for connecting said output signal converting means to said steam flow control means;

j. said digital computer means being characterized in that it is programmed to periodically
   i. compute values of representations of turbine rotor stress,
   ii. compute anticipated values of said representations, and
   iii. compute control signals in response to the difference between said representations and said anticipated values and at last one reference value for said representations and for said anticipated values; and
k. said control signals being converted to output signals by said output converting means for controlling said steam flow control means as a function of said sensed parameters so as to control steam flow as an intermediate variable, and to control turbine speed during startup and turbine load during load operation as end operating variables.

14. A steam turbine system for providing power to an electric generating system comprising:
a. a steam turbine adapted to receive steam and to drive an electric generator;
b. means for digitally computing and processing, having a central processor unit and a memory interconnected with said central processing unit;
c. means for converting input signals to digital data, said input converting means connected to said digital computing means;
d. means for converting digital data to output signals, said digital to output converting means connected to said digital computing means;
e. means for sensing the value of predetermined turbine operating parameters and for generating input signals representative of said parameter, said sensing means being connected to said input converting means;
f. means for controlling the steam flow to said turbine;
g. means for connecting said output signal converting means to said steam flow control means;
h. said digital computer means being programmed to perform the functions of
   i. computing representations of anticipated values of turbine rotor stress;
   ii. computing control signals in response to the difference between said representations and at least one reference value for said representations; and
i. said control signals converted to output signals by said output converting means for controlling said steam flow control means as a function of said sensed parameters so as to control steam flow as an intermediate variable, and to control turbine speed during startup and turbine load during load operation as end operating variables.

15. An electric power generating system comprising:
a. a steam turbine system;
b. a steam generator for providing steam to said steam turbine system;
c. an electric generator rotated by said turbine system, and adapted to be connected to an electric load;
d. means for sensing the value of predetermined turbine operating parameters, including first stage turbine metal temperature, and for generating signals representative of said parameters;
e. means connected to said sensing and generating means for performing the functions of
   i. generating cold start control signals as a function of said parameter signals, for controlling said turbine system through a cold start startup procedure when said metal temperature is below a predetermined value, and
   ii. generating hot start control signals as a function of said parameter signals, for controlling said turbine system through a hot start startup procedure when said metal temperature is above a predetermined value; and
f. means for controlling steam flow through said steam turbine system, said steam control means being connected to said means for performing and responsive to said control signals.

16. A steam turbine system for providing power to an electric generating system comprising:
a. a steam turbine adapted to receive steam and drive an electric generator;
b. means for generating representations of a plurality of turbine operating parameters, including the temperature of a predetermined portion of said turbine;
c. means connected to said generating means for performing the functions of
   i. selecting one of a predetermined plurality of startup procedures as a function of said temperature representation, and
   ii. generaing startup control signals as a function of said parameter representation for operating said turbine through said selected startup procedure; and
d. means for controlling steam flow through said steam turbine system, said steam control means being connected to said function performing means and responsive to said control signals.

17. The system as described in claim 16, wherein said startup procedures comprise a cold start startup procedure and a hot start startup procedure.

18. The system as described in claim 11, wherein said predetermined portion is first stage metal temperature.

19. The system as described in claim 18, wherein said means for controlling steam flow comprises valve means for controlling the flow of steam through said steam turbine, said valve means including valves operable to limit said flow of steam, and wherein said generating means generates a representation of first stage metal temperature before opening valves.

20. An electric power generating system comprising:
a. a steam turbine system;
b. a steam generator for providing steam to said steam turbine system;
c. an electric generator rotated by said turbine system, and adapted to be connected to an electric load;
d. means for digitally computing the processing, having a central processor unit and a memory interconnected with said central processing unit;
e. means for converting input signals to digital data, said input converting means connected to said digital computing means;
f. means for converting digital data to output signals, said digital to output converting means connected to said digital computing means;
g. means for sensing the value of predetermined turbine operating parameters and for generating input signals representative of said parameters, said sensing means being connected to said input converting means;

h. means for controlling the steam flow to said turbine;
i. means for connecting said output signal converting means to said steam flow control means;
j. said digital computer means being programmed to perform the functions of
  i. comparing first stage metal temperature before opening valves with a predetermined value;
  ii. generating control signals for taking said turbine system through a cold start startup procedure when said metal temperature is below said predetermined value; and
  iii. generating control signals for taking said turbine system through a hot start starting procedure when said metal temperature is above a predetermined value.

21. In an electric power generating system having a steam turbine with means for controlling steam flow therethrough, a steam generator, and an electric generator rotated by said turbine for delivering load to a power system, a method of operating said power generating system comprising:
a. sensing the values of predetermined turbine operating parameters, including differential expansion of predetermined parts of said turbine, and generating input signals representative of said parameters;
b. converting said input signals to digital data and inputting said digital data to a digital computer having a central processing unit and a memory interconnected with said central processing unit;
c. comparing in said digital computer said sensed differential expansion signals with respective predetermined limits;
d. computing in said digital computer turbine control signals which are a function of at least one of said input signals and of said comparison;
e. performing in said digital computer a plurality of respective computing and processing functions in accordance with a predetermined priority, said functions including said control signal computing and said comparing;
f. converting said control signals to output signals adapted to operate said turbine steam flow control means; and
g. controlling the operation of said turbine by using said control signals to operate said turbine steam flow control means during turbine startup.

22. The method as described in claim 21, comprising adjusting said control signals to hold speed during turbine startup when the differential expansion at the turbine generator end is outside of a predetermined range.

23. The method as described in claim 21, comprising adjusting said control signals to accelerate speed during turbine startup when the sensed differential expansion at the turbine governor end is less than a first one of said predetermined limits.

24. The method as described in claim 21, comprising adjusting said control signals to hold speed when said sensed differential expansion at the governor end is greater than a second one of said predetermined limits.

25. In an electric power generating system having a steam turbine system with means for controlling steam flow therethrough, a steam generator, and an electric generator rotated by said turbine system for delivering load to a power system, a method utilizing a digital computer for operating said power generating system, comprising:
a. concurrently sensing predetermined conditions in the region of the rotor of said turbine and differential expansion of predetermined rotor parts, generating signals representative of said rotor conditions and differential expansion, and inputting said representative signals to said digital computer;
b. computing, in said digital computer, signals derived from said condition signals and representative of stress in the rotor of said turbine system;
c. comparing, in said digital computer, said stress signals with predetermined limits;
d. performing, in said digital computer, a plurality of respective functions in accordance with a predetermined priority, said functions including computing control signals as a function of said stress comparison and of said differential expansion signals; and
e. controlling the steam flow from said steam generator to said steam turbine with said control signals, so as to control turbine speed during turbine startup and turbine load during load operation.

26. The method as described in claim 25, comprising computing, as a function of said computed stress signals, signals representative of anticipated rotor stress, and computing said control signals as a function of said anticipated rotor stress signals.

27. The method as described in claim 26, wherein said step of computing anticipated rotor stress signals comprises extrapolating anticipated stress signals from said computed stress signals.

28. A method of operating an electric power generating system having a steam turbine with means for controlling steam flow therethrough, a steam generator for providing steam, and an electric generator rotated by said turbine for delivering load to a power system, comprising:
a. periodically generating a representation of turbine rotor metal temperature;
b. periodically generating a representation of at least one anticipated thermal condition of said turbine rotor as a function of the difference between said determined metal temperature; and
c. controlling the turbine steam condition in the region of said rotor as a predetermined function of said generated anticipated thermal condition representations and at least one reference undue, said controlling step including generating control signals with a programmed digital computer and controlling said steam control means therewith.

29. The method as described in claim 28, wherein said representation of at least one anticipated thermal condition is a representation of anticipated rotor stress.

30. The method as described in claim 29, comprising the step of periodically comparing said anticipated rotor stress with a predetermined limit, and controlling said turbine steam condition as a function of said comparison.

31. The method as described in claim 30, wherein said step of generating anticipated rotor stress representations comprises extrapolating anticipated rotor stress from present rotor stress.

32. In an electric power generating system having a steam turbine system with means for controlling steam flow therethrough, a steam generator, and an electric generator rotated by said turbine system for delivering load to a power system, a method utilizing a digital computer for operating said power generating system, comprising:

a. sensing predetermined conditions in the region of the rotor of said turbine, generating signals representative of said rotor conditions, and inputting said rotor condition signals to said digital computer;

b. computing, in said digital computer, signals derived from said condition signals and representative of stress in the rotor of said turbine system;

c. computing, in said digital computer, as a function of said computed stress signals, signals representative of anticipated rotor stress, and computing in said digital computer control signals as a function of said anticipated rotor stress signals; and d. controlling the steam flow from said steam generator to said steam turbine with said control signals, so as to control turbine speed during turbine startup and turbine load during load operation.

33. The method as described in claim 32, wherein said step of computing anticipated rotor stress signals comprises extrapolating anticipated stress signals from said computed stress signals.

34. A method of operating an electric power generating system having a steam turbine with means for controlling steam flow therethrough, a steam generator for providing steam, and an electric generator rotated by said turbine for delivering load to a power system, comprising:

a. determining a representation of the temperature of a predetermined portion of said turbine system;

b. selecting one of a plurality of respective startup procedures as a function of said temperature representation, and operating said turbine system through said selected startup procedure;

c. generating a representation of at least one predetermined thermal condition of the rotor portion of said turbine system;

d. generating a representation of an anticipated value of said thermal condition; and e. said step of operating said turbine system through a selected startup procedure including controlling steam conditions which affect said predetermined rotor thermal condition.

* * * * *